US006097926A

United States Patent [19]

Takagi et al.

[11] Patent Number: 6,097,926

[45] Date of Patent: Aug. 1, 2000

[54] FIXING DEVICE USING AN INDUCTION HEATING UNIT

[75] Inventors: Osamu Takagi; Satoshi Kinouchi, both of Tokyo, Japan

[73] Assignee: Kabushiki Kaisha Toshiba, Kawasaki, Japan

[21] Appl. No.: 09/389,493

[22] Filed: Sep. 3, 1999

Related U.S. Application Data

[63] Continuation of application No. 09/226,062, Jan. 6, 1999.

[30] Foreign Application Priority Data

| | | | |
|---|---|---|---|
| Jan. 9, 1998 | [JP] | Japan | P10-002806 |
| Apr. 30, 1998 | [JP] | Japan | P10-120743 |
| May 1, 1998 | [JP] | Japan | P10-122258 |

[51] Int. Cl.[7] ..... G03G 15/20

[52] U.S. Cl. ..... 399/328; 219/216; 219/619; 399/67

[58] Field of Search ..... 399/67, 68, 69, 399/70, 328, 330, 331, 334, 397, 400; 219/216, 603, 619, 635, 663, 671; 118/60

[56] References Cited

U.S. PATENT DOCUMENTS

| | | | |
|---|---|---|---|
| 4,403,950 | 9/1983 | Maeda | 399/328 X |
| 4,996,567 | 2/1991 | Watarai et al. | 399/70 |
| 5,552,582 | 9/1996 | Abe et al. | 219/619 |
| 5,729,818 | 3/1998 | Ishizuka et al. | 399/400 |
| 5,809,368 | 9/1998 | Menjo et al. | 399/68 |
| 5,819,150 | 10/1998 | Hayasaki et al. | 399/330 |
| 5,822,669 | 10/1998 | Okabayashi et al. | 399/330 |
| 5,835,835 | 11/1998 | Nishikawa et al. | 399/328 |
| 5,881,349 | 3/1999 | Nanataki et al. | 399/328 |

FOREIGN PATENT DOCUMENTS

| | | |
|---|---|---|
| 5-019555 | 1/1993 | Japan . |
| 5-127552 | 5/1993 | Japan . |
| 5-158380 | 6/1993 | Japan . |
| 8-16005 | 1/1996 | Japan . |
| 9-80951 | 3/1997 | Japan . |

*Primary Examiner*—Arthur T. Grimley
*Assistant Examiner*—Sophia S. Chen

[57] ABSTRACT

A fixing device of the present invention includes a first roller that is made of a conductive material, and is rotated and driven; a second roller that is in contact with the first roller in the pressed state; and an induction heating unit that is arranged at the first roller side and concentrates the induction heating to the nip portion of the first roller and change a developer image formed on a fixing medium to a fixed imaged. This induction heating unit of the fixing device is made of a high permeable material, has a core that is open at the surface opposite to the first roller and a coil wound round the core and generates magnetic flux on the core when high frequency current is supplied to the core and has a high projecting portion so that a part of the core closes the first roller.

4 Claims, 46 Drawing Sheets

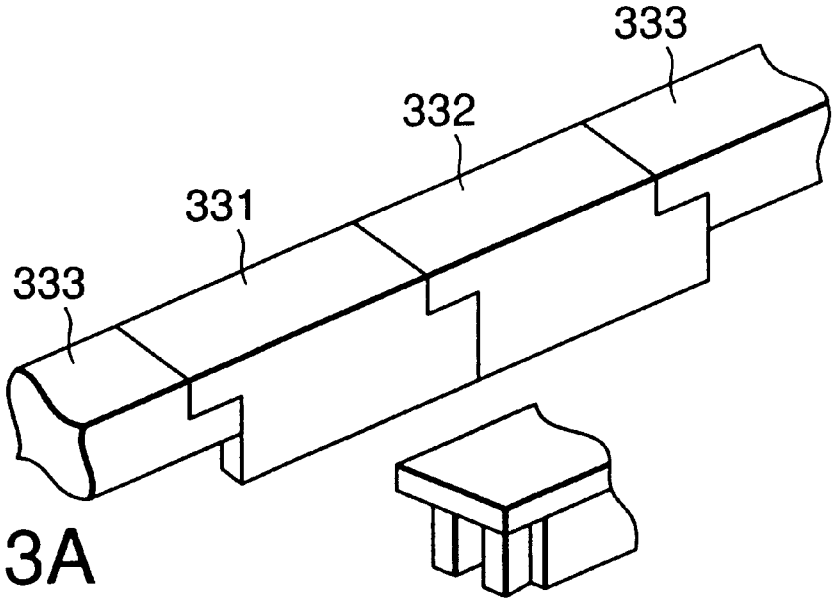
FIG.53A
FIG.53B
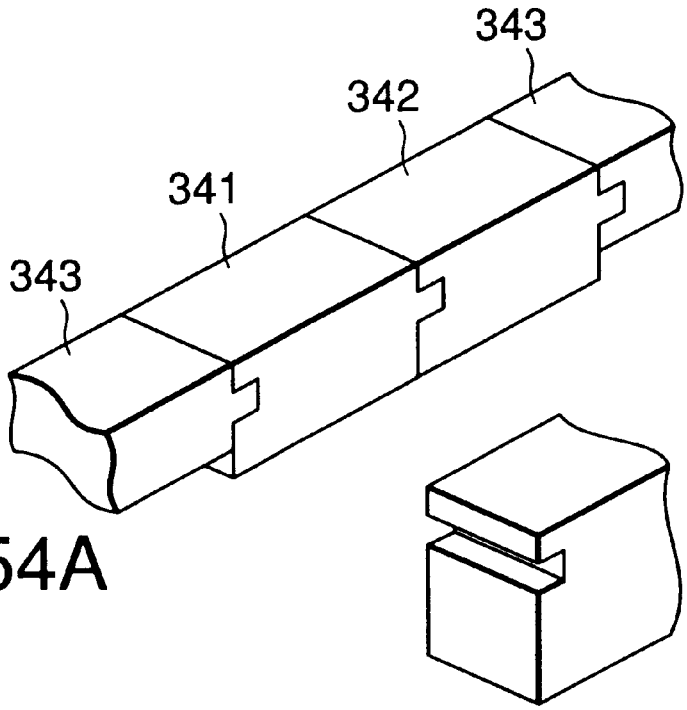
FIG.54A
FIG.54B

FIXING DEVICE USING AN INDUCTION HEATING UNIT

This application is a continuation, of application Ser. No. 09/226,062, filed Jan. 6, 1999.

BACKGROUND OF THE INVENTION

1. Field of the Invention

The present invention relates to a fixing device that is used on an image forming apparatus for obtaining a fixed image by fixing a developer image formed on a fixing medium.

2. Description of the Related Art

There are so far available such type of fixing devices comprising an image forming apparatus as those devices equipped with a heating roller and a pressure roller. The heating roller heats an image fixing medium, that is a paper, carrying a developer image formed thereon by a powder developer. The pressure roller is in contact with this heating roller via a fixing medium and conveys the fixing medium while applying the pressure on it.

When a fixing medium passes through a contacting portion (called as the nip) between these heating roller and pressure roller, a developer on this fixing medium is fused, press fitted and fixed.

So far, such a fixing device uses a halogen lamp, etc. as a heating source and a heating roller is composed by providing this halogen lamp, etc. in a metallic roller. In addition to this type of heating source, there are some fixing devices provided with a flush lamp and heat a fixing medium by lighting this lamp without contacting the fixing medium.

However, a lamp used as a heating source once converts electric energy into light and heats and applies them to a metallic roller by the radiant action and therefore, efficiency is worse and thermal efficiency is limited to about 70%.

Further, as much time is needed to warm-up the fixing at present, it is largely demanded to make the warm-up time short. So, there is a view to increase the nicer of lamps as a heat source from one to two pieces but this will not only make an apparatus large in size but also increase the power consumption.

In view of above, in order to make the start-up time short, several technologies to fix an image using the induction heating had been developed. For instance, the Japanese Patent Gazette No. 8-76620 disclosed an apparatus to fix a developer image on a recording medium by closely fitting this recording medium to a conductive film that is heated by a magnetic field generating means. Further, a technology to heat a thin metallic layer of a roller provided around a cylindrical ceramics by applying induction current using an induction coil has been disclosed in the Japanese Patent Gazette No. 59-33476.

However, these technologies have such a defect that a start-up time can be made short but are applicable only to copying machines that are operated at a low speed because there is available no heat storage element. Further, in order to run a film, a complicated control including a zigzag control is required and a cost will increase.

In the case of such an inducting heating type fixing device, it is desirable to use a strong magnetic material for heating a film by generating eddy current efficiently and an iron material is generally used.

An iron material has lower thermal conductivity than aluminum and copper materials, heat history tends to be left and the heat build-up characteristic of a heating means tends directly to appear. Accordingly, if a thin iron made roller is used, uneven temperatures are produced depending on accuracy of the position or heat build-up characteristic of said heating means.

Further, the shape of magnetic flux produced differs slightly at the central part and the end of a heating roller. So, a temperature becomes different between the central part and the end of the heating roller and the escape of heat from the end is larger than the central part and thus, a temperature difference is produced on a roller.

Further, such a problem was also caused that if an image fixing medium in smaller width than the fixing nip width is passed, a temperature difference is produced between the passed portion and the non-passed portion, this temperature difference is left as a temperature history and the uneven fixing will result.

In addition, on a fixing device utilizing the electromagnetic induction heating as described above, there was such problem shown below.

Core elements wound round heating coils are formed in one united body by cutting or using a mold and it was difficult to get a dimensional accuracy in the longitudinal direction. In particular, when a ferrite element is used for the core element, it was difficult to form a core in a complicated shape in one united body and if dimensional accuracy is demanded, a manufacturing cost will increase sharply. Further, if conductive materials (iron core, permalloy, amorphous metal) are used for core element when forming core elements in one united body, eddy current is generated on the core elements themselves and heat is generated by the core element itself. In other words, thermal efficiency drops.

Further, a core element formed in one united body has such problems that it is not possible to regulate a heat value in the longitudinal direction and the volume of heat radiated to the air at the end portion becomes larger than that at the central part of the nip portion, and the heating at the end portion becomes insufficient. Further, when an image fixing medium in the width smaller than that of the fixing nip was passed through the nip portion, a temperature difference is produced between the passed portion and the non-passed portion of the paper become different and while leaving this temperature difference as a temperature history, an uneven fixing was also-produced.

In case of a means to solve this problem as disclosed in the Japanese Patent Gazette No. 8-16005, a plurality of core elements are arranged in one direction and this state of arrangement is held by a holder. According to this structure, it is possible to prevent generation of eddy current in the core elements themselves. However, the structure with core elements simply arranged in one direction is often performed for cores of transformers, etc. and the basic structure to prevent generation of eddy current in core elements. Further, the cores arranged and held by a holder only may cause insufficient strength and it becomes difficult to maintain a distance to an image fixing medium accurately. Further, as rotary components are in the positions close to the cores, the structural strength is needed and the insufficient strength results from the structure to hold the arranged cores by a holder. In addition, there was a problem that individual core elements are oscillated in the holder by the oscillation accompanied with the rotation. Further, there were also such problems that a magnetic field generating means including core elements becomes a large size as a result of the holder provided around the core elements and it becomes difficult to downsize the unit, etc.

SUMMARY OF THE INVENTION

It is an object of the present invention to provide a fixing device that is capable of making a warm-up time short, uniformly supplying heat generated through the induction heating to rollers without generating uneven temperature at a fixing nip, and fixing an image even in copying machines of fast copying speed.

It is a further object of the present invention to provide a fixing device that has improved machining accuracy and dimensional accuracy of core elements, reduced manufacturing costs, maintains the same strength as that when core elements are formed in one united body and eliminated generation of insufficient heating, improper fixing, uneven temperature, etc.

It is another object of the present invention to provide a fixing device that has high thermal efficiency and is able to be manufactured at a cheap price.

According to the present invention, a fixing device is provided, which comprising: a first roller that is made of a conductive material, and rotated and driven; a second roller that is in contact with the first roller in the pressed state to pass a fixing medium on which a developer image formed between these rollers; and an induction heating unit that is arranged at the first roller side and concentrates the induction heating to a contacting point of the first roller to change the developer image formed on the fixing medium to a fixed image; wherein the induction heating unit is made of a high permeable material, has a core of which surface opposite to the first roller opens and a coil wound round this core and generates magnetic flux in the core when high frequency current is supplied, and has high projecting portions of a part of the core so as to close the first roller.

Further, according to the present invention, a fixing device that is provided with: a core and a magnetic field generator comprising a coil wound round the core, generates eddy current on a heater by the magnetic field generator and fixes a developer image formed on a recording medium by the heat generated on the heater based on the eddy current; wherein the core is composed by laminating and bonding a plurality of core elements having at least more than one cross sectional shapes.

Further, according to the present invention, a fixing device comprising a heating member that moves at a speed equal to a moving speed of a fixing medium and by contacting the fixing medium, fixes an image on the fixing medium by heating it; and an induction heating unit to heat the heating member; wherein the induction heating unit has a core element and a coil element wound round this core element, and the core element is divided into plural portions on the dividing surfaces that have a surface vertical to the conveying direction of a fixing medium.

BRIEF DESCRIPTION OF THE DRAWINGS

FIG. 1 is a sectional view of the entire fixing device; FIG. 2 is a sectional view of an induction heating unit of the fixing device shown in FIG. 1; FIG. 3 is a perspective view of the induction heating unit shown in FIG. 2; FIG. 4 is a sectional view showing the generating state of the magnetic line of force in the induction heating unit shown in FIG. 3 and FIG. 5 is a perspective view for explaining the closed loop of the magnetic line of force generated on a heating roller in the induction heating unit shown in FIG. 3;

FIG. 12B is in the ready state;

FIG. 53A and FIG. 53B are perspective views showing a fourth example of a core element in the fixing device shown in FIG. 52A;

FIG. 54A and FIG. 54B are perspective views showing core elements in he fixing device shown in FIG. 52A;

DETAILED DESCRIPTION OF THE PREFERRED EMBODIMENTS

Hereinafter, a fixing device of the present invention is described with reference to the attached drawings.

FIG. 1 through FIG. 5 show a fixing device in a first embodiment of the present invention.

Figure 1:
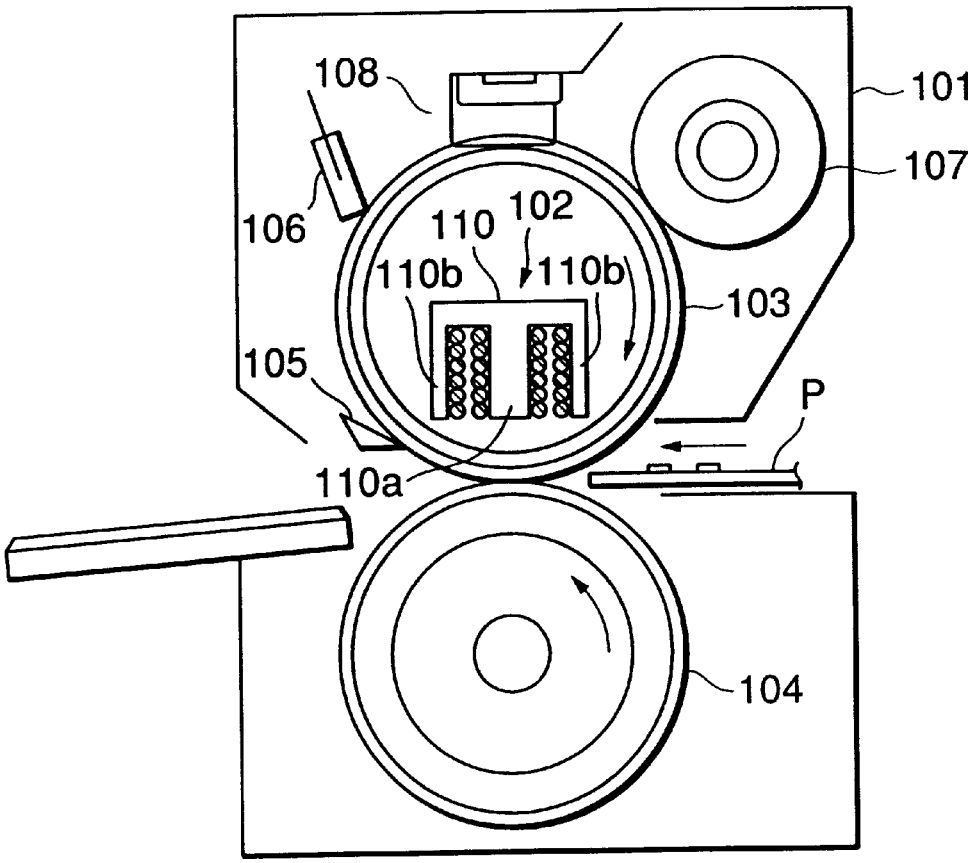
FIG. 1 through FIG. 5 show a fixing device in a first embodiment of the present invention.

As shown in FIG. 1, a heating roller (30 mm in diameter) 103, which is a first contacting member containing an induction heating unit 102 in its inside, is arranged in the main body 101. This heating roller 103 is connected to a driving mechanism (not shown) and is rotated and driven in the arrow direction.

A pressure roller (30 mm in diameter) that is pushed against the heating roller 103 by a pressure mechanism (not shown) is in contact with the heating roller 103 so as to have a fixed nip width under the pressed state. Accordingly, the pressure roller 104 rotates in the arrow direction shown in the figure following the heating roller 103.

The heating roller 103 is made of iron in a thickness of 0.6 mm. The surface of this roller 103 is covered by a mold lubricant layer such as Teflon, etc. The pressure roller 104 is composed by covering around the core metal with a silicon rubber, fluoro rubber, etc.

When a fixing medium P that is a paper passes through a fixing point that is the nip portion between the heating roller 103 and the pressure roller 104, a developer on the fixing medium P is fixed through the fusion and press fit.

On the outer surface of the heating roller 103, a separation claw 105 is provided at the downstream side in the rotating direction from the nip portion between the heating roller 103 and the pressure roller 104 to separate a fixing medium P from the heating roller 103. In addition, on the outer surface of the heating roller 103, there are provided a cleaner 106 to remove offset toner, dust like waste paper, etc. on the heating roller 103, a mold lubricant coating unit 107 to coat an offset preventive mold lubricant, and a thermistor 108 to detect a temperature of the heating roller 103.

Figure 2:
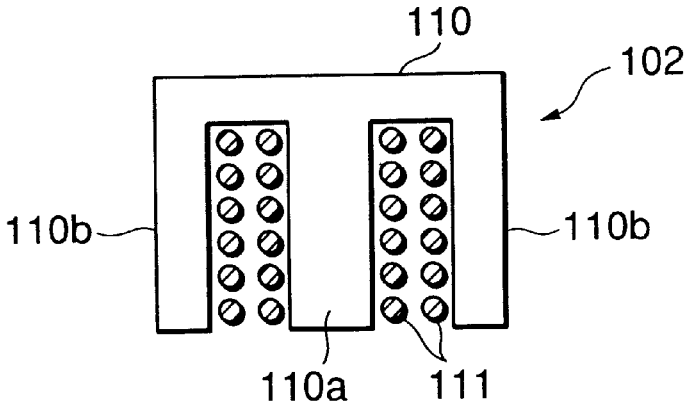

As shown in FIG. 2, the induction heating unit 102 is made of a ferrite that is a high permeable material and is equipped with a core 110 formed in E-shaped section with the open end facing downward and a coil 111. The coil 111 is made as a litz wire using a copper wire in 0.5 mm diameter and wound round the core 110 by plural turns along its longitudinal direction.

The longitudinal direction of the core 110 is opposite to nearly the overall length in the axial direction of the heating roller 103. As the open end of this core faces downward, the core has three opposing points; a center projection 110*a* and both projections 110*b* as shown in FIG. 1.

High-frequency current is supplied to the coil 111 from a high-frequency circuit (not shown) and magnetic flux is generated on the core 110. From the shape of the core 110, magnetic flux is concentrated near a fixing nip that is a contacting portion between the heating roller 103 and the pressure roller 104 and magnetic flux and eddy current are generated on the heating roller 103.

By this eddy current and resistance of the heating roller 103 itself, so-called Joule heat is generated on the heating roller 103. In other words, only the nip portion, that is the contacting portion between the heating roller 103 and the pressure roller 104, is locally heated.

High-frequency current of 20 kHz and 900 W output is supplied to the coil 111 from the high-frequency circuit and the surface temperature of the heating roller 103 becomes 180° C. This surface temperature is detected by the thermistor 108 and the temperature of the heating roller 103 is controlled through the feed back control.

Figure 3:
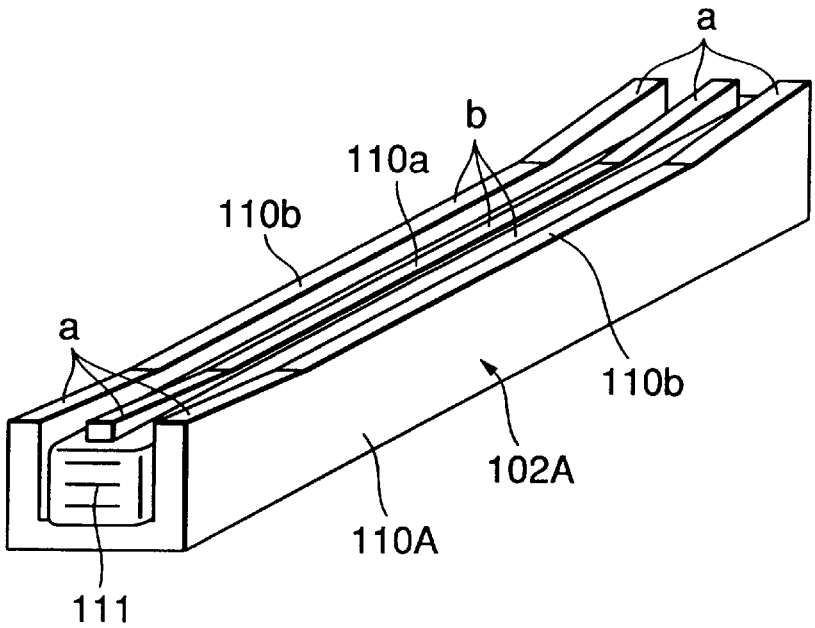

In FIG. 3, an induction heating unit 102A is shown by turning the upside down from the operating state for convenience of the explanation. The coil 111 is wound round the core 110 along a center projection 110*a*.

Further, a taper portion a is formed at both ends in the longitudinal direction of the center projection 110*a* and both projections 110*b* which comprise the core 110A. The edge sides of these taper portions a are higher than a mutual portion b of the taper portions a and a.

Accordingly, a distance between the inner surface of the heating roller 103 and the opposite surfaces of the center projection 110*a* and both projections 110*b* of the core 110A is larger at a center portion b that is the mutual portion of the taper portions than at the taper portion a side.

Figure 4:
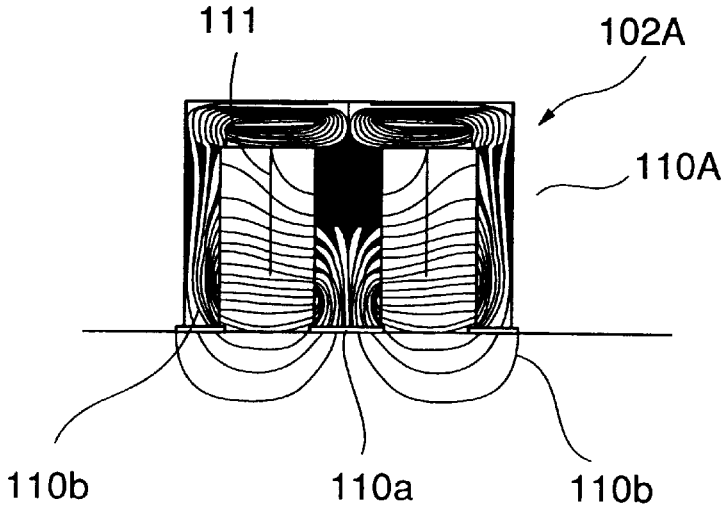

FIG. 4 shows a diagram of magnetic flux generated when the core 110A constructed as described above is provided. That is, the magnetic flux crosses the coil 111 between the center projection 110*a* on the core open surface and both projections 110*b* and 110*b*.

Figure 5:
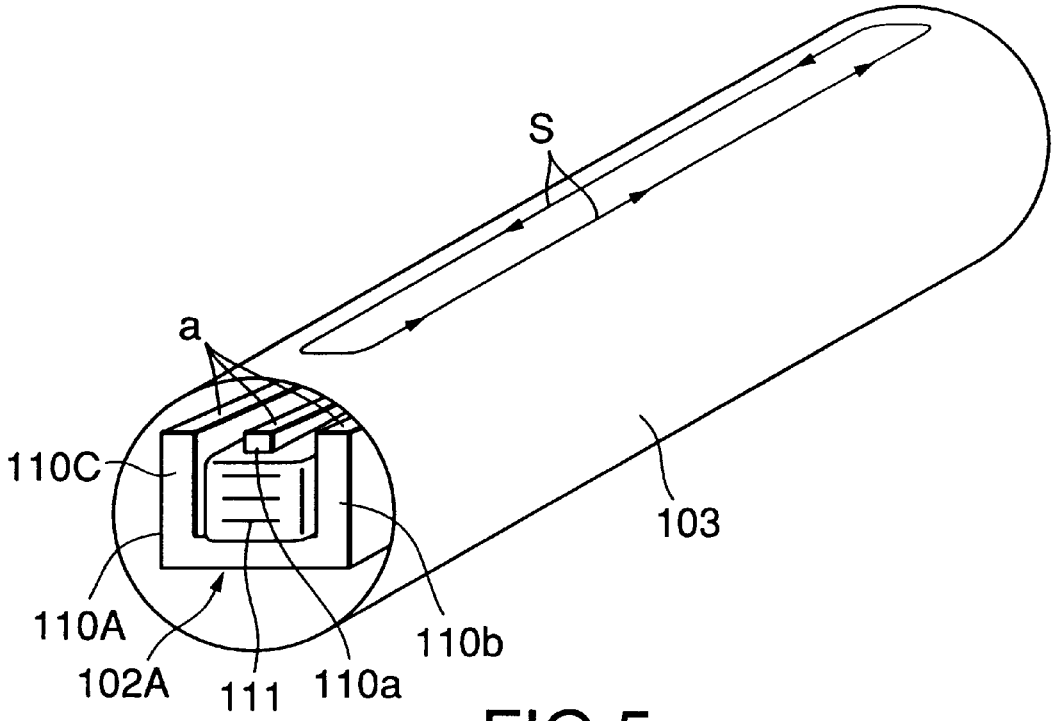

As shown in FIG. 5, eddy current S flows to the heating roller 103 according to the magnetic flux generating shape. This eddy current S flows in the shape of a closed loop and while the eddy current is flowing in a straight line shape along the axial direction of the heating roller, it flows by circling at both ends.

As the result, a heat value generated on the heating roller 103 varies between the center and both ends of the heating roller 103 and it is less at both ends than the center. Furthermore, as a heat value escaping to the outside is much more than that at the center, the temperature at both ends becomes lower than the center.

So, in this first embodiment, the taper portion a is formed at both ends of the core 110A and a distance between the heating roller 103 and the opposite surface of the core 110A is made closer at the ends. Therefore, the magnetic flux crossing the heating roller 103 is much at both ends more than at the center and a generating heat value can be increased.

Thus, it becomes possible to supply heat value to cover a shortage of heat resulting from partial difference in flow of the eddy current in the heating roller 103 and the heat escaped to the outside and maintain the surface temperature of the heating roller 103 at a constant level.

Figure 6:
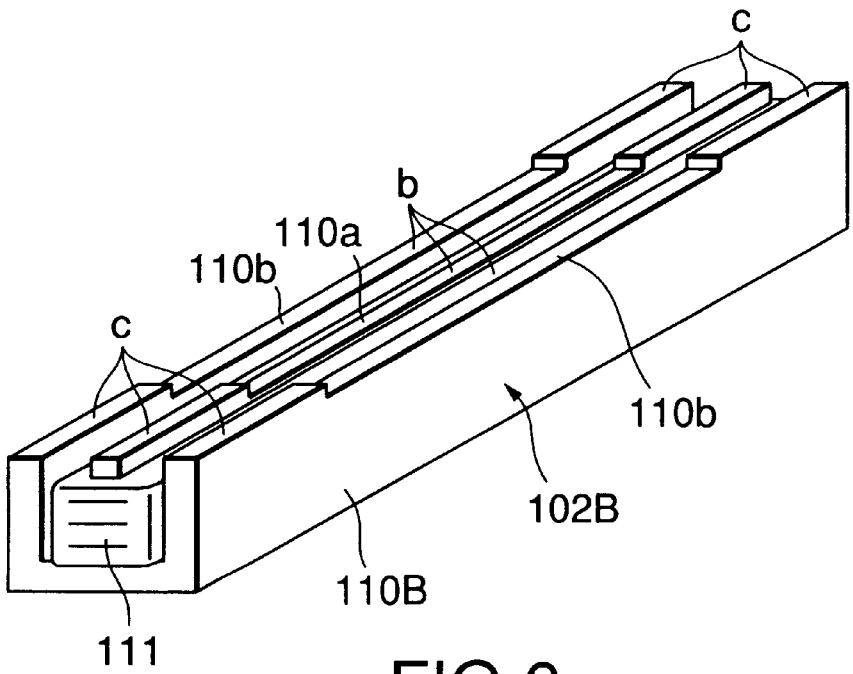
FIG. 6 is a perspective view showing an induction heating unit of the fixing device in a second embodiment of the present invention.

FIG. 6 shows an induction heating unit of a fixing device in a second embodiment of the present invention. As the overall construction of the fixing device in this embodiment is the same as that previously shown in FIG. 1, FIG. 1 is used and a new explanation is omitted here.

As shown in FIG. 6, a core 110B comprising an induction heating unit 102B has the center projection 110*a* and both projections 110*b* in the sectional shape as explained so far. Here, at the ends of the center projection 110*a* and both projection 110*b*, step portions c and c projecting to both ends in the longitudinal direction are formed.

Accordingly, a distance between the heating roller 103 and the opposite surface of the center projection 110*a* and both projections 110*b* is larger at a center portion b, that is a between step portion than at a step portion c.

The presence of these projected step portions c makes it possible to supply heat value to cover the shortage of heat resulting from partial difference in flow of eddy current and heat escaped to the outside and maintain the surface temperature of the heating roller 103 at a constant level.

Figure 7:
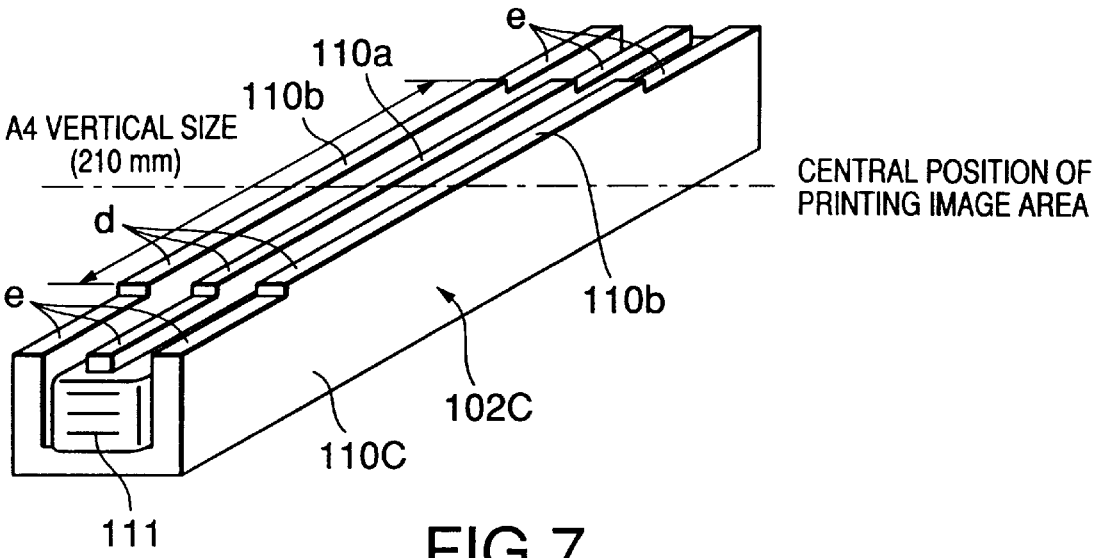
FIG. 7 is a perspective view showing an induction heating unit of the fixing device in a third embodiment of the present invention.

FIG. 7 shows an induction heating unit of a fixing device in a third embodiment of the present invention. The entire structure of the fixing device is the same as previously shown in FIG. 1 and therefore, FIG. 1 is applied and a new explanation is omitted here.

The core 110C comprising the induction heating unit 102C is in the sectional shape having the center projection 110*a* and both projections 110*b* as explained before. Here, at the ends of the center projection 110*a* and both projections 110*b*, a step portion d is formed between the step portions in the longitudinal direction, projecting from both ends e.

The size of the width of the step portion d is formed up to, for instance, A4 vertical size symmetrically with respect to the central position of the printing image area. In this case, a difference in temperatures between the passed portion and the non-passed portion when A4 vertical size fixing media are passed continuously through this fixing device can be reduced.

Furthermore, as the step portion d is projected, the heating is concentrated on the heating roller that is opposite to this step portion. When A4 vertical size fixing media are consecutively passed through the fixing device, they are led to a region where the heating is concentrated by the step portion d and they are effectively heated and fixed.

Further, even when no fixing medium is passed through , the heating is concentrated on the portion of the heating roller 103 opposite to the step portion d and the temperature is raised. If this temperature exceeds a specified temperature (the so-called Curie point), the magnetic flux flowing to the core 110C is reduced and the eddy current generated on the coil 111 is reduced as the phenomena peculiar to a magnetic material.

Accordingly, a temperature of the portion of the heating roller 103 opposite to the step portion d drops automatically and a difference from the temperatures of both ends e becomes small and thus, the temperature is unified in the longitudinal direction of the core 110C.

This phenomenon is presented not only when no fixing medium is passed but also when a fixing medium smaller than A4 vertical size is passed and also, when a fixing medium larger than this size is passed.

Figure 8:
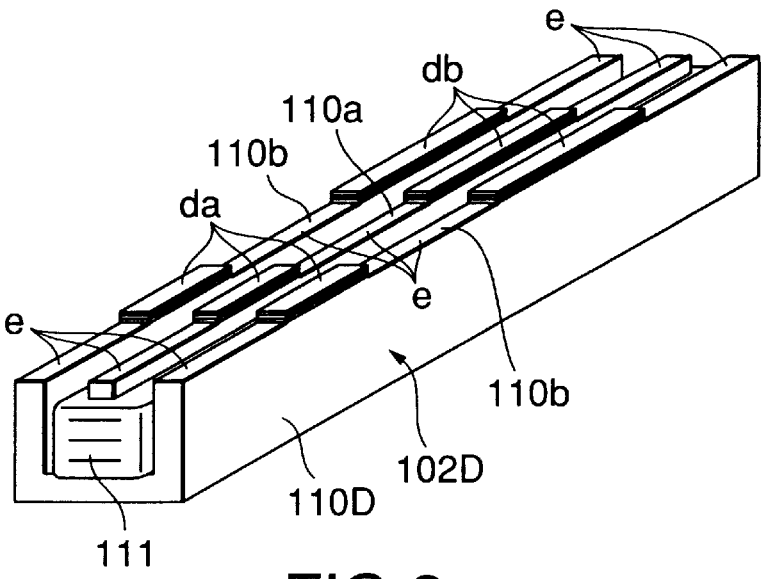
FIG. 8 is a perspective view showing an induction heating unit of the fixing device in a fourth embodiment of the present invention.

FIG. 8 shows an induction heating unit of a fixing device in a fourth embodiment of the present invention. The entire structure of the fixing device is the same as that previously show in FIG. 1 and therefore, FIG. 1 is used here and a new explanation is omitted.

A core 110D comprising the induction heating unit 102D is in the sectional shape having the center projection 110*a* and both projections 110*b* as explained before. Here, the ends of the center projection 110*a* and both projections 110*b* have plural step portions da, db formed at the specified portions in the longitudinal direction, projecting from both ends and a between step portions e and e.

The step portions da, db are formed in the width of the same size as a fixing medium in a specified size and therefore, a difference in temperature between the paper passing portion and the non-paper passing portion is reduced and a certain fixing is assured.

Figure 9:
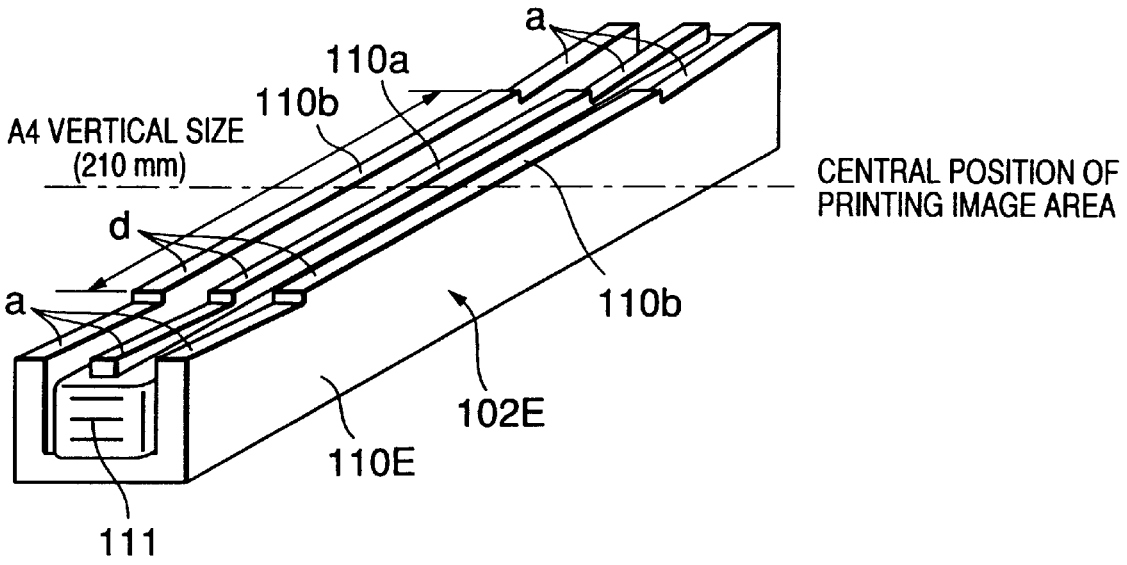
FIG. 9 is a perspective view showing an induction heating unit of the fixing device in a fifth embodiment of the present invention.

FIG. 9 shows an induction heating unit of a fixing device in a fifth embodiment of the present invention. As the entire structure of this fixing device is the same as that previously shown in FIG. 1, FIG. 1 is used and a new explanation is omitted here.

A core 110E comprising an induction heating unit 102E is in the sectional shape having the center projection 110*a* and both projections 110*b* as explained before. The ends of the center projection 110*a* and both projections 110*b* have a taper portion a formed at both ends in the longitudinal direction and the step portion d is formed between these taper portions a, projecting therefrom.

The size of the width of this step portion d is the same as, for instance, A4 vertical size symmetrically with respect to the central position of the printing image area. Accordingly, a difference in temperature between the paper passing portion and non-paper passing portion can be reduced when A4 vertical size fixing media are consecutively passed.

Further, as the taper portion a is provided at both ends, it is possible to get two effects; that is, the uniform temperature is obtained at the initial stage of the heating roller 3 and uneven temperature of the heating roller when especially small size fixing media are passed is relieved.

As shown in FIG. 8, the coil 111 is partially wound round the step portions da, db in the specified number of turns. Therefore, the eddy current generated on the heating roller 103 by the magnetic flux generated from the coil 111 flows much to the portions of the heating roller 103 opposite to the step portions da, db. As the result, it becomes possible to increase eddy current at any optional position.

In other words, if partially uneven temperature is generated on the heating roller 103 for the shape of the heating roller or the core 110 and there is the possibility for reappearance of this uneven temperature, it is possible to unify the surface temperature of the heating roller 103 by providing the step portions da, db at those potions and winding the coil 111 in the specified turns.

In this case, after actually measuring the temperature distribution on the heating roller 103, provide the step portions da and db at applicable portions and unify temperature of these portions. The step portions da and db can be easily formed by adhering them. As a matter of course, the number of turns of a supplementary coil 111*a* that is wound round the step portions da and db should be optimum for unifying the temperature distribution.

Further, even when the coil 111 is partially wound round the step portions previously shown in FIG. 6, FIG. 7 and FIG. 9, there will be no trouble.

Further, in the above embodiments, the fixing device is explained to cope with A4 vertical size fixing media but not restricting to them, it may be in structures to cope with fixing media in letter size, B4 size and other sizes.

Figure 10:
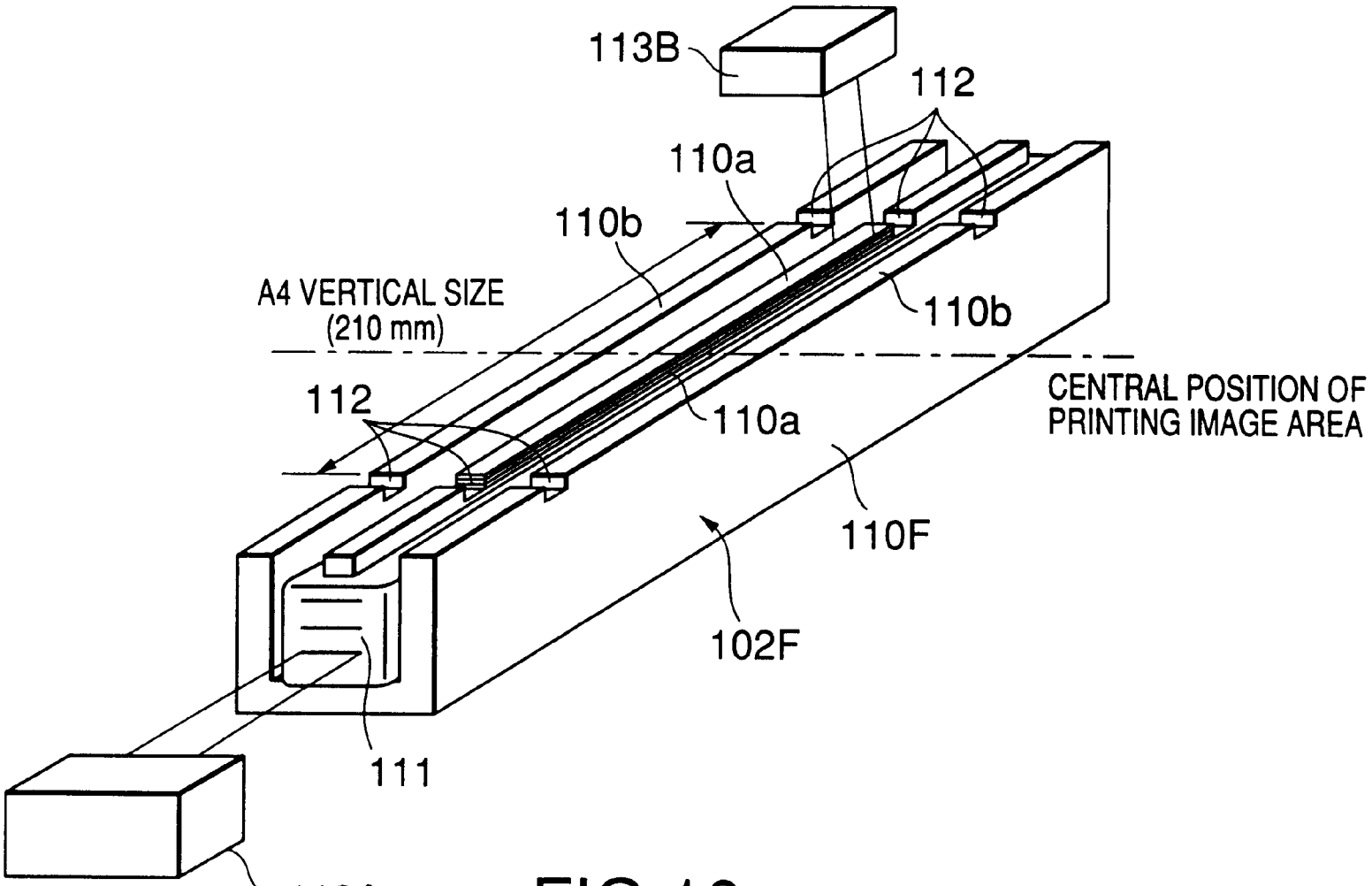
FIG. 10 is a perspective view showing an induction heating unit of the fixing device in a sixth embodiment of the present invention.

FIG. 10 shows an induction heating unit of a fixing device in a sixth embodiment of the present invention. As the entire structure of the fixing device is the same as that previously shown in FIG. 1, FIG. 1 is used and a new explanation is omitted here.

A core 110F comprising an induction heating unit 102F is in the sectional shape having the center projection 110*a* and both projections 110*b* as explained before. At the ends of the center projection 110*a* and both projections 110*b*, a pair of grooves 112 are formed with a specified space between them.

The coil 111 that is previously explained is wound round the center projection 110*a* along its longitudinal direction and on the other hand, the supplementary coil 111*a* is wound round the end of the center projection 110*a* positioned between the grooves 112 by the specified number of turns.

The size between the grooves 112 at the end of the center projection 110*a* with the supplementary coil 111*a* wound round is formed at a position (the area width: 210 mm) where, for instance, A4 vertical size fixing media passes, symmetrically with respect to the center of printing image area.

The coil 111 is electrically connected to a main high frequency circuit 113A, the supplementary coil 111*a* is connected to a supplementary high frequency circuit 113B and these coils 111 and 111*a* are driven independently.

For instance, the main frequency circuit 113A supplies 800W power at 20 kHz to the coil 111 and the supplementary high frequency circuit 113B supplies 1000 W power at 20 kHz to the supplementary coil 111*a*.

The high frequency circuits 113A and 113B are selectively controlled according to a size of a fixing medium on which an image to be fixed is formed upon receipt of a control signal from a control means (not shown) and generates eddy current on the induction heating unit 102F.

Figure 11:
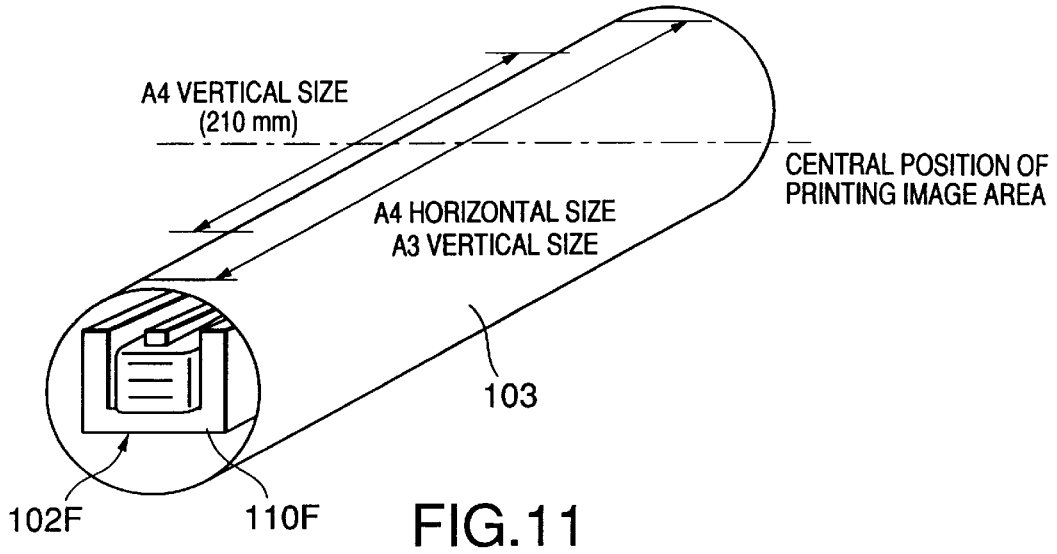
FIG. 11 is a perspective view showing the structure of the induction hearing unit shown in FIG. 10 incorporated in a heating roller.

When a size of a fixing medium is, for instance, A4 lateral or A3 vertical as shown in FIG. 11, the fixing is made by contacting the entirety of the heating roller 103 in the axial direction to a fixing medium and it is therefore necessary to heat the entirety of the heating roller 103.

In this case, high frequency current is supplied to the coil 111 from the main high frequency circuit 113A under the control of said control means. Accordingly, the entire heating roller 103 is heated and the fixing operation of a fixing medium is carried out without any defect.

On the other hand, when a size of a fixing medium is A4 vertical, as heat is deprived from the paper passing area only of the heating roller 103, the paper passing area of the heating roller 103 is heated by applying high frequency current to the coil 111 from the main high frequency circuit 113A and also by applying high frequency current to the supplementary coil 111*a* from the supplementary high frequency circuit 113B.

By such the control as described above, it is possible to maintain the uniformity of the surface temperature of the heating roller 103 as well as the satisfactory fixation and it becomes possible to make the thickness of the heating roller 103 thin.

A seventh embodiment of the present invention is described with reference to FIG. 12A and FIG. 12B.

As previously explained with reference to FIG. 1, the induction heating unit 102 is equipped with the core 110 and the coil 111 and locally heats the nip portion of the heating roller 103 and therefore, when the heating roller is warmed up and becomes ready for the fixing, it is necessary to maintain the surface temperature of the heating roller 103 uniform by rotating it.

However, even when the heating roller 103 is heated in the state with the pressure roller 104 kept in contact with the heating roller 103, heat escapes to the pressure roller 104 side. So, when the heating roller 103 is warmed up and becomes ready, to prevent heat from escaping from the heating roller 103 to the pressure roller 104 side and quickly raise the set temperature of the surface temperature of the heating roller 103, a separation mechanism 115 is provided to separate the heating roller 103 and the pressure roller 104 each other as shown in FIG. 12A and FIG. 12B.

Figure 12A:
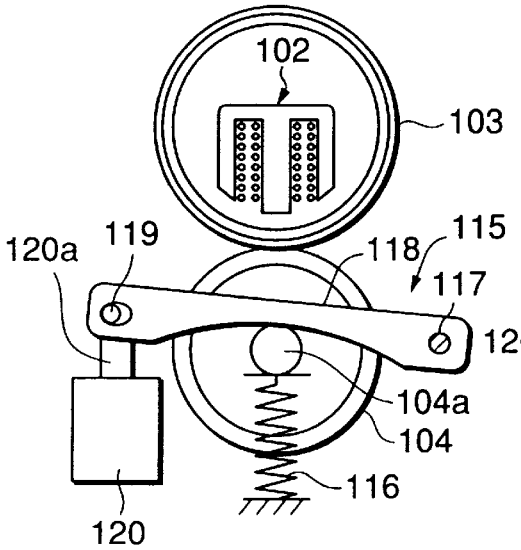
FIG. 12A and FIG. 12B are schematic diagrams for explaining the actions of a separation mechanism in the fixing device in the seventh embodiment of the present invention.

FIG. 12A shows the state where the separation mechanism was released and the pressure roller 104 was not separated from (kept in contact with) the heating roller 103. FIG. 12B shows the state where the pressure roller 104 was separated from the heating roller 103.

Under the state shown in FIG. 12A where the separation mechanism 115 is not acted, the pressure roller 104 is kept in contact with the heating roller 103 by a pressing mechanism 116 and is held to have a certain nip width.

The separation mechanism 115 comprises a linkage which is partially linked to the main body rotatably via a shaft 117, a pin 119 that is inserted into a slot provided at the free end side of the linkage 118 and a solenoid 120 equipped with an actuator 120*a* into which the pin 119 is projected.

The middle portion of the linkage 118 is kept in contact with the top of a spindle 104*a* of the pressure roller 104, and the pressing mechanism 116 is kept in contact with the bottom of the spindle 104*a* and pushes the pressure roller 104 upward jointly with the spindle 104*a*. Thus, the linkage 118 sets the position of the spindle 104*a* against the elastic force of the pressing mechanism 116.

Accordingly, in FIG. 12A, the linkage 118 is not excited by the solenoid 120, its retaining force is released and is in the free state. The pressure roller 104 receives the pressing force directly from the pressing mechanism 116 and contacts the pressure roller 104.

Figure 12B:
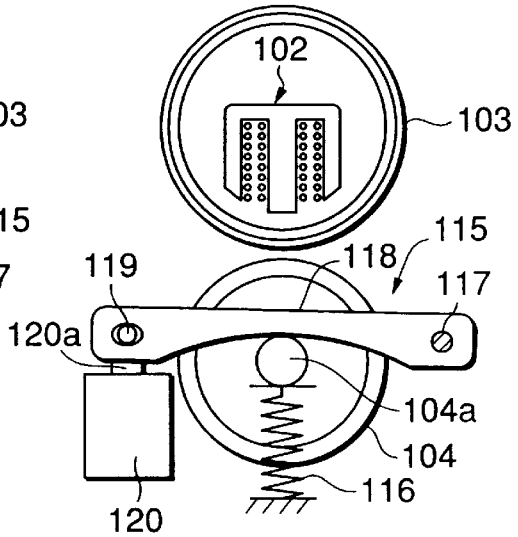

In FIG. 12B, the solenoid 120 is excited by applying the power, the actuator 120*a* is extracted and the free end of the linkage 118 is forced to rotate and displace to the lower side. The force of the solenoid overcomes the elastic force of the pressing mechanism 116 and the pressure roller 104 is separated from the heating roller 103.

Hereafter, it is possible to heat the surface of the heating roller 103 uniformly by rotating and heating the heating roller 103. At this time, as the heat does not escape to the pressure roller 104 side, the warm-up time can be reduced.

Figure 13:
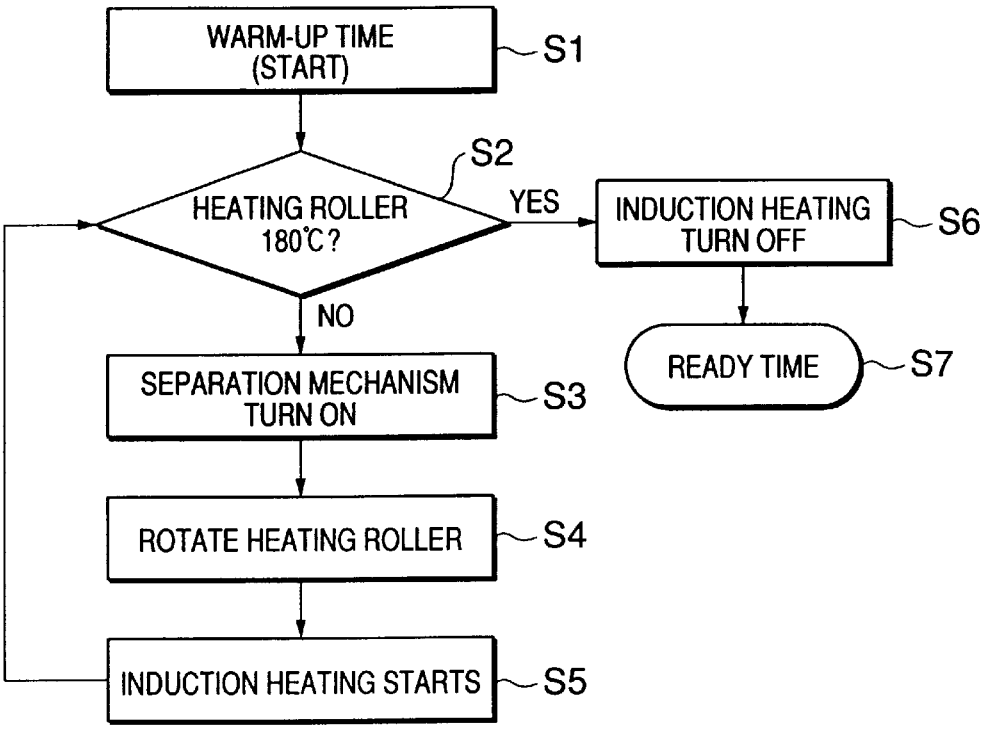
FIG. 13 is a flowchart showing the operations when warming up a fixing device having the separation mechanism shown in FIG. 12A and FIG. 12B.

Next, referring to a flowchart shown in FIG. 13, the operation of a fixing device equipped with a separation mechanism started from the warm-up time is described.

After started from the warm-up time in Step S1, the thermistor 108 previously described in FIG. 1 detects the surface temperature of the heating roller 103 and a detected temperature signal is sent to a control circuit (not shown) in Step S2.

If the surface temperature of the heating roller 103 is below 180° C., the solenoid 120 of the separation mechanism 115 is excited in Step S3 as previously described in FIG. 12B. As the result of this excitation, the linkage 118 is rotated and the pressure roller 104 is separated from the heating roller 103.

Then, the heating roller 103 is rotated and driven at a specified speed in Step S4 and the induction heating action is started and the heating roller 103 is heated in Step S5. Hereinafter, returning to Step S2, the above steps are repeated and as the result, the surface of the heating roller 103 is uniformly heated.

Further, when the control circuit confirms that the heating roller 103 is heated to above 180° C. in Step S2, the fixing device proceeds to Step S6 and stops the induction heating action and further, proceeds to Step S7 and becomes the ready state.

Figure 14:
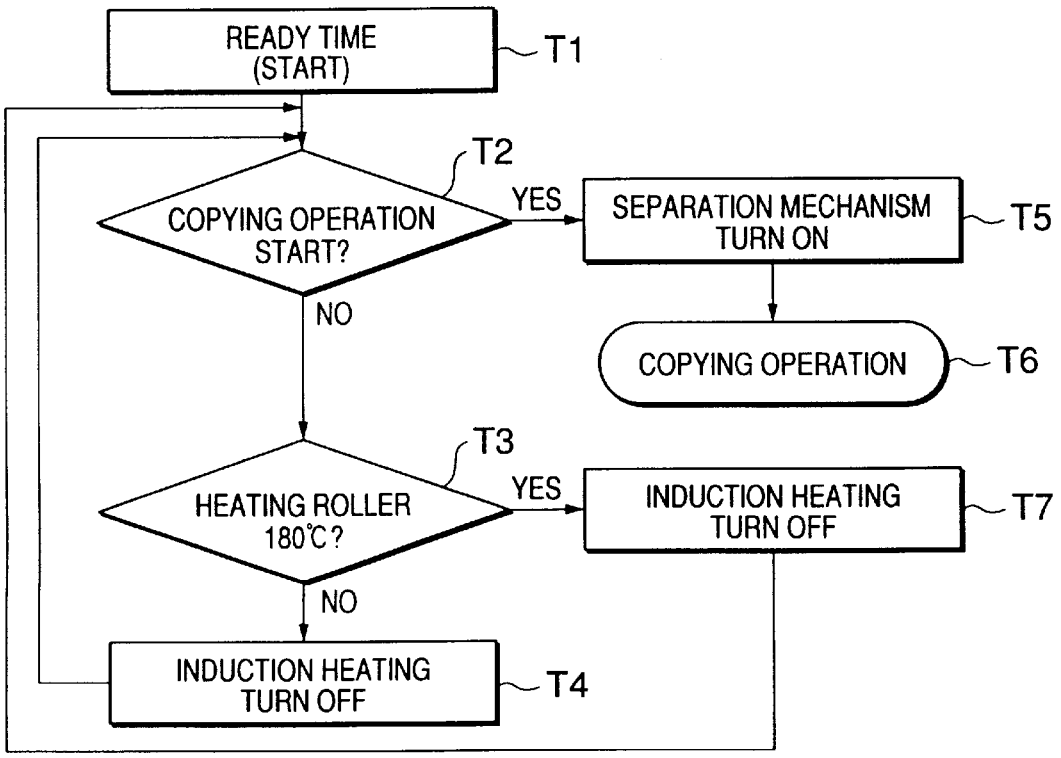
FIG. 14 is a flowchart showing the operations when the fixing device having the separation mechanism shown in FIG. 12A

Next, referring to a flowchart shown in FIG. 14, the operation of the fixing device equipped with the separation mechanism at the time of ready is described.

After started from the ready state in Step T1, the operation proceeds to Step T2 and judges as to whether the copy operation is ON. If the copy operation is OFF, it is detected as to whether the heating roller is kept at above 180° C. in Step T3.

If the temperature of the heating roller 103 drops to below 180° C., the induction heating unit 102 is turned ON in Step T4 and the heating roller 103 is heated. Then, returning to Step T2, the above operations are repeated.

On the other hand, when it is confirmed that the copy operation is ON in Step T2, the operation proceeds to Step T5 and the separation mechanism 115 is turned ON. The force applied to the pressure roller 104 is released and the pressure roller 104 contacts the heating roller 103. So, the copy operation in Step T6 starts.

Further, when it is confirmed that the heating roller 103 is at above 180° C. in Step T3, the induction heating action is turned OFF in Step T7 and returning to Step 2, the above operations are repeated.

Figure 15:
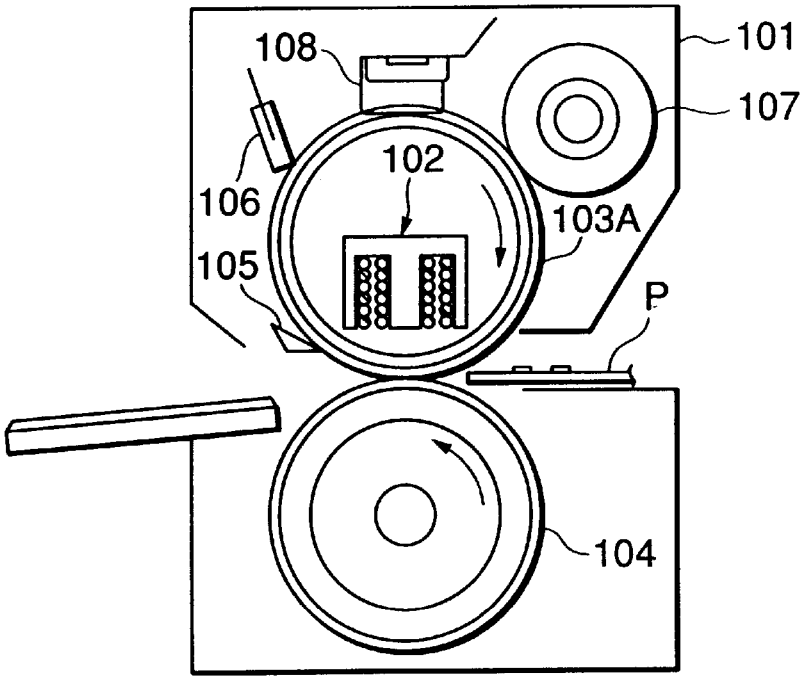
FIG. 15 is a sectional view showing the entirety of a fixing device in an eighth embodiment of the present invention.

Next, an eighth embodiment of the present invention is described referring to FIG. 15.

Further, as the entire structure of the fixing device is the same as that previously shown in FIG. 1, the same component elements are assigned with the same reference numerals and a new explanation is omitted here.

In this embodiment, a heating roller 103A in the thickness, for instance, 2 mm which is thicker than the preceding heating roller is used. This heating roller is able to sufficiently cope with a copying machine of a fast copying speed.

In other words, when the thickness of the heating roller 103 is simply increased, the heat capacity increases as a matter of course. The amount of heat accumulated in the heating roller 103 becomes larger than the heating roller shown in FIG. 1 and it is possible to supply the amount of heat sufficient for the fixing even when the copying speed is increased.

However, when the copying speed is further increased, the amount of heat supplied only from the heating roller 103 becomes insufficient.

So, this problem can be solved when heat is given to the pressure roller 104 from the heating roller 103 during the warm-up and in the actual fixing operation, heat is also given to a fixing paper P from the pressure roller 104 side so as to make the temperature to a level that is able to make the fixing.

In order to reduce this warm-up time, the thicker heating roller 103A and the separation mechanism 115 previously explained are used jointly. That is, the separation mechanism 115 keeps the pressure roller 104 separated from the heating roller 103A until the temperature of the heating roller 103A rises to a specified level, and the warm-up is made by rotating the heating roller 103A only.

Then, when the heating roller 103A reaches a specified temperature, the separation mechanism 115 is released and the pressure roller 104 is rotated by bringing it in contact with the heating roller 103A. This state is continued until the temperature is raised to a level that is able to make the fixing.

Further, the set value of the surface temperature of the heating roller 103A when the pressure roller 104 is separated from the heating roller 103A is changed according to the specification of a copying machine. When the copying speed becomes fast, it is necessary to make the separation time of the pressure roller 104 accordingly. For instance, this is better to apply to a copying machine having a copying speed of 35 sheets/min.

As a definite control, the pressure roller 104 is kept separated from the heating roller 103A by the separation mechanism 115 until the surface temperature of the heating roller 103A reaches 150° C. At the time when the surface temperature of the heating roller 103A rises to 150° C., the separation mechanism 115 is released and the pressure roller 104 is returned to the state kept in contact with the heating roller 103A.

Finally, when the surface temperature of the heating roller 103A reaches 180° C., the warm-up is completed. By performing such the control, the warm-up time can be reduced by more than 30% when compared with the heating of the heating roller 103A from the first with keeping it in contact with the pressure roller 104.

Figure 16:
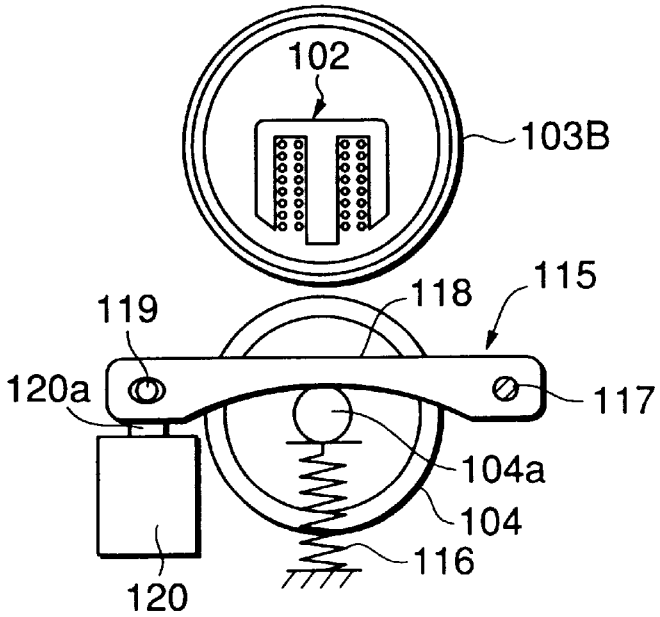
FIG. 16 is a schematic diagram for explaining the actions of the separation mechanism in a fixing device in a ninth embodiment of the present invention.

Next, a ninth embodiment of the present invention is described referring to FIG. 16.

Further, as the entire structure of the fixing device is the same as that previously shown in FIG. 1, the same component elements are assigned with the same reference numerals and a new explanation is omitted.

In this embodiment, a heating roller, which is thinner than the previous heating roller, for instance, a 0.4 mm thick roller is used as the heating roller 103B.

On a fixing device that is using such the heating roller 103, as the control at the time of the warm-up after starting the copying operation (the start button ON), the pressure roller 104 is separated from the heating roller 103B by actuating the separation mechanism 115.

Then, the heating roller 103B is heated by rotating it and supplying high frequency current to the induction heating unit 102. This state continues and immediately before a fixing medium advances into the nip portion between the heating roller 103B and the pressure roller 104, the separation mechanism 115 is released.

As the heating roller 103B is made thin, even when the fixing operation is performed immediately after starting the copying operation (the start button is pushed), it is possible to bring the surface temperature of the heating roller 103B to a level at which the fixing can be made within a time when a fixing medium comes into the fixing device.

Referring to FIG. 16, the ninth embodiment of the present invention is explained.

At the time of warm-up and also at the ready state, the pressure roller 104 is normally separated from the heating roller 103B by actuating the separation mechanism 115, and the heating roller 103B is heated by the induction heating unit 2 while continuously rotating the heating roller 103B.

Then, immediately after detecting that a fixing medium comes into the fixing device, the separation mechanism is released. So, the nip portion can be heated centrally without letting heat to escape to the pressure roller 104 and thus, thermal efficiency can be improved.

Figure 17:
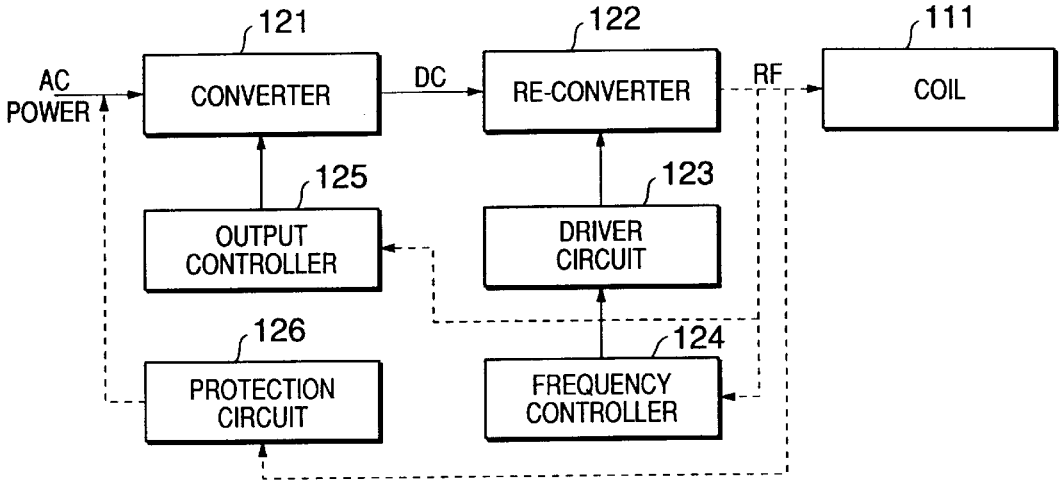
FIG. 17 is an electric block diagram in a fixing device in a tenth embodiment of the present invention.
Figure 18:
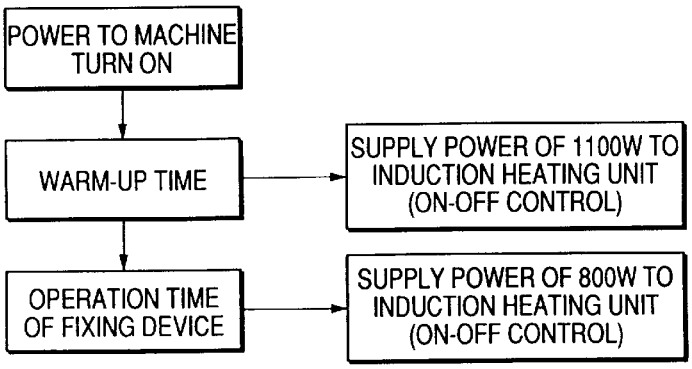
FIG. 18 is a block diagram for explaining the electric control of the fixing device shown in FIG. 17.

Next, referring to FIG. 17 and FIG. 18, a tenth embodiment of the present invention is described FIG. 17 is a block diagram of a control means, which controls the operation of the fixing device, comprising a converter 121, a re-converter 122, a driver circuit 123, a frequency controller 124, an output controller 125 and a protection circuit 126.

The re-converter 122 adopted an inverter system. This system is to obtain AC voltage from DC voltage,-and received 50/60 Hz commercial AC voltage is converted into DC voltage in the converter 121 and re-converted into to high frequency current by the re-converter 122.

High frequency that s re-converted is decided by the frequency controller 124 and pulses are supplied to the gate of switching element provided to the re-converter 122 by the driving circuit 123. The protection circuit 126 is for preventing overheating of the heating roller.

High frequency current is applied to the coil 111 comprising the induction heating unit 102, wherein the high frequency magnetic field is produced. When the heating rollers which is an inductive material is partially put in this high frequency magnetic field, the eddy current is generated and the heating roller 103 is heated.

FIG. 18 is a block diagram relative to a heating control system of such the fixing device at the time of the warm-up and the fixing operation.

That is, when the power source of a copying machine is turned ON, the warm-up is started. At the time of this warm-up, 1,100 W power is applied to the control means in order to reduce the warm-up time.

High frequency current is applied to the coil 111 of the induction heating unit 102 from the high frequency circuit to heat the heating roller 103 locally. At this time, the power is so controlled as to generate 1,100 W as the calorific volume.

As the total power consumption by units other than the fixing device at the time of warm-up is less than that required for the copying operation, even when 1,100 W out of rated power 1,500 W is used by the fixing device, the power consumption of the entire copying machine is within the rated power.

Thus, the heating roller 103 is heated by giving the maximum amount of power that can be applied to the coil 111 and therefore, the warm-up time can be reduced sharply. The power supply of 1,100 W is continuously held until the surface temperature of the heating roller 103 reaches a temperature at which an image can be fixed.

At the time of this warm-up, the separation mechanism 115 acts and the heating is made in the state with the pressure roller 104 is kept separated from the heating roller 103 as shown previously.

As the amount of power used by units other than the fixing device,(for instance, driving, developing, transferring actions, etc.) increases more than that at the time of the warm-up, the amount of power that is usable by the fixing device is controlled to 800 W.

In other words, by controlling to give the minimum amount of power that is used for the fixing to the fixing device, the ward-up time can be reduced, attributing to the improvement of thermal efficiency. Furthermore, it becomes possible to achieve the downsizing without cost increase.

Figure 19:
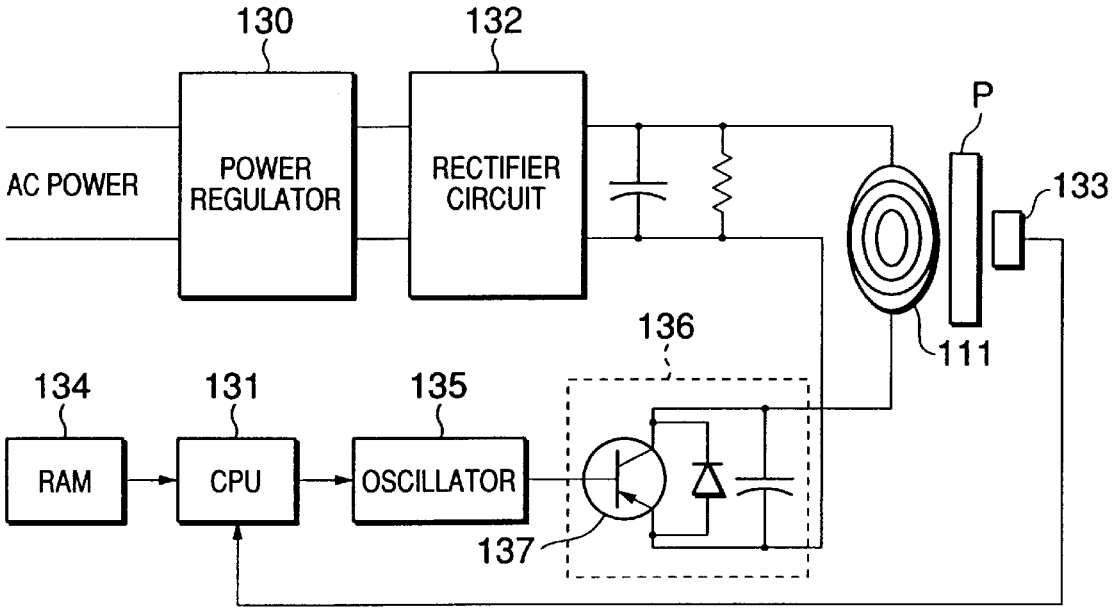
FIG. 19 is a block diagram showing an electric control circuit in a fixing device in an eleventh embodiment of the present invention.

Next, referring to FIG. 19, an eleventh embodiment of the present invention is described.

Although the basic view regarding the control means is common to that described in the tenth embodiment, some different points only are described in the following.

The amount of power to be applied at the time of the warm-up is limited to the maximum 1,100 W and is controlled by changing it linearly. Similarly, the amount of power to be applied at the time of the fixing operation is limited to the maximum 800 W and is controlled by changing it linearly.

For instance, when the thickness of the heating roller 103 is gradually increased, the ripple of its surface temperature tends to become large. However, when the amount of power is controlled as described above, the warm-up time can be reduced and the ripple of the surface temperature also can be reduced.

FIG. 19 shows this control circuit.

When commercial AC power is supplied from a commercial AC power source, output voltage is controlled by changing an ignition control angle of the gate current of the thyristor in a power regulator 130 by a CPU 131.

That is, a control pulse is given to the thyristor gate according to the change in a resistance value (the temperature change) of the thermistor, and the power is applied to the thyristor and DC output is generated through a smoothing circuit.

After such the power regulation, AC power is converted into DC power in a rectifier circuit 132. The maximum amount of power is switched and controlled according to the warm-up and the fixing operation. In the state of the warm-up time reduced according to this control method, it is possible to reduce ripple without causing the overshoot of the heating roller even when the thermal capacity of the heating roller 103 is small.

Figure 20:
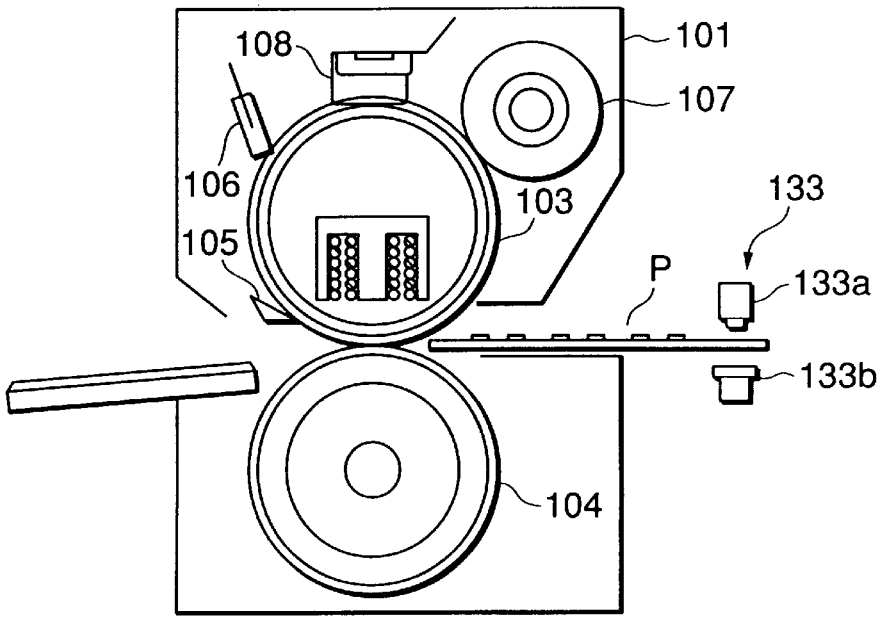
FIG. 20 is a sectional view showing the entirety of a fixing device in a twelfth embodiment of the present invention.

Next, referring to FIG. 19 and FIG. 20, a twelfth embodiment of the present invention is described.

FIG. 20 shows the fixing device and the same component elements as those shown in FIG. 1 are assigned with the same reference numerals and a new explanation is omitted.

This embodiment is characterized in that a photo coupler 133 that is a means to detect the coming fixing medium P is arranged at the position before a fixing medium P is led to the nip portion between the heating roller 103 and the pressure roller 104.

The photo coupler 133, comprising a light emitting element 133*a* and a light receiving element 133*b*, detects the conveyance of a fixing medium P and identifies its kind from on a transmission quantity of the light to the fixing medium.

Generally, ordinary paper, OHP paper, thick paper and other paper are available as fixing media that are led to the fixing device and required heat energy differs depending to material and characteristic of a fixing medium.

By applying a heat energy corresponding to a kind of this fixing medium, it is possible to increase heat efficiency while preventing waste of energy and maintain the satisfactory fixing irrespective of kind of fixing medium.

An actual control will be explained referring to the control circuit shown in FIG. 19.

The photo coupler 133 recognizes a kind of a fixing medium and sends its detecting signal to the CPU 131. The CPU 131 specifies and call heat data of a fixing medium P recognized by the photo coupler 133 from heat data corresponding to a kind of the fixing medium P that is pre-stored in a RAM 134.

The CPU 131 decides the maximum value of power based on the called heat value data and controls the number of pulses to be given to a switching element 137 comprising an inverter circuit 136 via an oscillator 135.

This switching element 137 supplies current to the coil 111 for a time of the given number of pulses. So, eddy current is produced and heat is generated on the heating roller 103 made of a conductive material.

Figure 21:
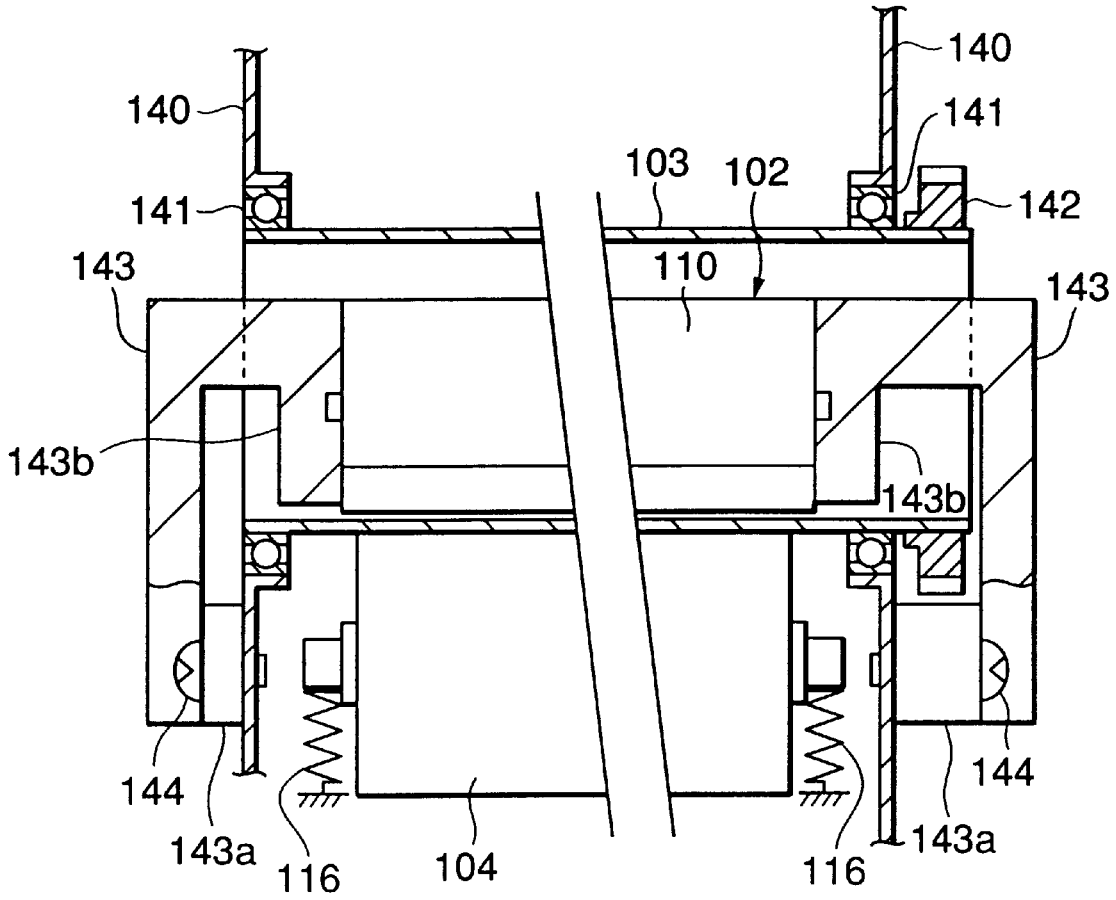
FIG. 21 is a partially schematic sectional view of a fixing device in a thirteenth embodiment of the present invention.

Next, referring to FIG. 21, a thirteenth embodiment of the present invention is described.

The heating roller 103 is supported rotatably by a frame 140 via a shaft bearing 141. The pressure roller 104 elastically supported by the pressing mechanism 116 is kept in contact with the heating roller 103 and is rotated following the rotation of the heating roller 103.

Further, one end of the heating roller 103 is projecting to the outside from the frame 140 and a follower gear 142 is fitted to the outer circumference of this projected end. Here, the follower gear 142 is engaged with a driving gear that is connected to a driving motor (not shown).

Further, the core 110 made of ferrite comprising the induction heating unit 102 is contained in the heating roller 103. This core 110 is wound round with a coil (not shown).

The core 110 is supported by a pair of support members 143 that are core supporting means at its both ends and the end of the core 110 is arranged with a specified space between the inner wall of the heating roller 103 and is not in contact with it.

The support member 143 is provided with a brim portion 143*a* mounted to the outer surface of the frame 140 via a fixing device 144 and a support portion 143*b* that supports the end of the core 110 and clamps it from both sides.

In case of a fixing device of a system to concentrate such the heating portion to the contacting portion between the heating roller 103 and a fixing medium, the magnetic flux generated from the core 110 must be applied effectively to the heating roller 103.

The control of a gap between the core 110 and the heating roller 103 and the setting of a mounting angle of the core 110 become very important problems.

Further, the weight and the cross section of the induction heater unit 102, comprising the core 110 that is made of heavy ferrite with the coil 111 wound round become larger than a conventional halogen lamp heater and therefore, it is required to support the core 110 separately from the heating roller 103.

However, if a highly solid and cheap material, for instance, iron is used for a core supporting means, the distribution of magnetic flux generated from the induction heating unit 102 is disturbed and the supporting means itself is heated and loss of energy may result.

So, the support member 143 as shown in FIG. 21 is provided to support the core 110. A material with lower permeability than ferrite comprising the core 110 is used for the supporting member 143.

When, for instance, aluminum is used for the supporting member 143, rigidity required for supporting the core 110 is maintained, the heat generated from the supporting member itself is suppressed and the distribution of magnetic flux generated from the induction heating unit 102 is not disturbed.

In other words, when aluminum having lower permeability than ferrite comprising the core 110 is used for the supporting member 143 which supports the core 110, the heating can be centered on the nip portion only, enabling the rapid warm-up.

On the fixing device shown in FIG. 21, an aluminum was used for the supporting member 143 but a synthetic resin, for instance, polyimide resin may be used.

Normally, large current of about 10A is flowing through the coil 110 and for safety, it is required to apply an insulation measure. Further, the core 110 and the coil 111 comprising the induction heating unit 102 are heated by radiant heat and heat is transferred to the supporting member 143.

The supporting member 143 is required to be able to withstand this heat and must be made using a material that has a lower permeability than ferrite comprising the core 110, electric insulation and heat resistance.

In this respect, a synthetic resin explained previously, for instance, polyimide resin is best suited for the support member 143 as it does not generate eddy current, surely electrically insulate and prevents heat generation.

Figure 22:
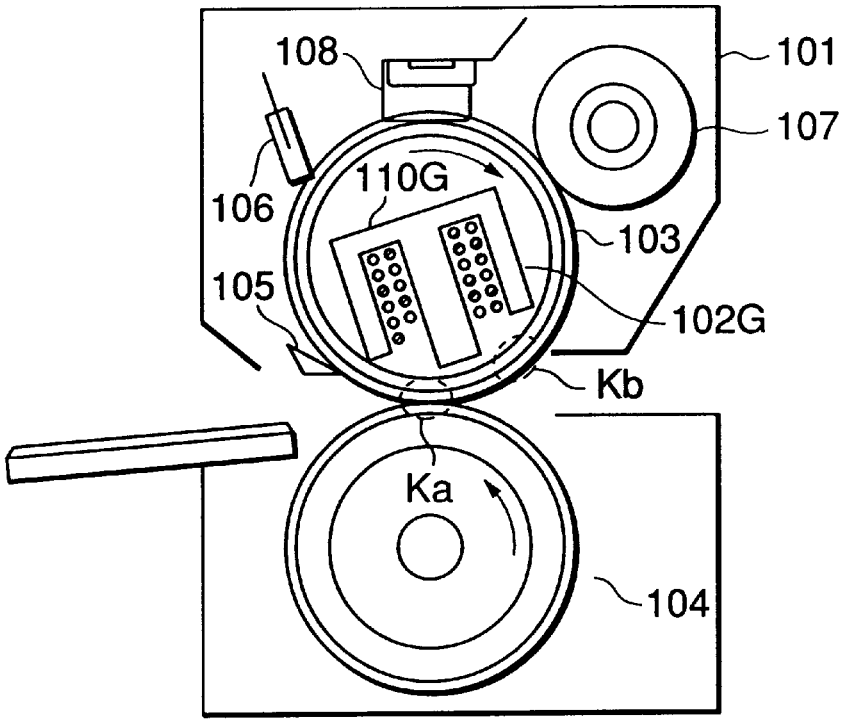
FIG. 22 is a sectional view showing the entirety of a fixing device in a fourteenth embodiment of the present invention.

Next, referring to FIG. 22, a fourteenth embodiment of the present invention is described.

The basic structure of the fixing device is the same as that is described in FIG. 1 and therefore, the same component elements are assigned with the same reference numerals and a new explanation is omitted here.

A core 110G of an induction heating unit 102G forms not only a heat distribution Ka to heat the nip portion but also a heat distribution Kb to heat the upper stream portion in the rotating direction of the heating roller 103.

Accordingly, before a fixing medium is heated at the heat distribution Ka that is the nip portion between the heating roller 103 and the pressure roller 104, it is heated in advance at the heat distribution Kb and apparently, there is the same effect as the increase of a fixing time. In other words, it becomes possible to drop a fixing temperature by 5–10° C. and this is effective for the high temperature offset, etc.

Figure 23:
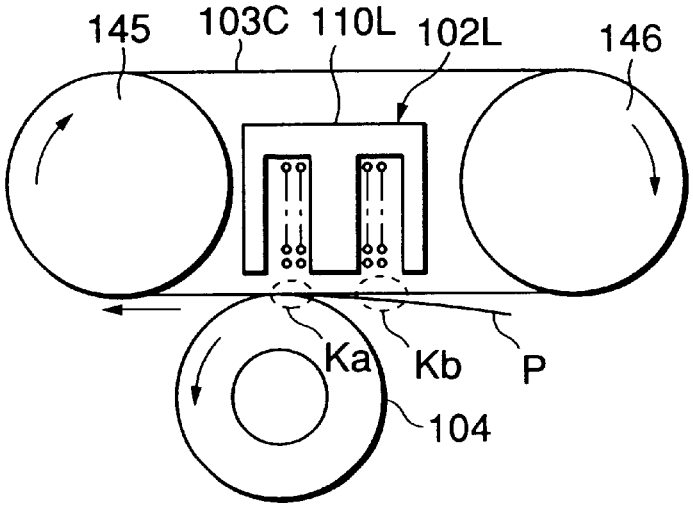
FIG. 23 is a sectional view showing the entirety of a fixing device in a fifteenth embodiment of the present invention.

Next, referring to FIG. 23, a fifteenth embodiment of the present invention is described.

A thin conductive belt 103C is put over a driving roller 145 and a driven roller 146 and an induction heating unit 102L is arranged at a position close to this conductive belt 103C. The pressure roller 104 is arranged so to contact with a part of the conductive belt 103C.

That is, as the above effect is more efficient when heat capacity is small, the heating roller 103 is replaced by the thin conductive belt 103C. As the induction heating unit 102L, a core 110L forms not only the heat distribution Ka on the contacting portion (the nip portion) with the pressure roller 104 but also the heat distribution Kb at the coming upper stream side of a fixing medium P and therefore, it is possible to obtain more effective heating characteristic likewise the above fourteenth embodiment.

Figure 24:
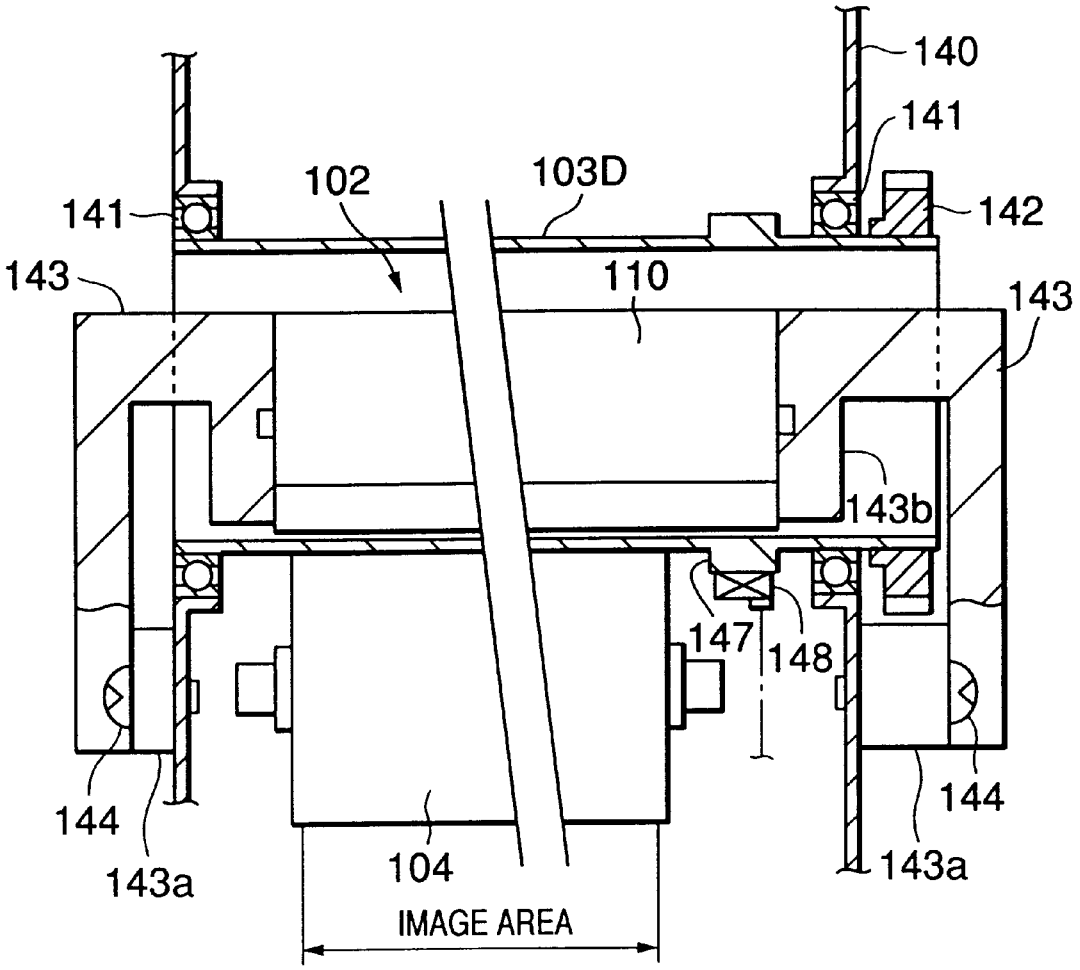
FIG. 24 is a partially schematic sectional view of a fixing device in a sixteenth embodiment of the present invention.

Next, referring to FIG. 24, a sixteenth embodiment of the present invention is described.

The basic structure as a fixing device is the same as that described in FIG. 21 (the pressing mechanism is omitted) and the same component elements are assigned with the same reference numerals and a new explanation is omitted.

A heating roller 103D is provided with a magnetic shelter 147 that is formed partially thick in the thickness and a temperature detector 148 is arranged in contact with this magnetic shelter 147 as a means to detect a temperature of the heating roller 103D.

That is, in case of a system to concentrate the heating portion to the contacting portion between the heating roller 103D and a fixing medium like this fixing device, the heating roller is heated by concentrating generated magnetic flux and therefore, the temperature detector 148 may not operate properly due to the influence of the magnetic field.

To avoid this influence, the thickness of the hating roller 103D is partially increased to shelter magnetic flux by restraining it in the inside of the heating roller 103D. The thickness changed portion may be projected to the inside or the outside. However, it is desirably in the outside of an image area and it is also necessary to extend the induction heating unit 102 to the outside of the image area accordingly.

The heating roller 103D is provided with the magnetic shelter 147 in the thickness increased by two times and projected to the outside at only the section opposite to the temperature detector 148. The temperature detector 148 detects the temperature of the nip portion outside the image area of the pressure roller 104 forming the nip portion.

As the thickness of the heating roller 103D is partially made thicker, a difference is partially produced in heat capacity and the warm-up, etc. become different from the image area. It is therefore better to provide a calibrated data table for the control purpose.

Figure 25:
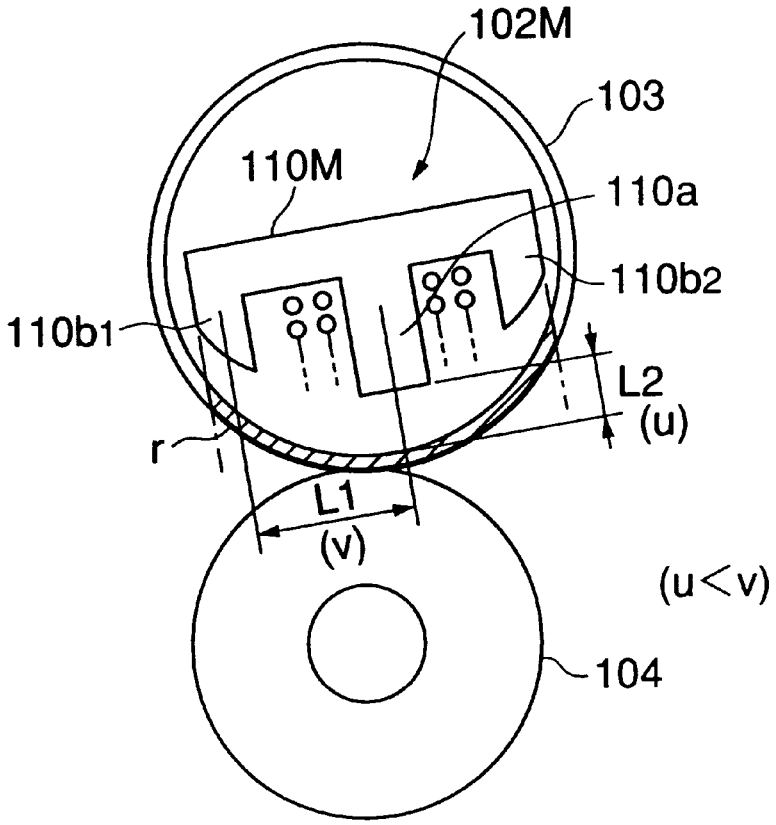
FIG. 25 is a sectional view showing a fixing-device in a seventeenth embodiment of the present invention.

Next, referring to FIG. 25, a seventeenth embodiment of the present invention is described.

The basic structure as a fixing device is the same as that previously described and all component elements other than the principal portions are omitted.

A core 110M comprising an induction heating unit 102M is in the nearly E-shaped section and the center projection faces the inner circumferential wall of the heating roller 103, and the ends of projections 110*b*1 and 110*b*2 provided at both sides of this center projection 110*a* are machined to the curved surface.

By the way, when power is applied to the coil wound round this core 110M, magnetic flux is generated from the center projection 110*a* toward the adjacent projections (the both projections 110*b*1 and 110*b*2 in this embodiment).

Accordingly, the eddy current generating range on the surface of the heating roller 103 is restricted to the range where magnetic flux is generated from this core 110M. As shown by attaching an oblique line to the heating roller 103 in FIG. 25, the portion r of the heating roller 103 opposite to the core 110M (that is, the portion of the heating roller 103 opposing to the range from the projection 110*b* 1 at the one side to the projection 110*b*2 at the other side) is heated.

When performing the induction heating, magnetic flux generated from the end of the center projection 110*a* of the core 110M returns to the both projections 110*b*1 and 110*b*2 by passing through the inside of the heating roller 103 when performing the induction heating, eddy current is generated in the heating roller 103 and heat is generated.

However, if a distance L2 from the end of the center projection 110*a* to the inner surface if the heating roller 103 opposite to this end is larger than a distance L1 from the end of the center projection 110*a* to the ends of the adjacent both projections 110*b*1 and 110*b*2 (L2>L1), the magnetic flux generated from the center projection 110*a* flows into the adjacent both projections 110*b*1 and 110*b*2 before reaching the heating roller 103.

This is because of the insulating action by the air layer and when L2 becomes larger than L1, magnetic flux tends to flow to the adjacent both projections 110*b*1 and 110*b*2 rather than to the back of the heating roller.

Therefore, in order to perform the efficient heating, when assuming a distance from the end of the projection most far from the inner surface of the heating roller 103 (here, the center projection 110*a*) out of the center projection 110 and the both projections 110*b*1 and 110*b*2 of the core 110M as u, and a most short distance out of distances among adjacent projections (here, the center projection 110*a* and the projection 110*b*1 or 110*b*2) as v, u<v becomes an indispensable condition.

Further, in the above seventeenth embodiment, the number of projections provided to the core 110M are made 3; 110*a*, 110*b*1 and 110*b*2 but are not limited to this. On a core provided with a plurality of projections, it is sufficient when a distance u between the end of projections of the core and the inner surface of the heating roller is short against the most short distance v out of the distances of adjacent projections.

Further, regarding a core provided with a plurality of projections, magnetic flux is always generated between adjacent projections and therefore, magnetic flux is generated in the numbers less than the number of total projections by one.

Here, the heat generating range of the heating roller 103 is the range to which the core 110M is opposing and therefore, when assuming that the length of the heat generating range of the heating roller 103 is q and the number of projections is x, a distance of the magnetic flux generated on the heating roller 103 becomes maximum q/x (x−1).

For the reason stated above, if a distance m between the end of the projection of the core and the inner surface of the heating roller is larger than the maximum distance of magnetic flux q/x(x−1) generated on the surface of the heating roller, the magnetic flux generated on the core 110M flow into the projections only and does not reach the surface of the heating roller.

So, when assuming that a distance between the end of projection of the core element and the inner surface of the heating roller is u, the number of projections of the core is x and the length of the heating area of the heating roller is q, it is necessary to set u<q/(x−1).

Figure 26A:
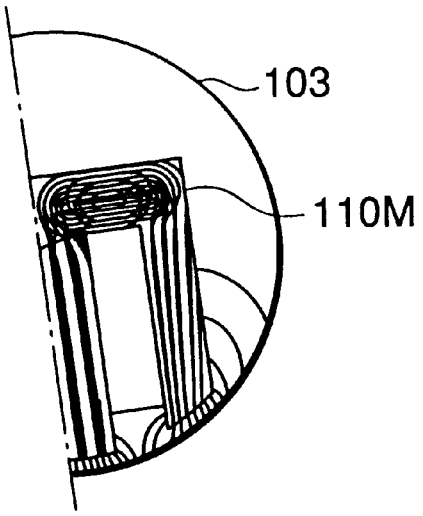
FIG. 26A is a diagram showing the state of generating the magnetic lines of force in a fixing device shown in FIG. 25

The change in the magnetic flux distribution of the core 110M satisfied the above condition is shown in FIG. 26A. As shown in FIG. 26A, it is seen that the magnetic resistance between the core 110M and the heating roller 103 drops and a magnetic line of high density is generated.

Accordingly, it is possible to have the generated magnetic flux to effectively act on the heating roller 103 and in particular, the magnetic flux generated from the end surfaces of both projections of the core 110M are not diffused to other parts and large eddy current is generated on the heating roller 103 and the good heating efficiency is obtained.

Figure 26B:
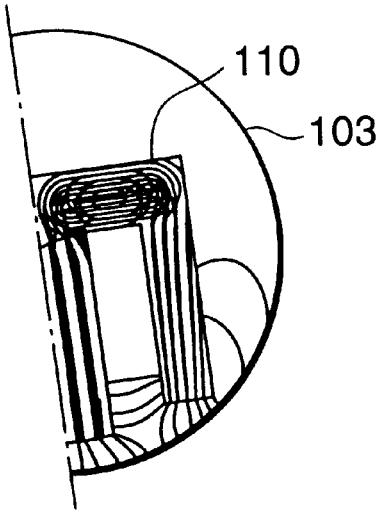
FIG. 26B is a diagram showing the state of generating the magnetic line of force in a conventional fixing device that is comparable with the fixing device of the present invention shown in FIG. 26A.

The change in the magnetic flux distribution of the core 110 in the ordinary shape is shown in FIG. 26B. Since nothing was devised to the end surfaces of the projections 110*a*, 110*b*, magnetic resistance between the core 110 and the heating roller 103 is large and the density of the line of magnetic pole is rough. Accordingly, the generation of eddy current is small in the heating roller 103 and the heating efficiency is low.

Deformed examples of the core 110M previously explained are shown in FIG. 27A through FIG. 27F, respectively.

Figure 27A:
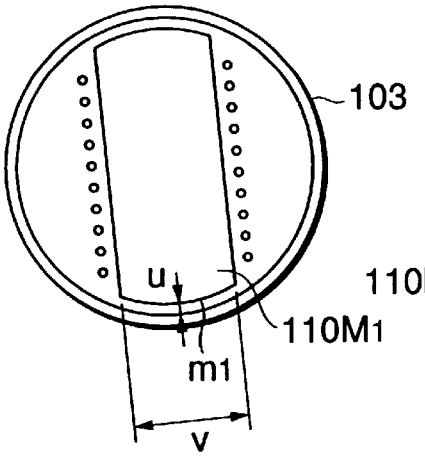
FIG. 27A through FIG. 27F are diagrams showing deformed examples of cores of the fixing device shown in FIG. 25, respectively.

A core 110M1 shown in FIG. 27A is in the rod-shaped cross section and only the end surface ml opposite to the inner wall of the heating roller 103 makes a uniform gap against the inner wall of the roller at the same center curvature as the center of the heating roller 103 and is formed in the close curved surface.

And when assuming that a distance between the end of the core 110M1 and the inner surface of the heating roller 103 is u and a width of the core 110M1, which is the heating width, is v, u is set larger than v (u<v).

Figure 27B:
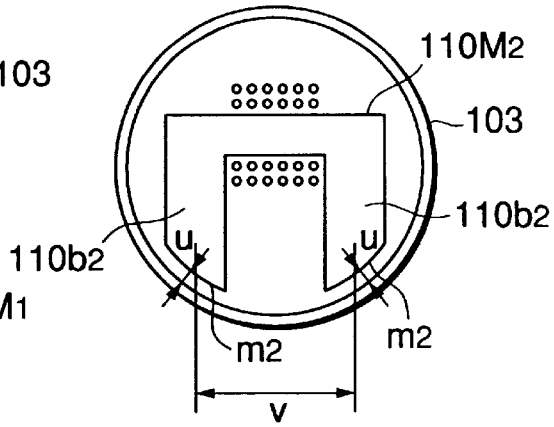

A core 110M2 shown in FIG. 27B is in the nearly inverted U-shaped cross section and the end surface m2 of the both projections 110*b*2 opposite to the inner wall of the heating roller 103 makes a uniform gap against the inner wall of the roller at the same center curvature as the center of the heating roller 103 and is formed in the close curved surface.

And when assuming that a distance between the end curved surface of the core 110M2 and the inner surface of the heating roller 103 is u and a width between the both projections 110*b*2 and 110*b*2 is v, u is set smaller than v (u<v).

Figure 27C:
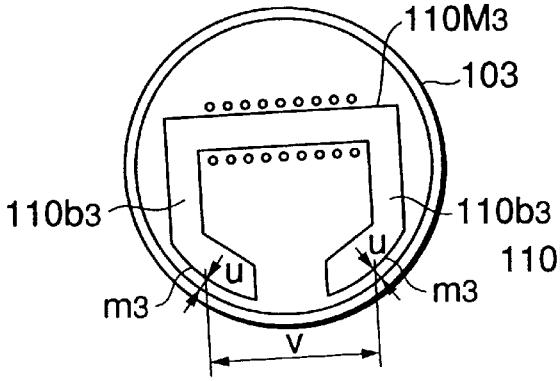

A core 110M3 shown in FIG. 27C is in the nearly inverted U-shaped cross section and its both projections 110*b*3 are bent at the middle portion. The outer surface m3 of the bent portion makes a uniform gap against the inner wall of the roller at the same center curvature as the center of the heating roller 103 and is formed in the close curved surface.

And when assuming that a distance between the end curved surface of the projection 110*b*3 and the inner surface of the heating roller 103 is u and a width between both projections 110*b*3, 110*b*3, that is a heating width is v, u is set smaller than v (u<v).

Figure 27D:
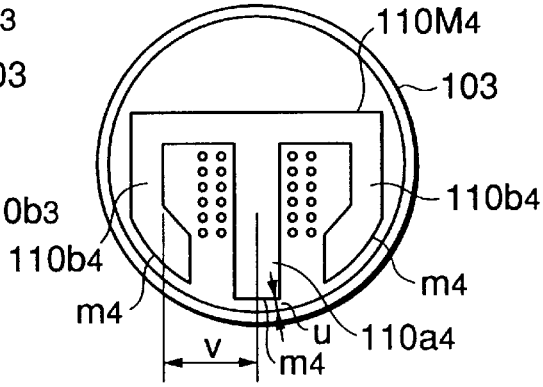

A core 110M4 shown in FIG. 27D is in the nearly E-shaped cross section and both projections 110*b*4 are bent from the middle portion to the end. The end surface of a center projection 110*a*4 and the outer surface m4 of the bent portion of both projections 110*b*4 make a uniform gap against the inner wall of the roller at the same center curvature as the center of the heating roller 103 and is formed in the close curved surface.

And when assuming that a distance between the end curved surface of the core 110M4 and the inner surface of the heating roller 103 is u and the width between the center projection 110*a*4 and both projections 110*b*4 is v, u is set smaller than v (u<v).

Figure 27E:
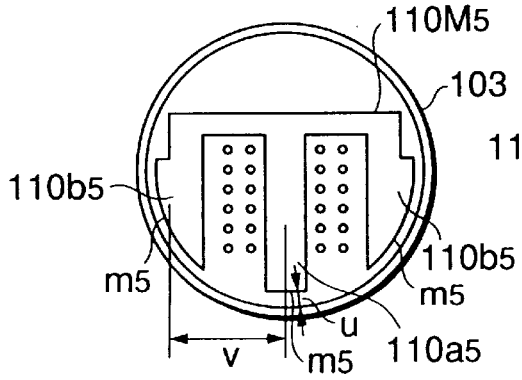
Figure 27F:
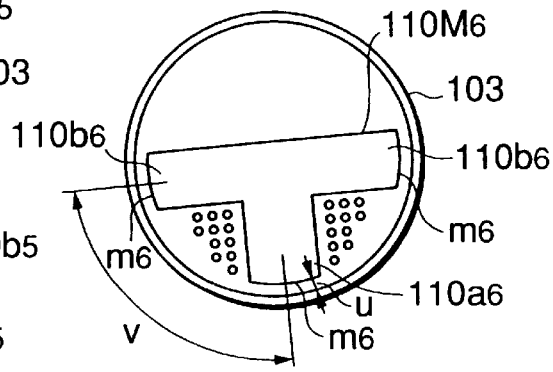

A core 110M5 shown in FIG. 27E is in the nearly E-shaped cross section and the end surface of a center projection 110*b*5 and the end surface m5 of both projections 110*b*5 make a uniform gap against the inner wall of the roller at the same center curvature as the center of the heating roller 103 and is formed in the close curved surface.

And when assuming that a distance between the end curved surface of the center projection 110*a*5 is u and a width between the center projection 110*a*5 bad both projection 110*b*5 is v, u is set smaller than v (u<v).

A core 110M6 shown in FIG. 17Fis in the nearly T-shaped cross section and the end surface m6 of its center projection 110*a*6 and horizontal projection 110*b*6 makes a uniform gap against the inner wall of the roller at the same center curvature as the center of the heating roller 103 and is formed in the close curved surface.

And when assuming that a distance between the end curved surface of the center projection 110*a*6 and the inner surface of the heating roller 103 is u and a width between the center projection 110*a*6 and the horizontal projection 110*b*6 is v, u is set smaller than v (u<v).

In any embodiment shown in FIG. 27, the actions and effects as previously described in FIG. 26A are obtained.

Figure 28:
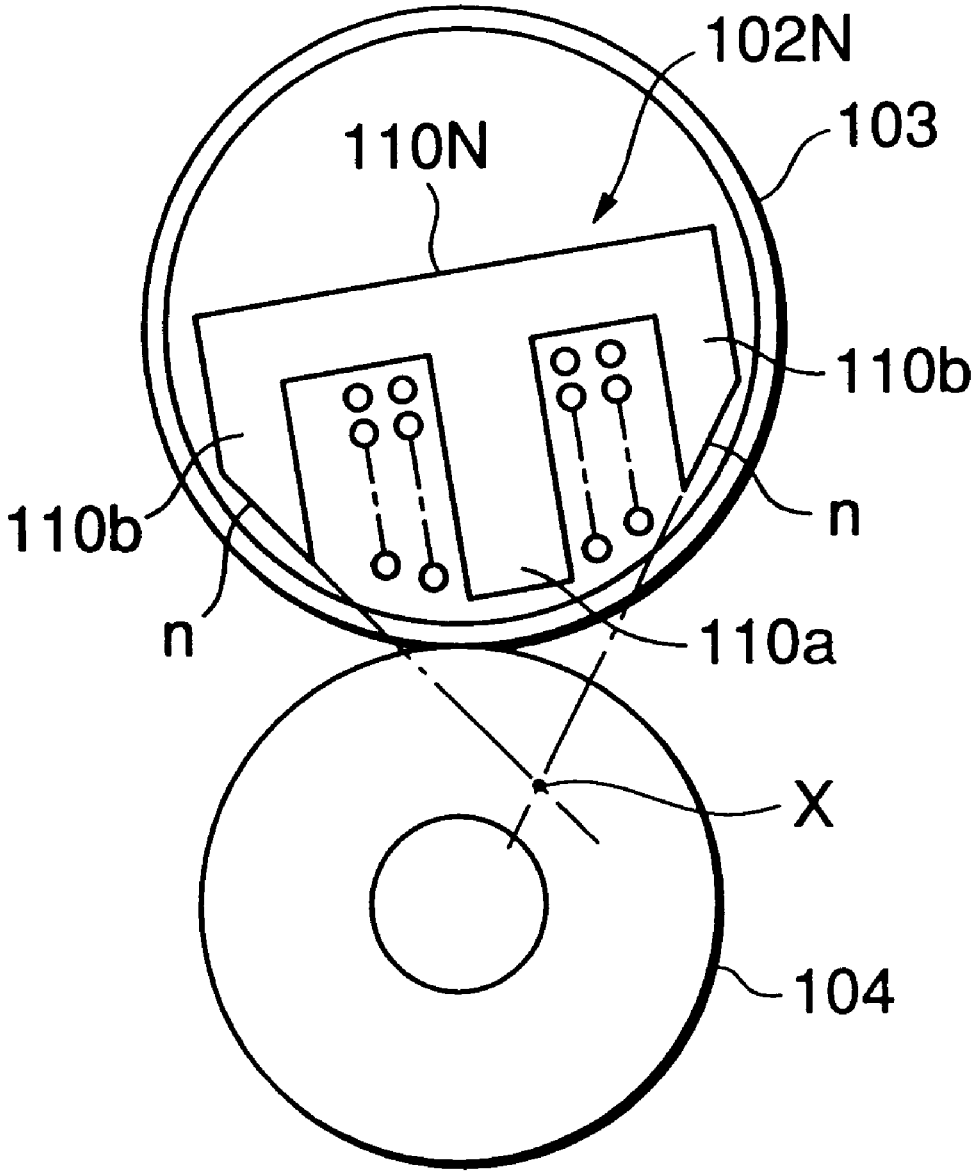
FIG. 28 is a sectional view showing a fixing device in an eighteenth embodiment of the present invention.

Next, referring to FIG. 28, an eighteenth embodiment of the present invention is described.

The basic structure as a fixing device is the same as that previously described and therefore, all component elements other than the principal portions are omitted.

A core 110N comprising an induction heating unit 102N is in the nearly E-shaped cross section and an end surface n of the center projection 110*a* and both projections 110*b* opposite to the inner wall of the heating roller 103 is formed in the rectilinear plane.

The end surface n of the center projection 110*a* is in the direction orthogonal to the longitudinal direction likewise the core 110 previously described for FIG. 2, while the end surface n of the both projections 110*b* is aslant to the longitudinal direction and the inner end is formed in a sharp shape.

When straight lines are extended along the shapes of the end surfaces n, n of both projections 110*b*, 110*b*, these extended lines cross each other between the projections 110*b*, 110*b*. The position of this intersecting point x is always in the inside of the both projections 110*b*, 110*b* and is never positioned at the outside.

On the core 110N in such the structure, magnetic resistance between the core 110N and the heating roller 103 drops and a line of magnetic force in high density is generated likewise the core 110M previously shown in FIG. 16A.

Accordingly, the generated magnetic flux can be acted on the heating roller 103 effectively and in particular, the magnetic flux generated from the end surface n of both projections 110*b* of the core 110N does not diffuse to other parts and large eddy current is generated on the heating roller 103 and high heating efficiency is obtained.

FIG. 29A through FIG. 29E show deformed examples of the core 110N previously shown, respectively.

Figure 29A:
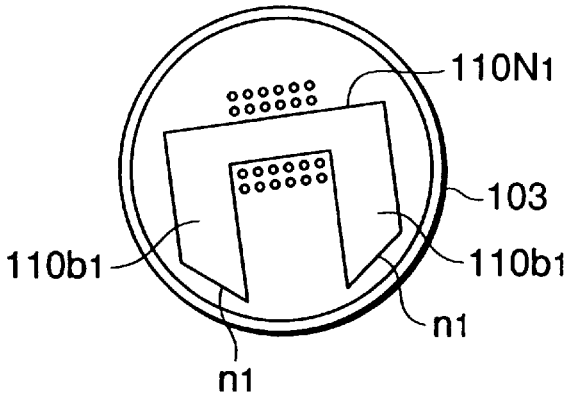
FIG. 29A through FIG. 29E are diagrams showing deformed examples of cores of the fixing device shown in FIG. 28.

A core 110N1 shown in FIG. 29A is in the nearly inverted U-shape cross section and the end surfaces nl, nl of the both projections 110*b*1 opposite to the inner wall of the heating roller 103 are formed in the obliquely straight shape and the plane extension lines of these ends intersect between the projections.

Figure 29B:
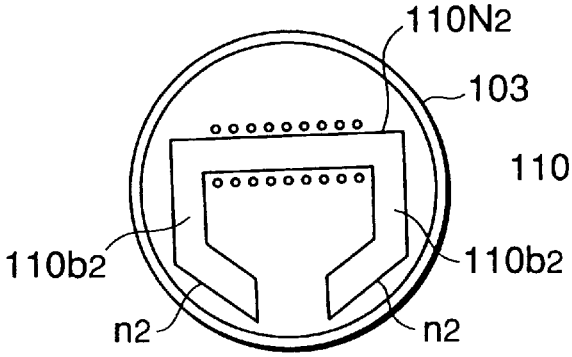

A core 110N2 shown in FIG. 29B is in the nearly inverted U-shape cross section and its both projections 110*b*2 are bent at the middle. The outer surfaces n2 of the bent portions are formed in the obliquely straight shape and their plane extension lines intersect between the projections.

Figure 29C:
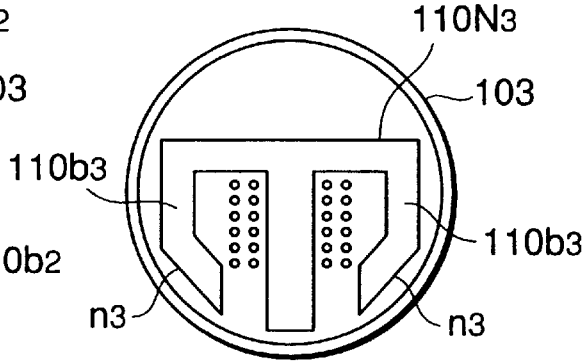
Figure 29D:
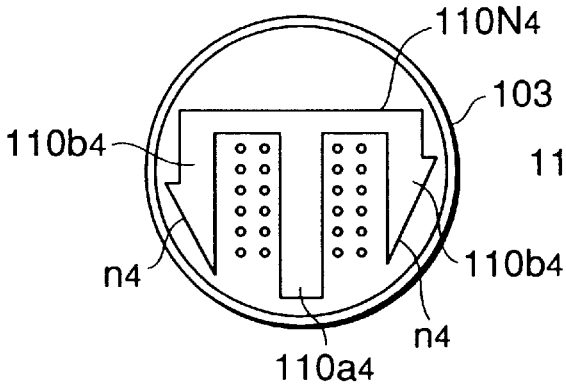

A core 110N3 shown in FIG. 29C is in the nearly E-shape cross section and both projections 110*b*3, 110*b*3 are bent from the middle to the end. The outer surfaces n3, n3 of the bent portions are formed in the obliquely straight shape and their plane extension lines intersect between the projections.

A core 110N4 is in the nearly E-shape cross section and the end surfaces n4, n4 of the both projections 110*b*4, 110*b*4 are formed in the obliquely straight shape and their plane extension lines intersect between both projections.

A core 110N4 shown in FIG. N4 is in the nearly inverted E-shape cross section and the end surfaces n4, n4 of the both projections 110*b*4, 110*b* 4 are formed in the obliquely straight shape and their plane extension lines intersect between both projections.

Figure 29E:
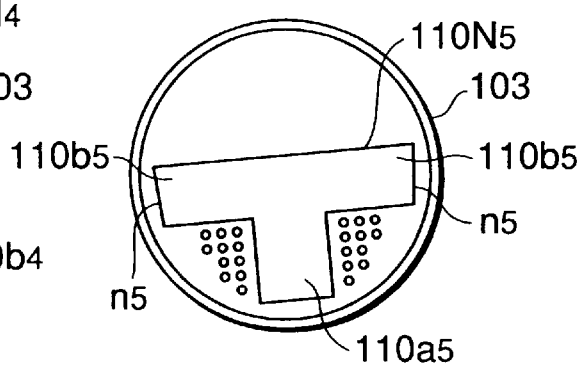

A core 110N5 shown in FIG. 29E is in the nearly T-shaped cross section and the end surfaces N5, n5 of the horizontal projection 110*b*5 is formed in the obliquely straight shape and their plane extension lines intersect between the projections.

In any embodiment shown in FIG. 29, the actions and effects previously described in FIG. 28 are obtained.

Figure 30A:
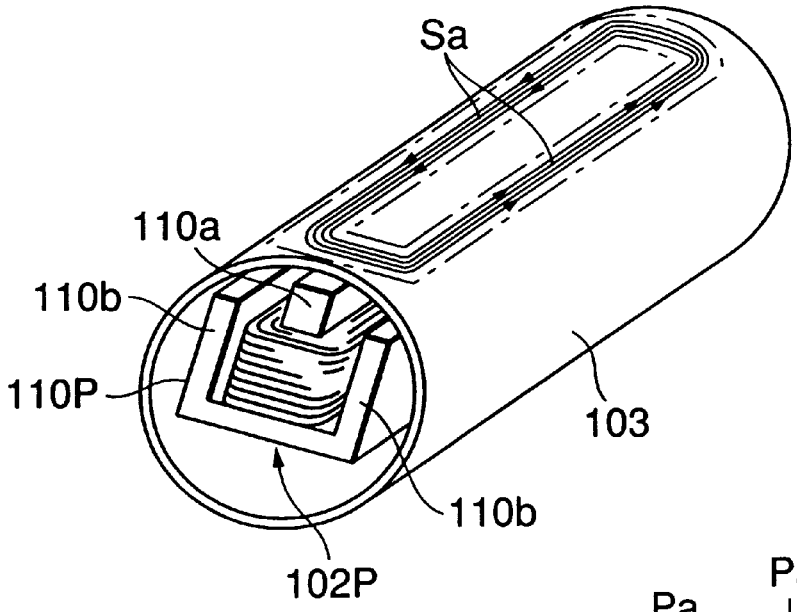
FIG. 30A is a perspective view showing a fixing device in a nineteenth embodiment of the present invention.
Figure 30B:
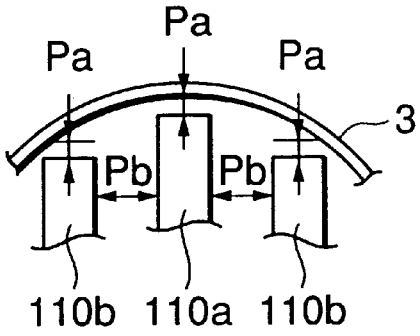
FIG. 30B is a schematic diagram showing the dimensional setting in the fixing device shown in FIG. 30A.

Next, referring to FIG. 30A and FIG. 30B, the nineteenth embodiment of the present invention is described.

As the basic structure as a fixing device is the same as that previously described, the same component elements are assigned with the same reference numerals and a new explanation is omitted.

A core 110P comprising an induction heating unit 102P is formed in the nearly E-shaped cross section using a high permeable ferrite element. Accordingly, the ends of the center projection 110*a*, the both projections 110*b*, 110*b* of the core 110P facing the inner wall of the heating roller 103 form 3 points of the heating roller facing portions.

Figure 30C:
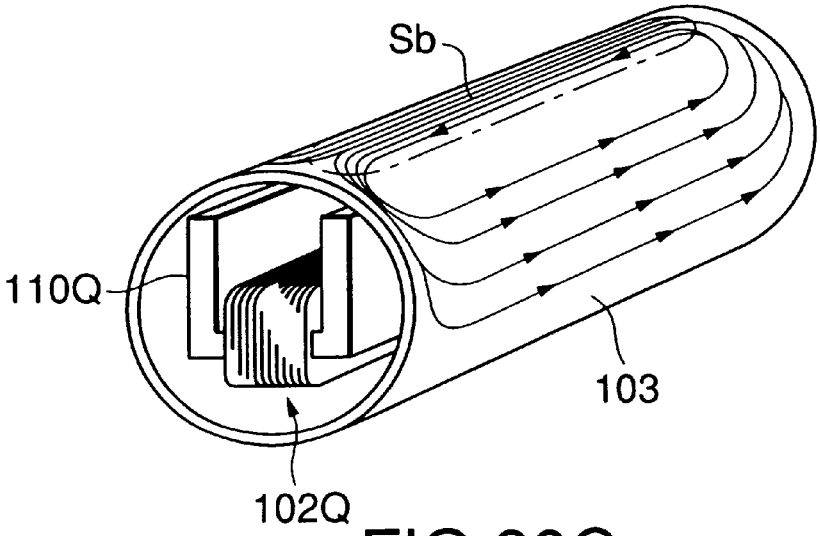
FIG. 30C is a perspective view showing an example of comparison with the nineteenth embodiment of the present invention.

Originally, in the sense of concentrating heating portions, a core 110Q that is formed in the nearly U-shaped cross section and has 2 points of both projections 110*b* opposite to the heating roller 103 like an induction heating unit 102Q shown in FIG. 30C is best suited.

In this case, at a part opposite to a portion between both projections 110*b* of the core 110Q, the eddy current closed loop Sb—side is formed. However, after passing this portion, the eddy current expands largely to the left and right and the density becomes rough.

On the contrary, on the core 110P that is in the E-shaped cross section and has 3 points opposite to the heating roller 103 shown in FIG. 30A, the eddy current closed loop Sa is formed at portions opposite to the center projection 110*a* and both projections 110*b*.

That is, there are two streaks opposite to the center projection 110*a* and both projections 110*b* and the closed loop Sa formed at these points and eddy current is concentrated without being diffused. Accordingly, heat energy is concentrated efficiently and heat efficiency is improved.

Further, it is necessary to reduce magnetic resistance between the core 110P and the heating roller 103 rather than the opposing distance between the center projection 110*a* and both projections 110*b* of the core so that magnetic flux generated in the core 110P is brought to an end without acting on the heating roller 103.

That is, as shown in FIG. 30B, a size that is made a gap pa between the ends of the center projection 110*a*, both projection 110*b* and the heating roller 103 smaller than an opposed space size pb between the center projection 110*a* and the both projections 110*b* of the core 110P is set.

Definitely, the opposed space size pb between the center projection 110*a* and the both projections 110*b* of the core 110P is 5 mm and the gap pa between the ends of the center projection 110*a* and the both projections 110*b* and the heating roller 103 is set at 0.5 mm.

Figure 31:
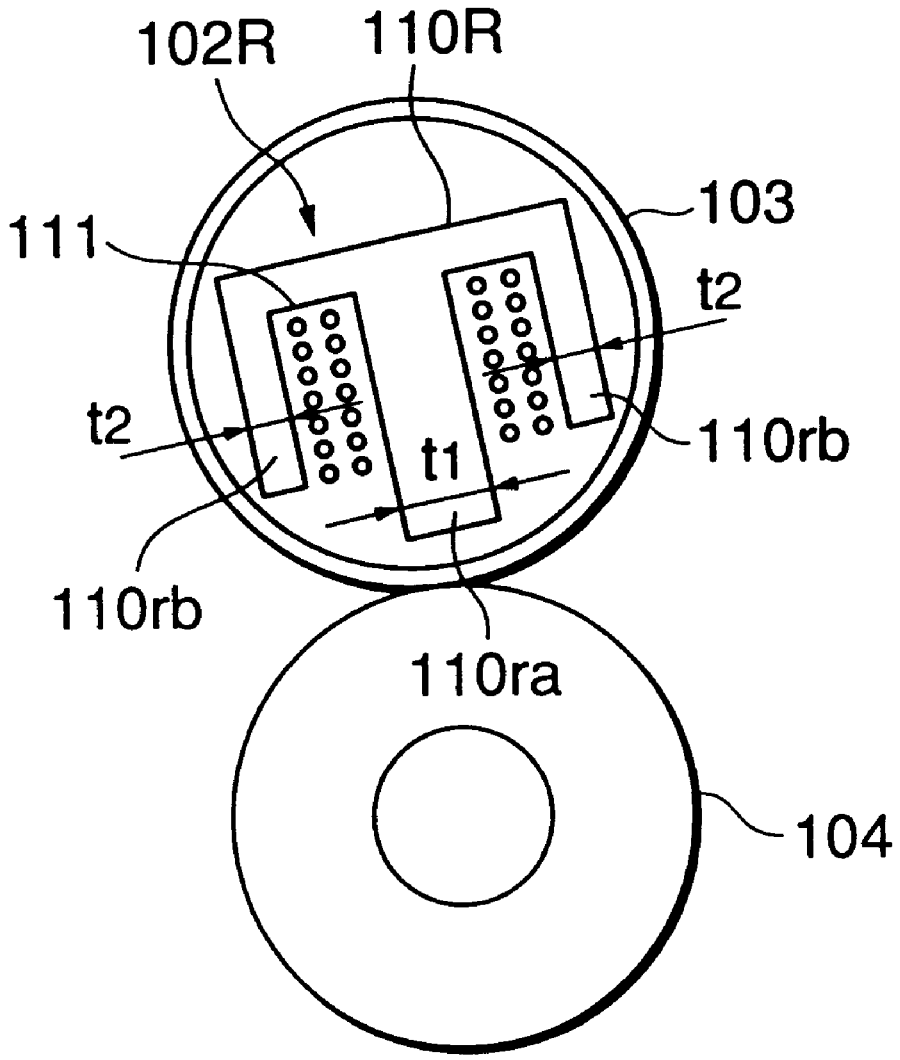
FIG. 31 is a sectional view showing a fixing device in a twentieth embodiment of the present invention.

Next, referring to FIG. 31, a twentieth embodiment of the present is described.

As the basic structure as a fixing device is the same as that previously described, the same component elements are assigned with the same reference numerals and a new explanation is omitted.

A core 110R comprising an induction heating unit 02R is in the E-shaped cross section and has at least 3 points opposite to the inner wall of the heating roller 103. The coil 111 is would round a center projection 110*ra* out of these points.

The thickness t1 of the center projection 110*ra* of the core 110R is twice of the thickness t2 of the both projections. Thus, by varying the thickness of the center projection 110*ra* and that of the both projections 110*rb*, not only saturated magnetic flux simply becomes high at the center projection 110*ra* but also the core 110R can be downsized in order to insert it into the heating roller 103.

That is, since the distribution of magnetic flux in the core 110R is largely governed by its sectional shape, an optimum design value cannot be decided only by the saturated magnetic flux density and the characteristic of portions generating magnetic flux is largely affected in addition to the corner portions and the core 110R.

In case of a system to concentrate the heating portion to the contacting portion between the heating roller 103 and a fixing medium, it is necessary to concentrate magnetic flux generated from the core 110R to the heating roller 103 in order to improve heating efficiency by displaying the effect of magnetic flux.

According to the structure described above, magnetic flux generated from the portions of the core 110R opposite to the heating roller 103 is not brought to the end without acting on other opposing portions of the core 110R and the heating roller 103 and the efficient heating is obtained.

Further, there is no problem when a mold lubricant layer or an offset preventive oil is applied to the surface of the heating roller 103 comprising the fixing device described above.

Next, referring to FIG. 32 through FIG. 35, a twenty-first embodiment of the present invention is described.

Figure 34:
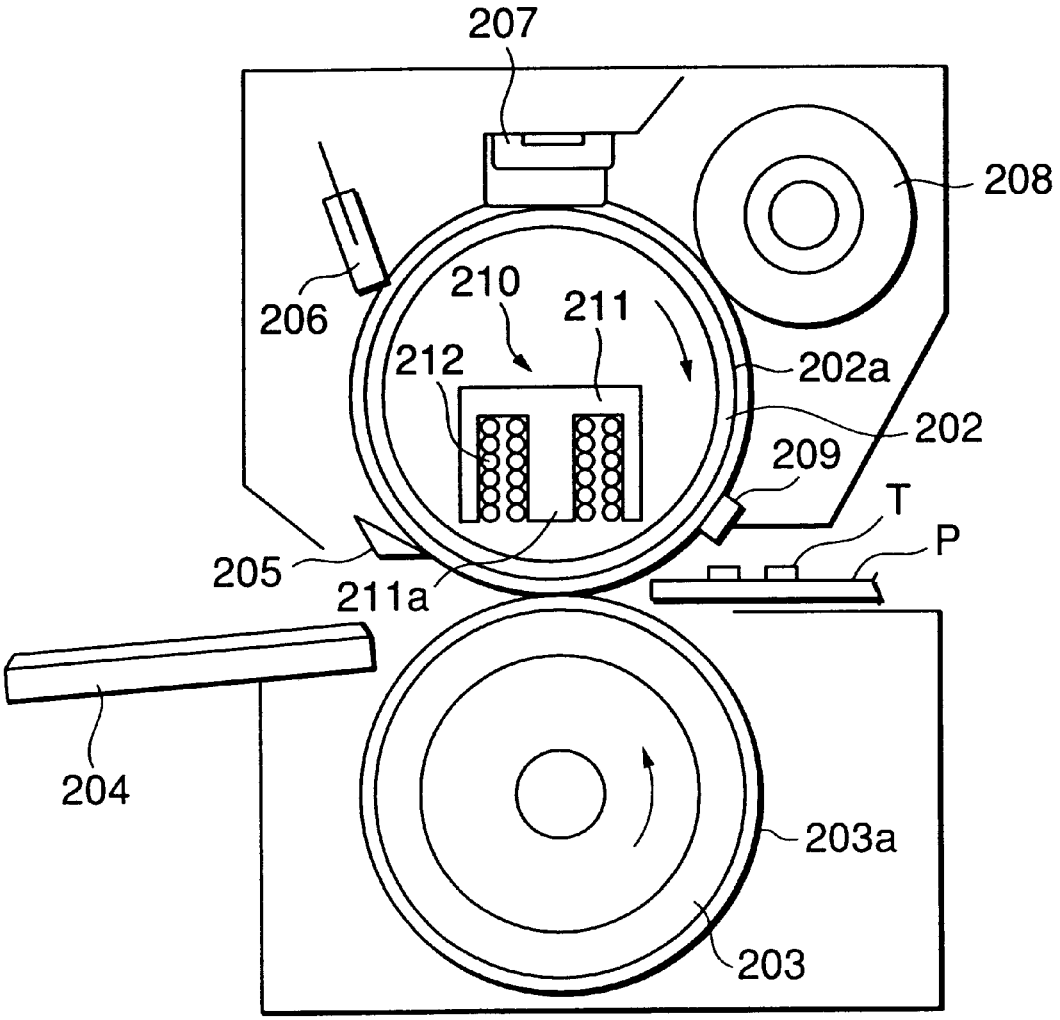
FIG. 34 is a schematic sectional view showing the entirety of a fixing device incorporating the induction heating unit shown in FIG. 32.

As shown in FIG. 34, at the upper and lower positions to clamp the conveying path of a paper P carrying a developer image T formed on the top, a conductive heating roller 202 (a heating member or a first contacting member; ϕ43 mm) and a pressure roller 203 (a second contacting member: ϕ40 mm) that contacts this heating roller 202 in the pressing state with a bias force from the pressing mechanism (not shown) are arranged. The contacting members of the rollers 202 and 203 are maintained in a fixed nip width.

The heating roller 202 is driven in the arrow direction by a driving motor (not shown) and the heating roller 203 is rotated in the arrow direction following the heating roller 202. The heating roller 202 is made of iron and is 0.6 mm thick. The surface of the roller is covered by a mold lubricant layer 202*a* such as Teflon, etc. The pressure roller 203 is in the structure that a core metal is covered by a member 203*a* of silicon rubber, fluoric rubber, etc. When a paper P passes through the fixing point that is the contacting portion (the nip portion between these heating roller 202 and the pressure roller 203 and heated by the heating roller 202, a developer image T on the paper P is fused and fitted on the paper P. The fixed paper P is ejected in a receiving tray 204.

At the downstream side in the rotating direction from the contact portion between the heating roller 202 and the pressure roller 203, a separation claw 205 to separate a paper P from the heating roller 203, a cleaner 206 to remove toner, waste paper and other dust offset on the heating roller 202, a thermistor 207 to detect a temperature of the heating roller 202 and a mold lubricant coating unit 208 to coat an offset preventive mold lubricant are arranged around the heating roller 202. Further, at the position where no problem is caused for the rotation of the heating roller 202 and the pressure roller 203 on the surface of the heating roller 202, a thermostat 209 is mounted as a temperature fuse.

In the heating roller 202, an induction heating unit 210 is accommodated as a magnetic field generating means. The induction heating unit 210 comprises an E-shaped core 211 and an excitation coil 212 wound round an inner leg 211*a* of the core 211. The excitation coil 212 used a copper wire ϕ0.5 mm and is produced as a litz wire. This litz wire makes it possible to effectively apply AC current. Further, the excitation coil 212 is covered by a heat resisting polyimide.

High frequency current is supplied to the excitation coil 212 from an excitation circuit (an inverter circuit) (not shown) and the magnetic field is generated from the excitation coil 212. This magnetic field is concentrated to the vicinity of the above contacting portion by the core 211 and magnetic flux and eddy current are generated on the heating roller 202. Heat is generated by this eddy current and the heating roller resistance. In particular, by the shape of the core 211 and the excitation coil 212, the contacting portion only of the heating roller 202 is locally heated.

In this twenty-first embodiment, high frequency current of 20 kHz and 900 W is supplied to the excitation coil 212 and the surface temperature of the heating roller 202 is set at 180° C. The high frequency current is fed back and controlled by comparing this set temperature with the detected temperature of the thermistor 207. At this time, in order to make the temperature distribution uniform, the rollers 202 and 203 are rotating. By rotating the rollers, a uniform heat value is given to the overall surface of the roller 202. When the surface temperature of the heating roller reaches 180° C., the copying operation starts and when a paper P passes the fixing point that is the contacting portion (the nip portion) between the heating roller 202 and the pressure roller 203, a developer on this paper is fused, fitted and fixed thereon. Further, current is supplied to the inverter circuit via the thermostat 209 that is a temperature fuse press fitted to the surface of the heating roller. This thermostat 209 shuts off current being supplied to the inverter circuit when the surface temperature of the heating roller 202 reaches a pre-set abnormal temperature.

Figure 32:
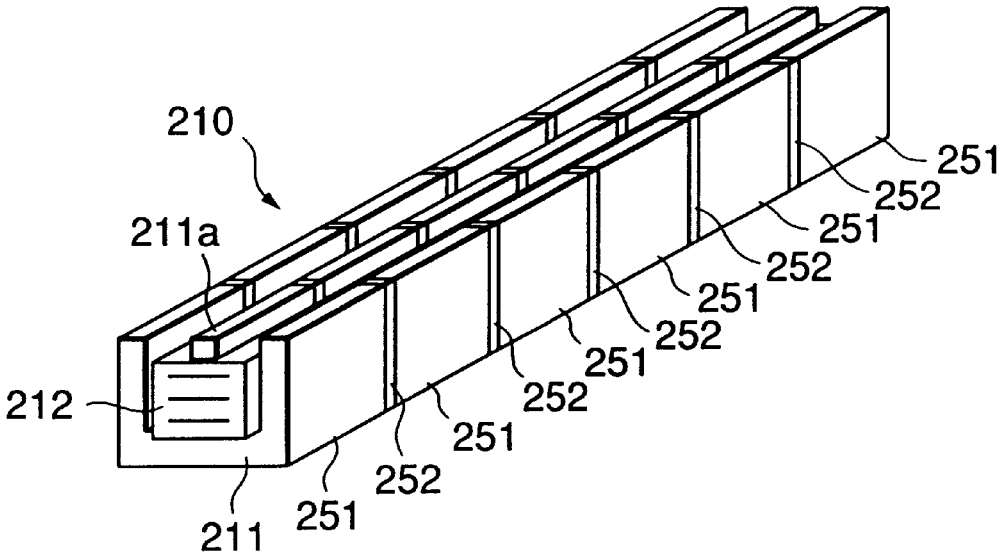
FIG. 32 is a perspective view showing an induction heating unit in a fixing device in a twenty-first embodiment of the present invention.

In this structure, as shown in FIG. 32, the core 211 is constructed in one unit by laminating at least more than one core elements 251 made of ferrite along the axial direction of rotation of the heating roller 202 and adhering each other by a bonding agent 252. After this unification, the excitation coil 212 is wound round the inner leg 211*a*. By the shape of this core 211, it is possible to concentrate the heating to the contacting portion of the heating roller 202.

Further, a material of the core element is not limited to ferrite but an iron core, permalloy, etc. are usable. In the case of an iron core or a permalloy, they are conductive materials differing from ferrite and therefore, a core member 251 is manufactured in one united body using directly these materials, eddy current is generated in the core itself and thermal loss can be caused. However, when the core is the unified structure by laminating and adhering materials as described above, eddy current is hard to draw a closed loop and the generation of eddy current can be prevented. Further, as materials are laminated and adhered, the mechanical strength of the core 211 is equivalent to a conventional unified type core and it is not necessary to hold the core 211 with a special holder, pin, etc. Further, in the case of a ferrite core, when a core is manufactured in a united shape (approx. 20 mm×15 mm×370 mm) as used in this embodiment, it is difficult to make it in a accurate size. In particular, it is difficult to get the flatness and dimensional accuracy in the longitudinal direction of the core. This can be a factor to warp the core. Even if the dimensional accuracy is maintained, this can be a factor of a sharp increase in manufacturing cost. However, when a united body is manufactured by laminating and adhering core elements as in this embodiment, it is possible to make individual core element in accurate dimensions at a cheap price. When an individual core element 251 is manufactured in a united body, the cost increase also can be suppressed and furthermore, mechanical strength also can be obtained.

Figure 33:
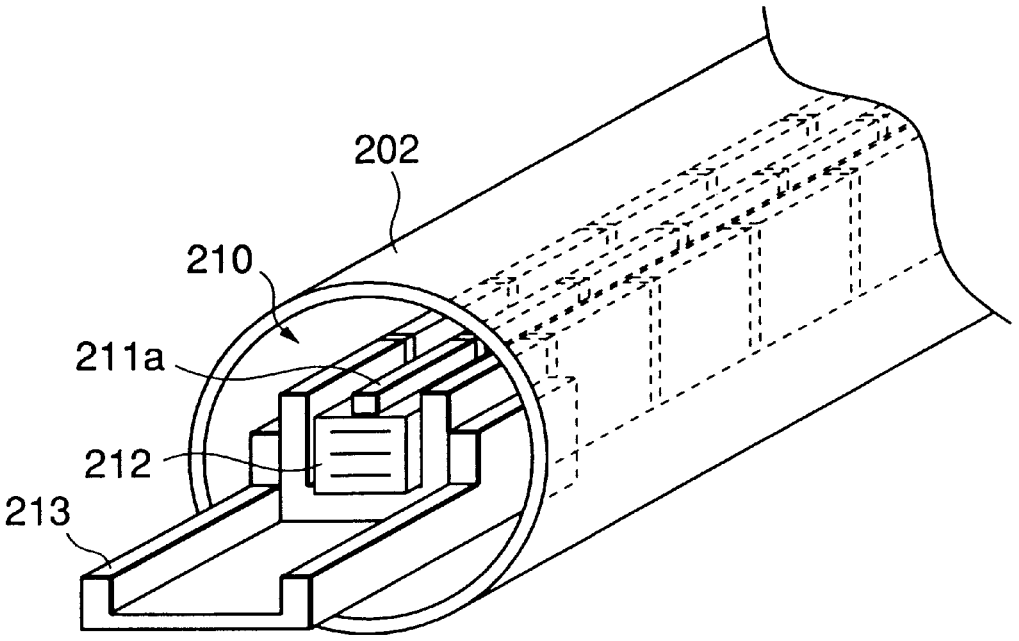
FIG. 33 is a perspective view showing the state of the induction heating unit shown in FIG. 32 incorporated in a heating roller.

Further, as shown in FIG. 33, a support member 213 is mounted to both ends of the core 211, respectively and these supporting members 213 are fixed to a fixing sheet metal (not shown) of the main body. An induction heating unit 210 is supported by these support members 213 separately from the heating roller 202. The adoption of this supporting structure eliminates the requirement of the holder, bobbin, etc. described above and enables it to arrange the induction heating unit 210 properly irrespective of a limited space in the heating roller 202, and in its turn the diameter of the heating roller 202 can be made small. Further, the cost increase resulting from use of holder, bobbin, etc. can be avoided.

Further, as the induction heating unit 210 is arranged in the heating roller 202, leakage of magnetic flux is less and thermal efficiency is improved. Furthermore, when the diameter of the heating roller 202 is made small gradually for downsizing, the core 211 and the inner surface of the heating roller 202 come close to each other and in turn, magnetic flux is much generated and heat value can be increased. The positioning of the core 211 and the heating roller 202 can be made by adjusting the fixing positions of the support members 213 and the fixing sheet metal of the main proper of the unit. Thus, it becomes possible to maintain a dimensional tolerance of the position.

Figure 35:
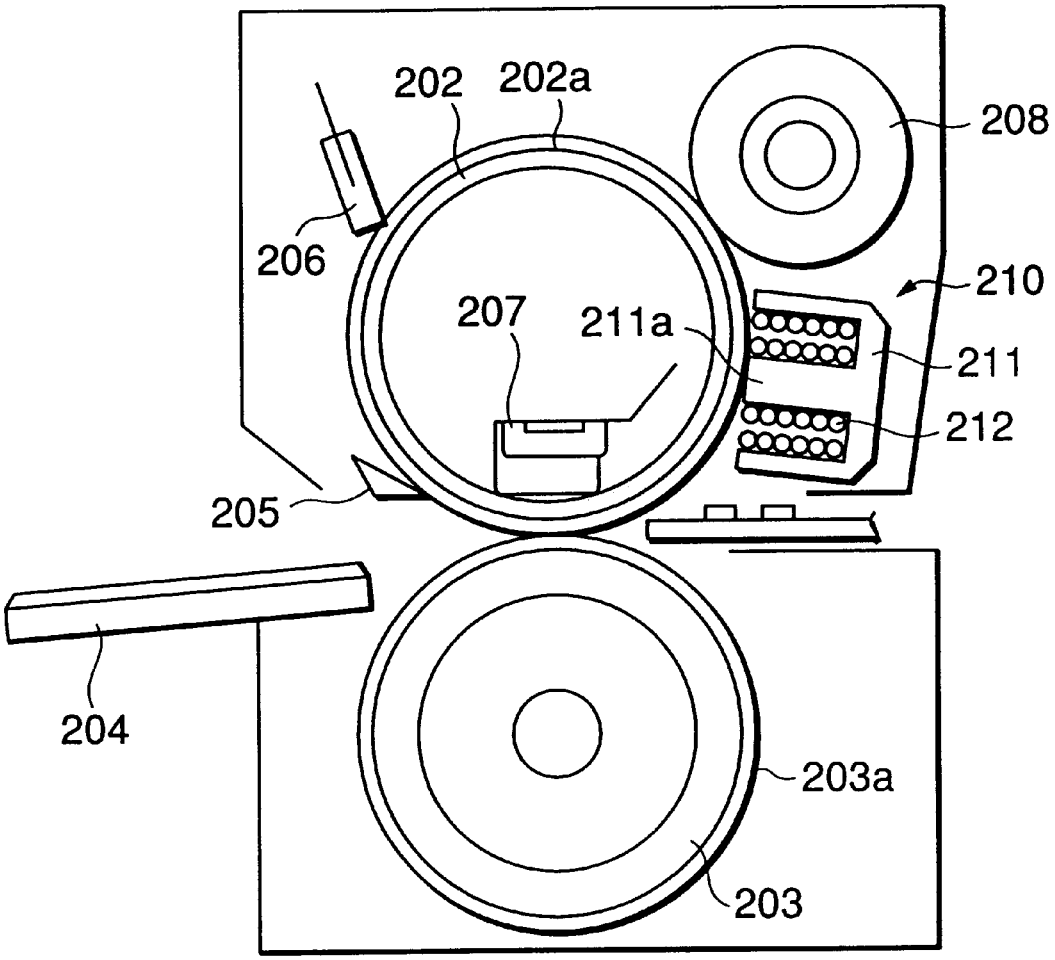
FIG. 35 is a schematic sectional view showing the entirety of a fixing device with the induction heating unit shown in FIG. 32 arranged around the outside circumference of a heating roller.

Further, it is not always necessary to arrange the induction heating unit 210 in the heating roller 202 and the induction heating unit 210 may be arranged at any position opposite to the outer surface of the heating roller 202 as shown in FIG. 35.

Figure 36:
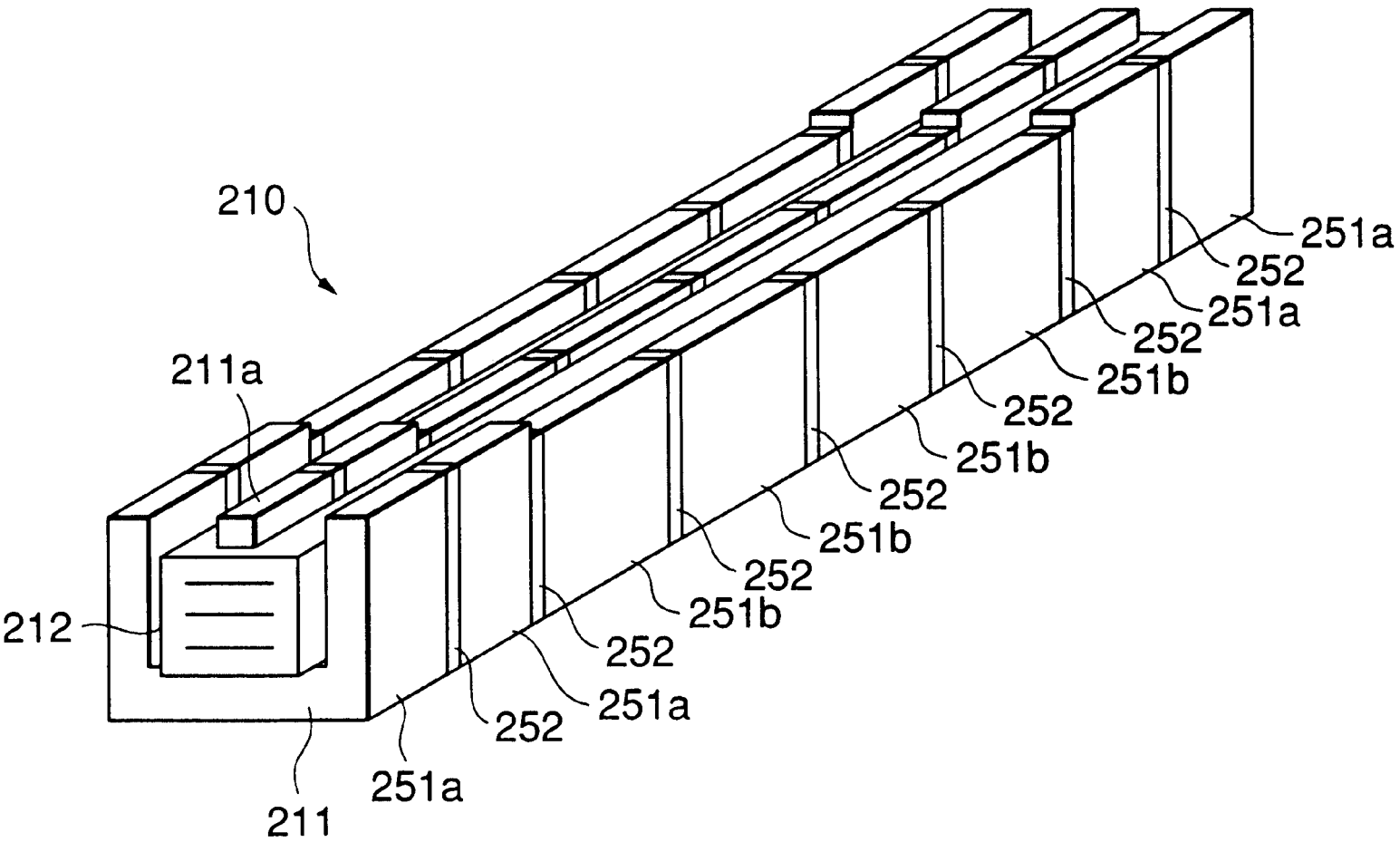
FIG. 36 is a perspective view showing an induction heating unit in a fixing device in a twenty-second embodiment of the present invention.

Next, referring to FIG. 36, a twenty-second embodiment of the present invention is described.

As shown in FIG. 36, the core 211 is composed in one united body by laminating and a plurality of core elements 251*a* and 251*b* along the axial rotating direction of the heating roller 202 and adhering each other by a bonding agent 252. After laminating and adhering these core elements 251*a* and 251*b* into one united body, the excitation coil 212 is wound round the inner leg 211*a*.

The legs of the core elements 251*a* and 251*b* are in different lengths each other, the core elements 251*a* in the longer length are arranged at both ends in the longitudinal direction of the core 211 and the core elements 251*b* in the shorter length is arranged in the inside in the longitudinal direction of the core 211.

According to the above structure, a distance between the core 211 and the heating roller 202 becomes shorter at both ends of the core 211 in the longitudinal direction than at the central side in the longitudinal direction. Therefore, magnetic flux crossing the heating roller 202 becomes much more at the both ends in the axial direction than the central side in the axial direction of the heating roller 202 and a heat value at both ends in the axial direction becomes larger than that at the central side in the axial direction.

That is, when the shape of the core at the points corresponding to both ends of the heating roller 202 in the axial direction and that at the point corresponding to the central side of the heating roller 202 in the axial direction are made different each other, it becomes possible to vary and adjust the distance between the core 211 and the heating roller 202 at both ends and the central side of the heating roller 202 in the axial direction and to compensate the heat radiation from both ends of the heating roller 202 in the axial direction.

Such effects as sufficient mechanical strength, satisfactory dimensional accuracy, cost reduction, etc. that can be obtained as in the twenty-first embodiment.

Figure 37:
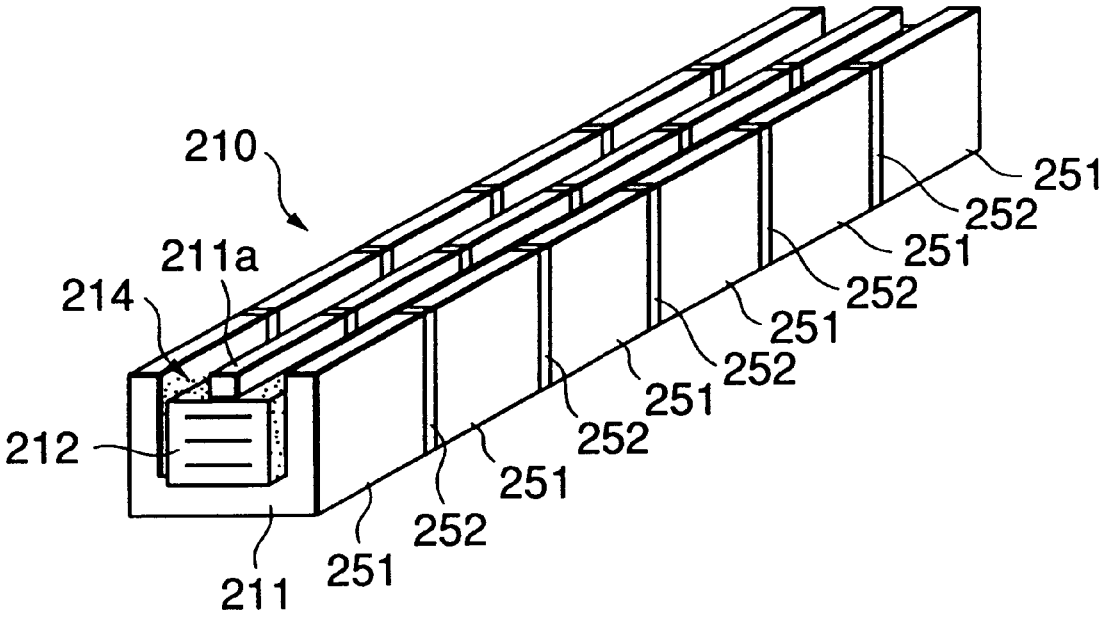
FIG. 37 is a perspective view showing an induction heating unit in a fixing device in a twenty-third embodiment of the present invention.

Next, referring to FIG. 37, a twenty-third embodiment of the present invention is described.

In this embodiment, as a bonding agent 252 used to adhere core element 251 (or 251*a* and 251*b*), epoxy resin or a ceramic bonding agent having a heat resisting temperature higher than temperature for fixing, for instance, above 180° C. are adopted. Other constructions are the same as the twenty-first embodiment.

By the adoption of such a bonding agent, it becomes possible to extract characteristics of the core 211 stably during the fixing operation. That is, when the induction heating unit 210 is arranged in the heating roller 202, the temperature of the core 211 itself is raised by the radiation heat from the inner surface of the heating roller 202. As the temperature of the core 211 closes the surface temperature of the heating roller 202 lastly, a heat resisting temperature above 180° C. is demanded for the a bonding agent 252 in order to maintain the unification of each core element 251. By responding to this demand, the strength of the core 211 is maintained and its life is promoted.

If a bonding agent having a heat resisting temperature lower than a fixing control temperature was used, it was necessary to provide a fan to cool the air layer in the heating roller 202 by moving the air layer in order to maintain the core temperature at a fixed temperature or below but it is no longer needed in this twenty-third embodiment. Further, as it is unnecessary to use a holder, etc. to hold each core element 251, the downsizing becomes possible.

Further, in this twenty-third embodiment, the core elements in the same shape were used but even when core elements in different shapes or having difference characteristics are used, similar effects are obtained.

After the excitation coil 212 was wound round the inner leg 211*a* of the core 211, an impregnant 214 shown by dots in FIG. 37 is filled to cover the excitation coil 212. Other structures are the same as the twenty-first embodiment.

By filling this impregnant, the excitation coil 212 is solidly fixed to the core 211 without clearance and the strength of the unified structure of the excitation coil 212 and the core 211 is increased. Even when vibration is caused from the rotation of the heating roller 202, the movement of the excitation coil 212 and the core 211 can be prevented and such trouble as the contact between the excitation coil 212 and the heating roller 202 can be prevented.

Unsaturated polyester, epoxy ester, polyimide, etc. are used as the impregnant 214.

Further, the laminated and bonded state of the core elements 251 becomes firm by filling the impregnant 214 and the structural strength increases more than that when the bonding agent 252 only is used.

When the induction heating unit 210 is arranged in the heating roller 202, it is not needed to cool the air by providing a fan when the impregnant 214 which has a heat resisting temperature high than the fixing control temperature (for instance, 180° C.) is adopted and thus, the strength of the induction heating unit 210 is maintained and the life is improved.

Further, although the core elements in the same shape were used in this twenty-third embodiment, it is needless to say that the same effects are obtained even when core elements in different shapes and characteristics are used.

Figure 38:
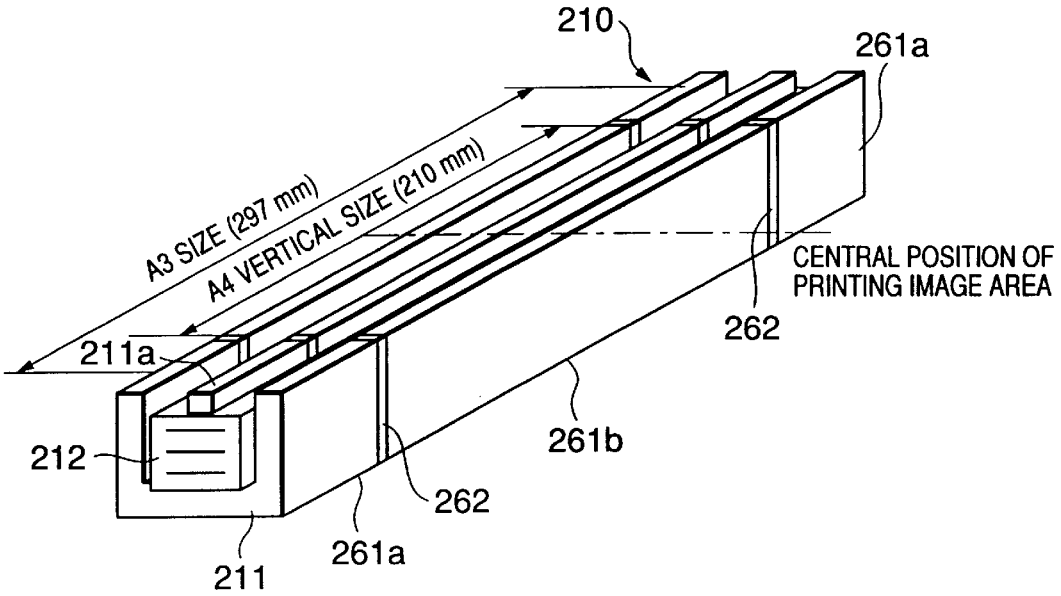
FIG. 38 is a perspective view showing an induction heating unit in a fixing device in a twenty-fourth embodiment of the present invention.
Figure 39:
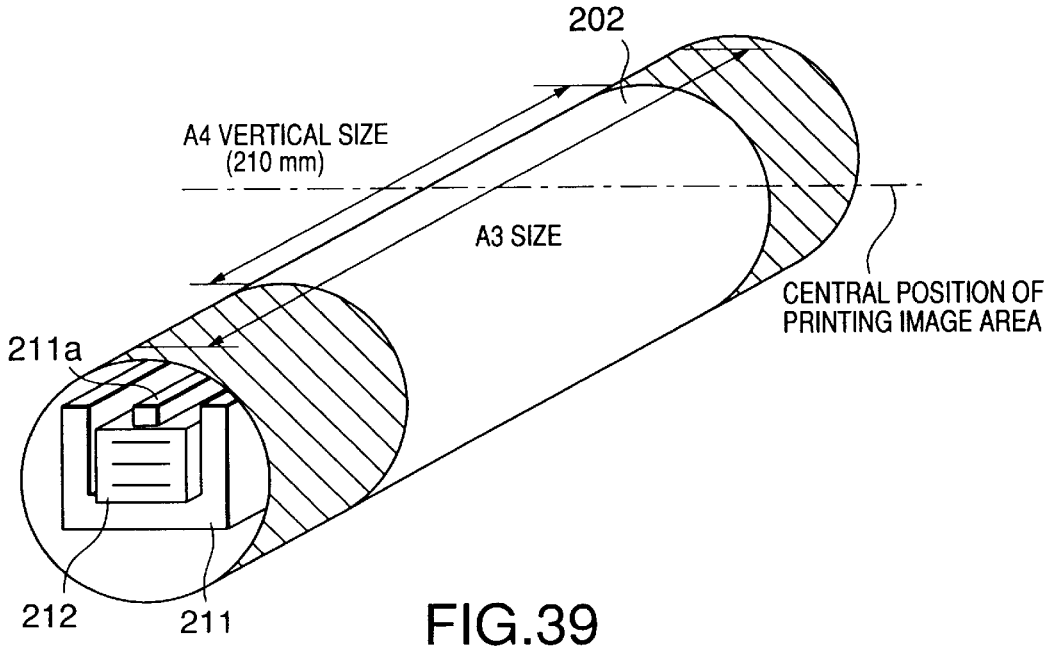
FIG. 39 is a perspective view showing the state of the induction heating unit shown in FIG. 38 incorporated in a heating roller.

Next, referring to FIG. 38 and FIG. 39, a twenty-fourth embodiment of the present invention is described.

As shown in FIG. 38, the core 211 is constructed in a united body by laminating and bonding 3 core elements 261*a*, 261*b* and 261*a* made of ferrite along the axial direction of rotation of the heating roller 202 via a clearance forming member, for instance, a heat resisting resin layer 262. After laminating and bonding these core elements 261*a*, 261*b* and 261*a* and the clearance forming member, the excitation coil 212 is wound round the inner leg 211*a*.

The length of the core element 261*b* along the axial direction of rotation of the heating roller 202 is equivalent to the A4 vertical paper size and the length of the core elements 261*a* along the axial direction of the rotation of the heating roller 202 is shorter than the core element 261*b*.

Two core elements 261*a* are laminated and bonded by putting one core element 261*a* between and the overall length of the core 211 is more than A3 size.

The heat resisting resin layer 262 is to form a fixed clearance between the core elements and is formed in the same shape as the core elements 261*a* and 261*b* using polyimide resin. The thickness of this heat resisting resin layer (that is, a clearance) is desirable 10/μm–1 mm. This is a clearance that does not produce a larger difference as the magnetic characteristic than that when the heating resisting resin layer 262 is not inserted between the core elements and is able to generate sufficient eddy current.

Other structures are the same as the twenty-first embodiment.

The induction heating unit 210 thus constructed is accommodated in the heating roller 202 as shown in FIG. 39.

Next, the actions of this twenty-fourth embodiment are described.

When A4 vertical size paper is successively passed through the fixing device, the temperature of the non-paper passing area (the oblique lined portion in FIG. 39) becomes higher than the temperature of the paper passing area. The temperature of the core 211 is also raised by heat radiated from the inside of the heating roller 202 and regarding the core 211, the temperature rise of the non-paper passing area becomes larger than the temperature rise of the paper passing area.

If there is no heat resisting resin layer 262 between the core elements of the core 211, heat flows into the paper passing area from the non-paper passing area of the core 211. As ferrite is used for the core elements, if the temperature of the core 211 rises and exceeds the Curie point, magnetic flux decreases. As a result, eddy current generated in the heating roller 202 decreases and a heat value drops.

When there exist certain clearance by the heat resisting resin layer 262 between the paper passing area and the no-paper passing area as in this twenty-fourth embodiment, thermal conductivity between the non-paper passing area and the paper passing area becomes low and the heat movement from the non-paper passing area to the paper passing area becomes less. Thus, a heat value of he paper passing area in the heating roller 202 can be made uniform. On the other hand, as the temperature of the non-paper passing area results in the temperature rise of the core 211 as the heat movement becomes less. However, when the temperature exceeds the Curie point, magnetic flux decreases and a heat value of the heating roller 202 also creases and the temperature of the core 211 is controlled near the Curie point. That is, in this twenty-fourth embodiment, there are such effects that a heat value of the paper passing area is made uniform and the temperature rise of the non-paper passing area is suppressed. Furthermore, as a result of the existence of clearances, it is possible to reduce core elements and expect cost reduction.

Further, it is needless to say that minimum size of paper P is not limited to A4 vertical size and a post card size, etc. are usable in this twenty-fourth embodiment. Further, when the heat resisting resin layer 262 is provided at the ends of a post card size and A4 vertical size, similar effects are obtained. Further, although polyimide resin was used as the heat resisting resin layer 262, non-magnetic materials such as glass, etc. are also usable.

Figure 40:
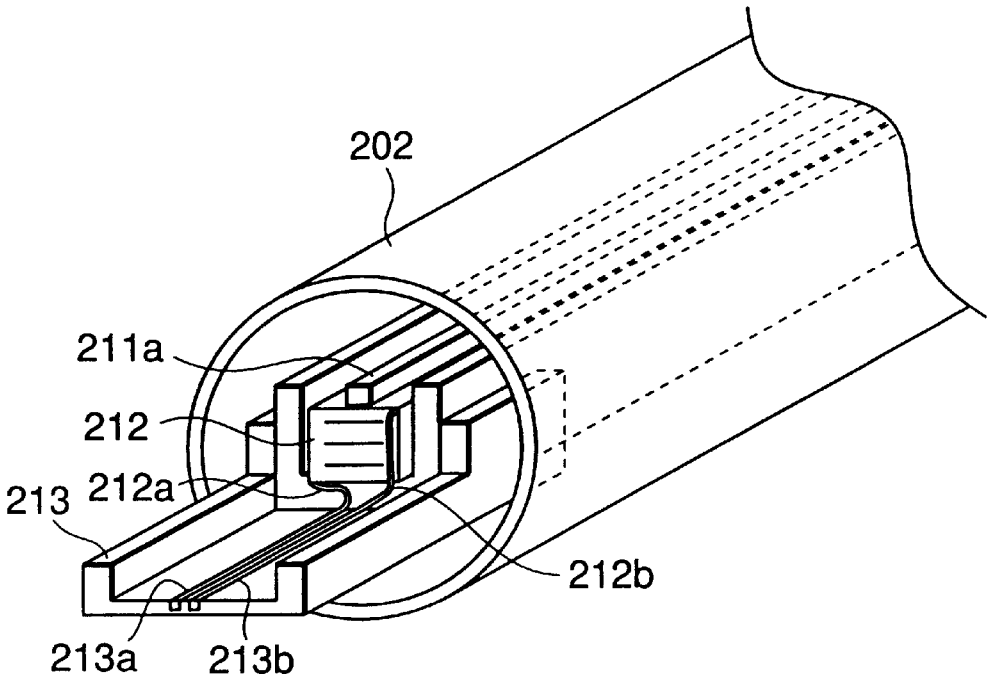
FIG. 40 is a perspective view showing an induction hearing unit and a heating roller in a fixing device in a twenty-fifth embodiment of the present invention.
Figure 41:
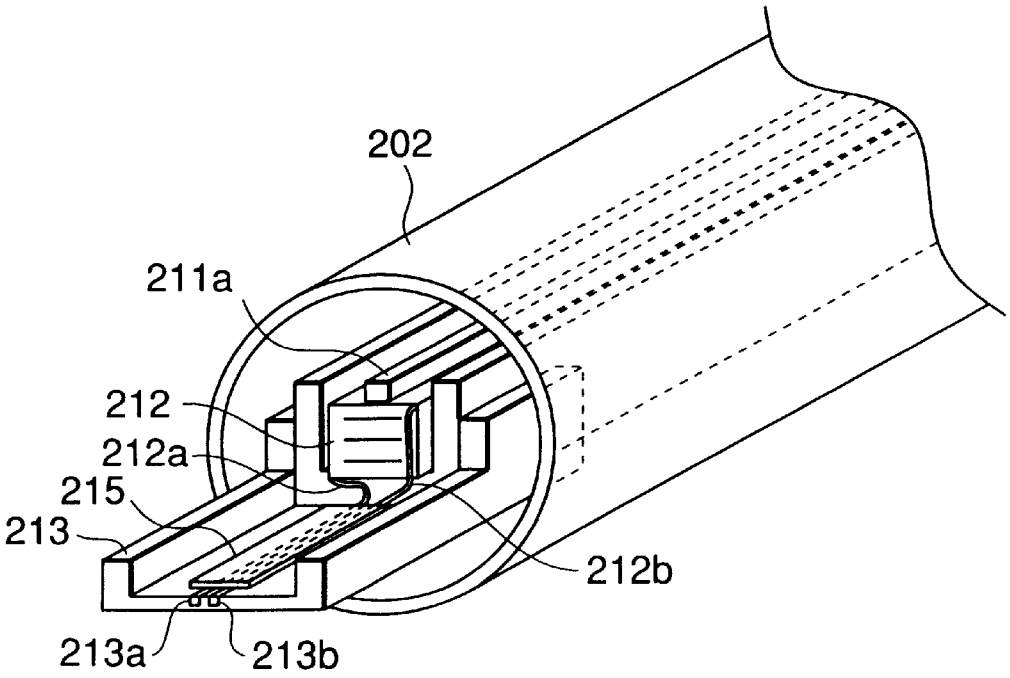
FIG. 41 is a perspective view showing a deformed example of the induction heating unit shown in FIG. 40.

Next, referring to FIG. 40 and FIG. 41, a twenty-fifth embodiment of the present invention is described.

As shown in FIG. 40, at one of the support members mounted to both ends of the core 211, wiring accommodation grooves 213*a* and 213*b* are formed as protective means to protect wires (so-called leader wires) 212*a* and 212*b* that are lead out of the excitation coil 212 of the induction heating unit 210 from contacting the heating roller 202. Further, the support members 213 are made of non-magnetic material.

The wires 212*a* and 212*b* are accommodated in the wiring accommodation grooves 213*a* and 213*b* and then, are connected to an induction driving circuit (not shown). This construction prevent a problem that the wires 212*a* and 212*b* contact the inner surface of the heating roller 202 and the improper contact, wear, current leakage, etc. can be avoided.

Further, as the support member is made of non magnetic material, such a problem that eddy current is generated and heat is generated.

If noise is generated by the effect of high frequency current lowing through the wires 212*a* and 212*b*, it is advised to cover the wiring accommodation grooves 213*a* and 213*b* with a cover 215. Noise can be sealed by this cover. In this embodiment, a ferrite sheet material was used for the cover 215 to shield the magnetic field.

Further, the effect of noise can be protected when a connector is provided at the end of the support member 213 and the excitation coil 212 is connected directly to a induction heating circuit by this connector. In this twenty-fifth embodiment, the wires 212*a* and 212*b* are connected to one of the support members 213 but each one wire may be pulled out to the both ends of the support member 213.

Other constructions and effects are the same as the twenty-first embodiment.

Figure 42:
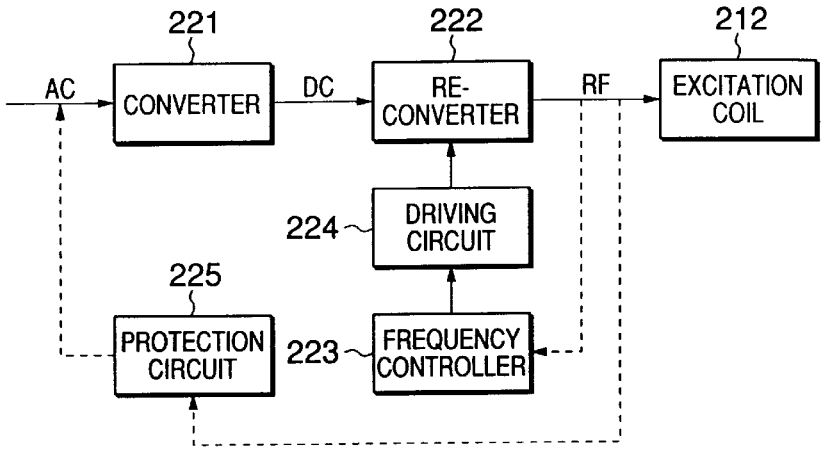
FIG. 42 is a block diagram showing an induction heating unit driving circuit in a fixing device in a twenty-sixth embodiment of the present invention.
Figure 43:
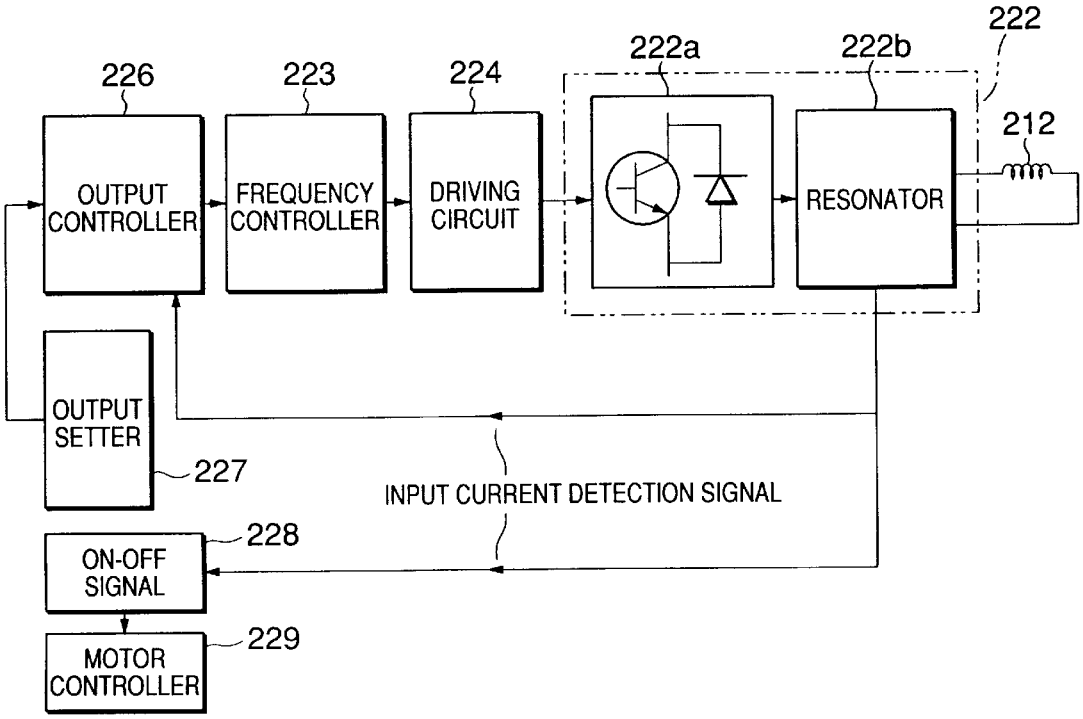
FIG. 43 is a block diagram of the driving circuit shown in FIG. 42 combined with a pressure roller control circuit.

Next, referring to FIG. 42 and FIG. 43, a twenty-sixth embodiment of the present invention is described.

A driving circuit shown in FIG. 42 is provided for driving the induction heating unit 210. That is, 50/60 Hz AC supply voltage is converted into DC voltage by a converter 221 and then, converted into high frequency power by a re-converter 222. High frequency to be re-converted is decided by a frequency controller 223 and a corresponding driving signal (pulse signal) is supplied to the gate of a switching element in the re-converter 222 from a driving circuit 224. A reference numeral 225 shows a protect circuit for preventing abnormal heating.

A circuit shown in FIG. 43 is this driving circuit combined with a pressure roller controller. That is, the re-converter comprises a switching circuit 222*a* and a resonator 222*b*. The switching circuit 222*a* uses IGBT (Insulation Gate Bipolar Transistor) and flywheel diode.

Input current to the resonator 222*b* is detected and its detecting signal (an input current detecting signal) is fed back to an output controller 226. The output controller 226 controls the frequency controller 223 by comparing this feedback signal with an output set signal from an output setter 227.

Further, the input of induction current to the excitation coil 12 is detected by the above input current detecting signal and a fixing device driving motor ON-OFF signal 228 corresponding to he detection result is supplied to a motor controller 229. This motor controller 228 drives the heating roller 202 when the input of induction current is detected and the fixing device driving motor ON-OFF signal is ON. That is, when the excitation coil 212 is in the state able to heat as current is flowing to it, the heating roller 201 always rotates. As a result, the entire heating roller 202 is uniformly heated and it becomes possible to maintain the surface temperature of the roller at a fixed level. Thus, such a problem that the heating roller 202 is locally heated abnormally when magnetic flux is generating on the excitation coil 212 is not generated.

Figure 44:
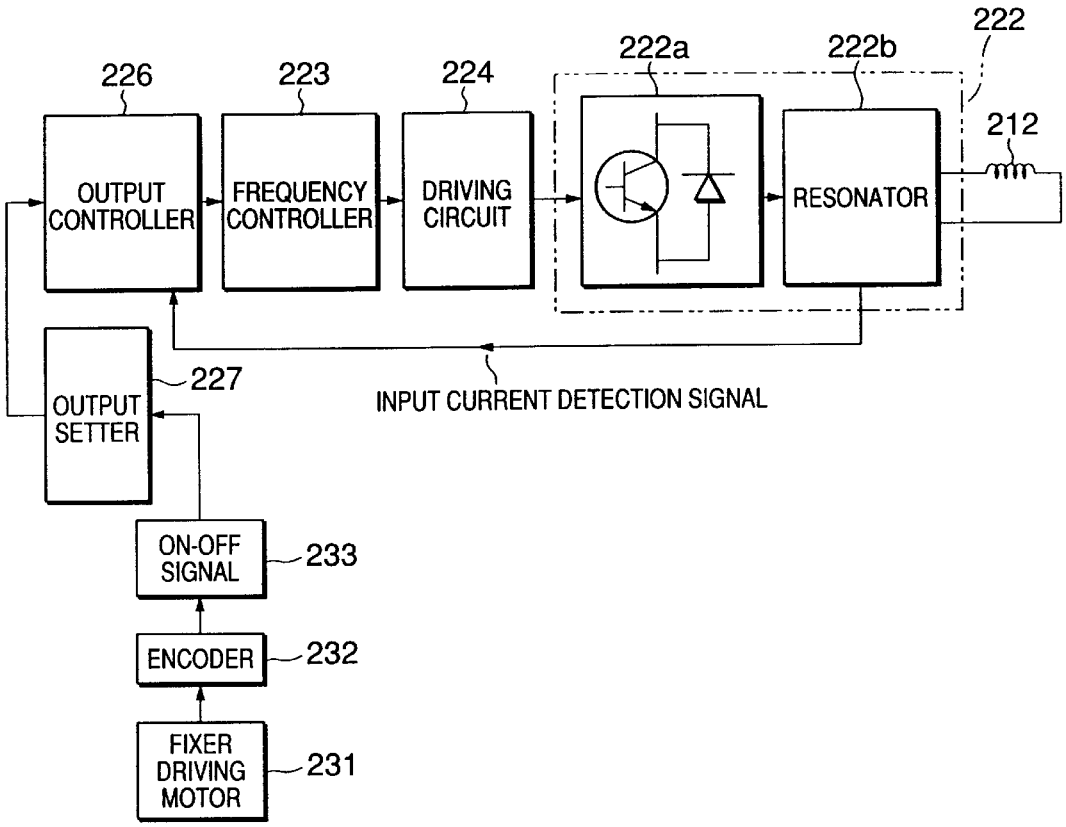
FIG. 44 is a block diagram an induction heating unit control circuit in the fixing device in the twenty-seventh embodiment of the present invention combined with other control circuits.

Next, referring to FIG. 44, a twenty-seventh embodiment of the present invention is described.

In FIG. 44, the reference numeral 231 indicates a fixing device driving motor 231 for driving the heating roller 202. The operating state of this fixing device driving motor 231 is detected by an encoder 232 and its detection signal is fed back to the output setter 227 as a fixing device driving motor ON-OFF signal 233

Accordingly, if the heating roller 202 is stopped to rotate by jamming or another cause, it is detected via the encoder 232 and the operation of the induction heating unit 210 is stopped. As the rotation of the fixing device driving motor 231 is detected directly by the encoder 232, it is possible to cope with any hardware trouble of the fixing device driving motor 231.

As a result, there will no longer occur such a trouble that the heating roller 202 is locally heated abnormally when the heating roller 202 is stopped to rotate. The induction heating unit 210 operates only when the heating roller 202 is rotating according to this embodiment.

Further, regarding the control to stop the induction heating unit 210 to operate when the heating roller 202 is not rotating, the control modes may be made selectable by operator in this embodiment.

Further, if a control is adopted to reduce operating current of the induction heating unit 210, that is, current flowing to the excitation coil 212 lower than the ordinary level when the heating roller 202 is not rotating, the overall surface of the heating roller 202 can be heated when the heating roller 202 continue to rotate in the case of a type wherein the heating is concentrated to the contacting point in the induction heating unit 210.

When the heating roller 202 is kept stopped, although if a current value equivalent to that at the time when it is driven is allowed to flow to the excitation coil 212, the heating roller 202 is locally heated abnormally, when smaller current than that at the ordinary time is allowed to flow, the heating roller 202 is not locally heated abnormally and heat moves gradually toward the outer surface of the heating roller 202 by the heat conduction of the heating roller 202. A current value smaller than the ordinary level is decided by finding a condition that the heat balance is maintained by radiation heat to the air when the heating roller 202 reaches a certain temperature and the temperature does not rise above that level.

Figure 45:
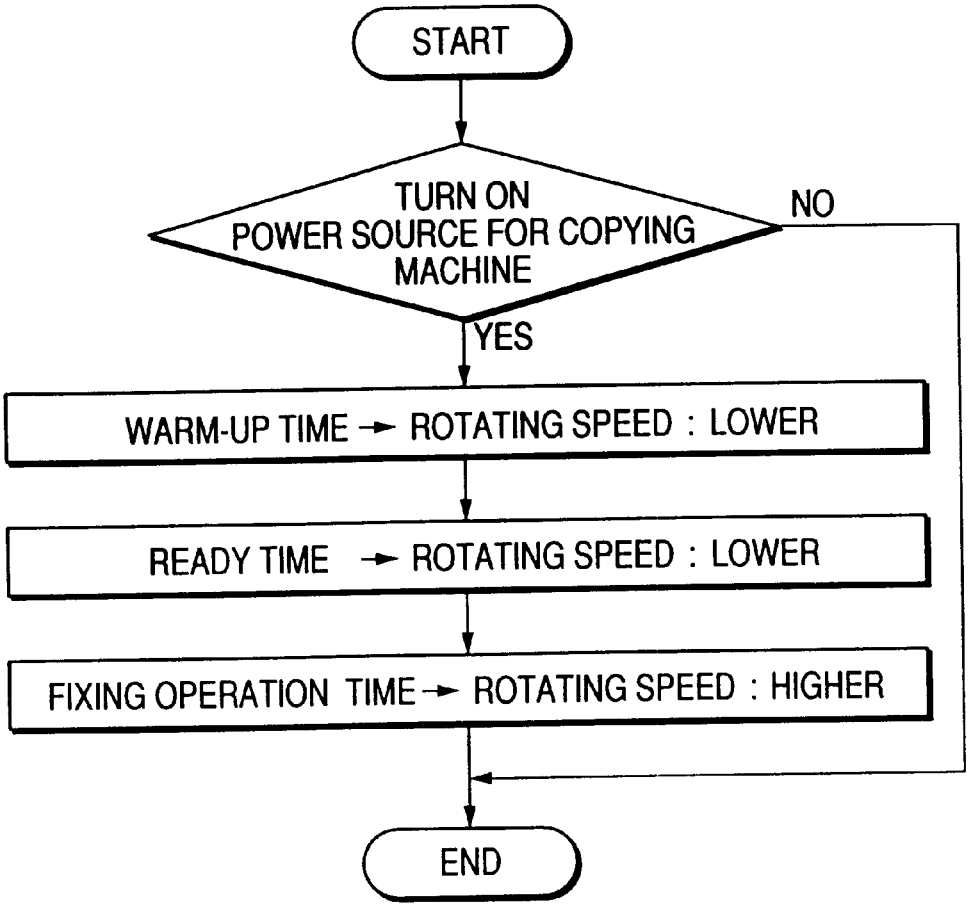
FIG. 45 is a flowchart for explaining the operations of the fixing device in the twenty-eighth embodiment of the present invention.

Next, referring to FIG. 45, a twenty-eighth embodiment of the present invention is described.

The output controller 226 shown in FIG. 43 or 44 has the control means shown below.

A control means to rotate the heating roller 202 at the time of warm-up and standby for the fixing operation similarly when executing the fixing operation and differentiate its rotating speed at the time of warm-up and standby for the fixing operation from that when executing the fixing operation. Definitely, the rotating speed of the heating roller 202 at the time of warm-up and standby for the fixing operation is made slower than that when executing the fixing operation.

At the time of warm-up (starting the apparatus) and standby for the fixing operation (ready), it is necessary to make the surface temperature of the heating roller 202 uniform by rotating the roller. At the time of warm-up, the heating roller 202 is heated by the induction heating unit 210 until the surface temperature of the roller reaches a control target temperature. Further, at the time of ready, the induction heating unit 210 is so controlled as to maintain the control target temperature.

That is, as shown in FIG. 45, at the time of the warm-up and ready, the heating roller 202 is set at a rotating speed lower than that when executing the fixing operation (the copying operation). For instance, it is reduced to the ⅓ speed.

At the time of standby and warm-up, the heating roller 202 can be set at any rotating speed as being not affected by other processes. So, when the rotating speed is made sharply lower than that at the time of standby and warm-up, the local and abnormal heating of the heating roller 202 at the time of warm-up and standby can be prevented and uneven temperatures are not produced on the entire heating roller 202. Furthermore, at the time of warm-up and standby, the sound (noise) generated by the rotation can be suppressed to a lower and calm level than the operating sound at the time when executing the fixing operation and thus, a noise problem can be solved. Further, for the time when the rotating speed is kept lowered, the life of the heating roller 202 is extended.

Figure 46:
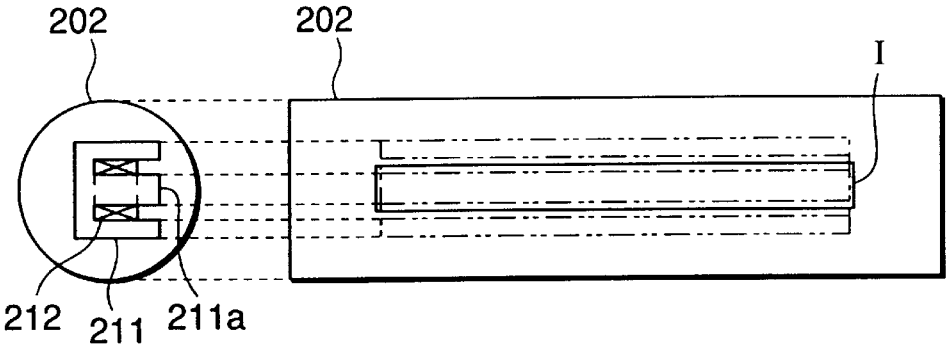
FIG. 46 is a schematic diagram showing the correspondence between an induction hearing unit and a heating roller and the eddy current loop in the fixing device in the twenty-ninth embodiment of the present invention.

Next, referring to FIG. 46, a twenty-ninth embodiment of the present invention is described.

As shown in FIG. 46, the induction heating unit 210 is arranged in the state it is sufficiently accommodated in the heating roller 202.

Eddy current I generated in the heating roller 202 by the magnetic field produced from the E-shaped core 211 flows through a route along the shape of the core 211 in the state where the induction heating unit 210 is accommodated in the inside from both-ends of the heating roller 202. Accordingly, the route of eddy current can be controlled so as to draw a closed loop of a fixed width in the direction orthogonal to the rotating direction of the heating roller 202 and it is easy to solve the uneven temperature in the rotating direction of the heating roller 202.

Figure 47:
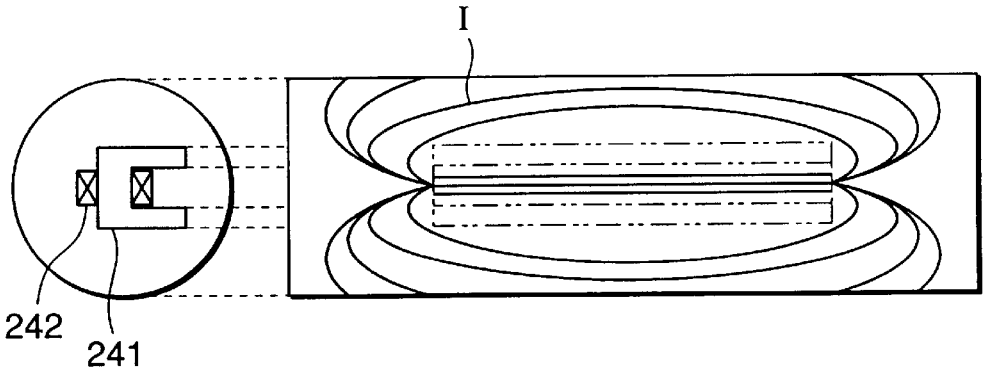
FIG.47 PRIOR ART
FIG. 47 is a schematic diagram showing the correspondence between an induction heating unit and a heating roller and an eddy current loop in a conventional fixing device that is comparable with the fixing device of the present invention shown in FIG. 46.

On the contrary, when, for instance, an induction heating unit having an excitation coil 242 wound round a C-shaped core 241 is adopted, the route of the eddy current I produced on the heating roller 202 becomes a loop extending on the overall surface of the heating roller 202 exceeding the above fixed width as shown in FIG. 47 and it becomes difficult to solve the uneven temperature in the rotating direction of the heating roller 202.

Figure 48:
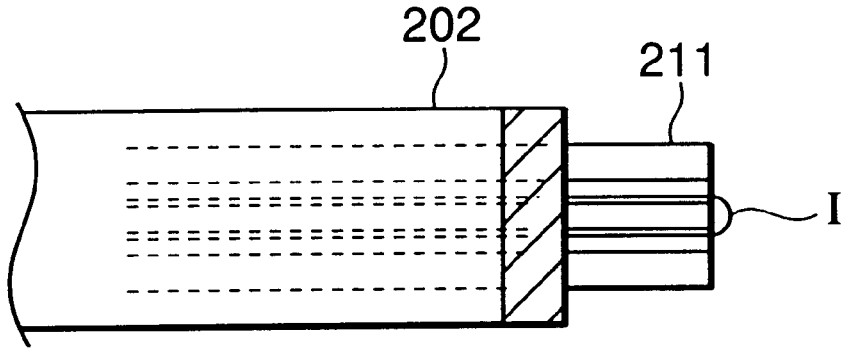
FIG. 48 is a schematic diagram showing a first example, where the correspondence between an induction heating unit and a heating roller and an eddy current loop in the fixing device in the twenty-ninth embodiment of the present invention were checked by experiments.

Further, according to an experiment, if the core 211 is projecting from the end of the heating roller 202 as shown in FIG. 48, the density of eddy current I produced at the end (the oblique lined portion in the figure) of the heating roller 202 becomes large and the heat value generated there increases. If so, the temperature at the end of the heating roller 202 becomes not controllable and uneven temperature is produced.

Figure 49:
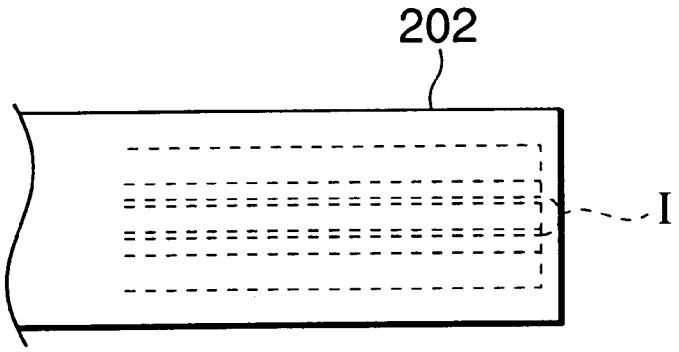
FIG. 49 is a schematic diagram showing a second example, where the correspondence between an induction heating unit and a heating roller and an eddy current loop in the fixing device in the twenty-ninth embodiment of the present invention were checked by experiments.
Figure 50:
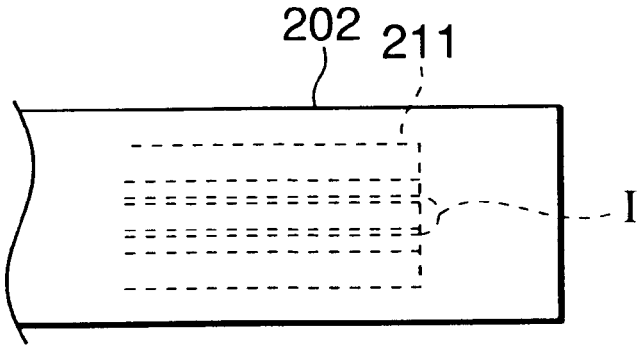
FIG. 50 is a schematic diagram showing a third example, where the correspondence between an induction heating unit and a heating roller and an eddy current loop in the fixing device in the twenty-ninth embodiment of the present invention, where the correspondence between the induction heating unit and the heating roller and the eddy current loop invention loop were checked by experiments.
Figure 51:
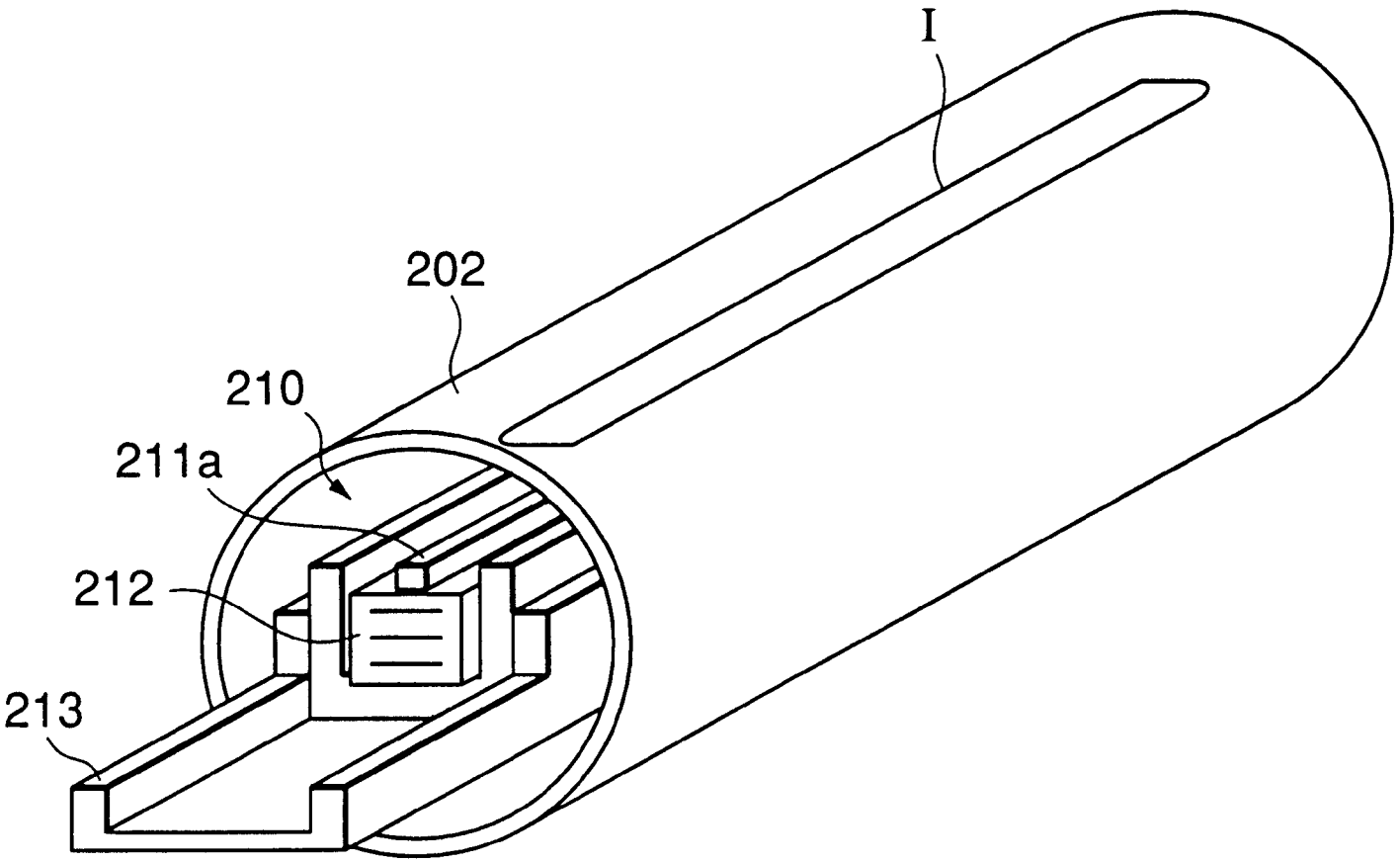
FIG. 51 is a perspective view showing a fourth example, where the correspondence between an induction heating unit and a heating roller and an eddy current loop in the fixing device in the twenty-ninth embodiment of the present invention were checked by experiments.

When the core 211 is sufficiently accommodated at the end of the heating roller 202, as shown in FIGS. 49, 50 and 51, the eddy current is not concentrated to the end in the rotating direction of the heating roller 202, the density of the eddy current I becomes the same at any position, no temperature difference is produced between the center and end of the heating roller 202 in the rotating axial direction and the temperature distribution in the heating roller 202 becomes uniform.

Next, referring to FIG. 52 through FIG. 55, a thirtieth embodiment of the present invention is described.

Figure 52A:
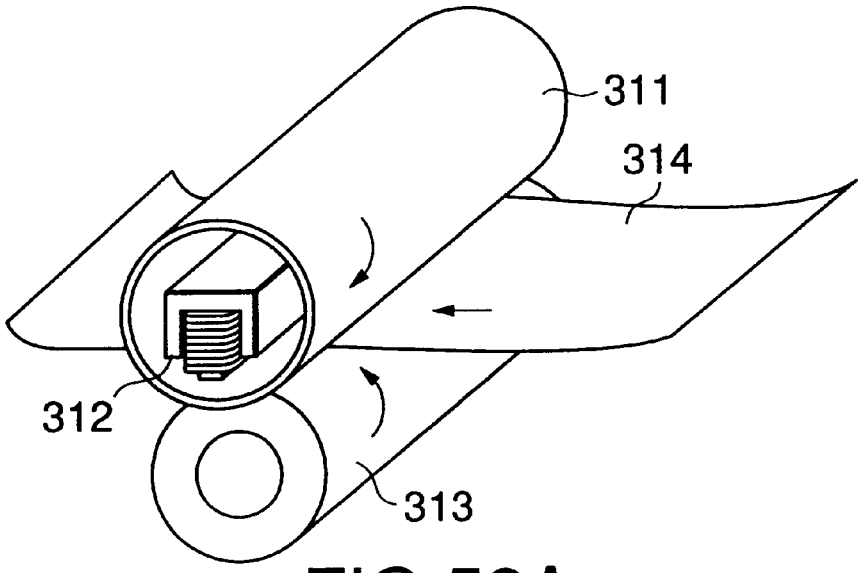
FIG. 52A is a perspective view showing a fixing device in a thirtieth embodiment of the present invention.

In FIG. 52A, a conducive roller 311 is rotating in the arrow direction as shown by a driving transfer mechanism (not shown) provided at the end in the axial direction. An induction heating unit 312 arranged in the conductive roller 311 generated an AC magnetic field by a high frequency circuit (not shown). Eddy current and the Joule heat are generated in the conductive roller 311 by this AC magnetic field and the conductive roller 311 is heated by this Joule heat.

A driven roller 313 is pressed against the conductive roller 311. This driven roller 313 is able to rotate and following the conductive roller 311, rotates in the arrow direction. A non-fixed medium 314 passes through the nip between these conductive roller 311 and the driven roller 313 and an image is fixed on the non-fixed medium 314 by the Joule heat.

In this thirtieth embodiment, the conductive roller 311 is made of iron of 30 mm in diameter and 0.6 mm thick and equipped with an excitation coil as an induction heating unit and a core element to effectively control the magnetic flux generated by this coil in the inside A non-fixed medium is a paper and a toner image formed by the electro-photographic process is formed on its surface.

A litz wire comprising 4 copper wires in 0.5 mm diameter wound by 12 turns is used as the excitation coil. Ferrite is used as the core element and magnetic flux is generated from the core element. The smaller a ferrite element is in size, the highly accurate is in its shape and cheaper in cost. At present, products of 150–200 mm in size are available for the general use. However, as the length of the conductive roller 311 is normally about 300 mm, it is required to connect more than 2 core elements for the fixing device of this present invention.

A core element is generally molded using a mold. When molding a core element, a draft is needed at the end of a core element. That is, the end of a core element needs a draft at an angle below 5 degree on the surface vertical against the surface of a fixing medium. When more than two core elements are connected, a space is normally produced at the connecting portion by such the draft and it is therefore considered to accommodate a core in a case in order to prevent it but the volume of a heavy case becomes a large problem for a fixing device comprising a roller or a belt in a small diameter.

Figure 52B:
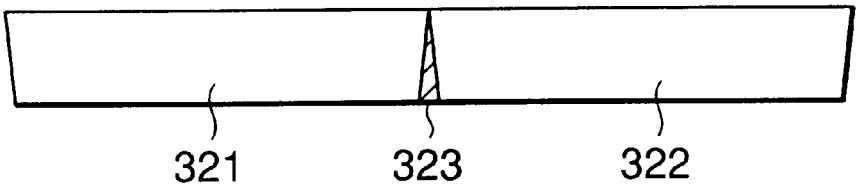
FIG. 52B is a perspective view showing a first example of a core element in the fixing device shown in FIG. 52A.
Figure 52C:
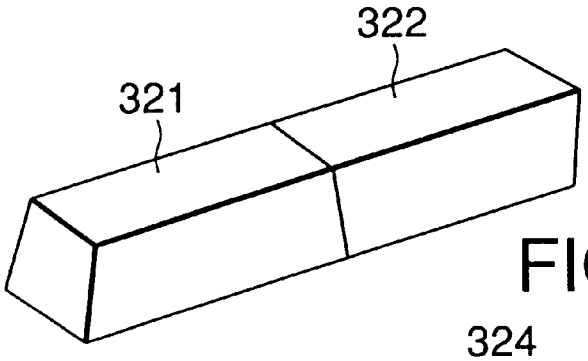
FIG. 52C is a perspective view showing a second example of a core element in the fixing device shown in FIG. 5A.
Figure 52D:
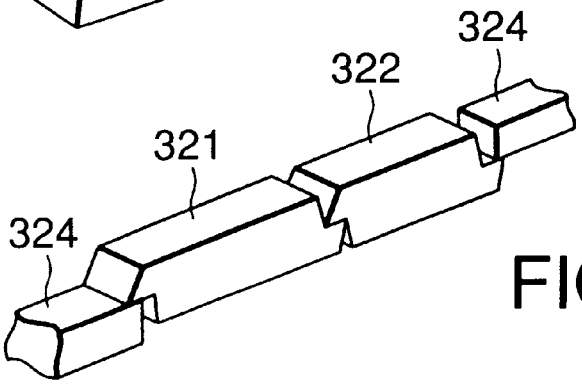
FIG. 52D is a third example of a core element in the fixing device shown in FIG. 52A.

Accordingly, in this thirtieth embodiment, more than two core elements 321 and 322 are connected by bonding with an adhesive 323 and the gap with the roller is supported at both ends as shown in FIG. 52B. Further, when two core elements 321 and 322 are made in symmetrical shape in order to increase bonding accuracy, it is also possible to construct a fixing device so as to offset an angle of a draft. Further, as shown in FIG. 52D, it is also possible to construct the connecting surface between two core elements 321 and 322 in plural surfaces for positioning at the time of connection. Further, the reference numeral 324 in FIG. 52D indicates a support element.

This effect is also effective for other shapes than those of core elements shown in this embodiment. Further, it is also possible to construct core elements with other materials and change heating portions and characteristics.

When an excitation member comprising a coil and core is inserted in a conductive roller in a small diameter, it is necessary to make the downsizing of a fixing device to the extent possible and control effect of radiation heat from the conductive roller, a gap with the conductive roller, etc. and it becomes necessary to support a fixing device by both ends only to meet these purposes.

As shown in FIG. 53 and FIG. 54, a fixing device in this embodiment is in such a structure that a vertical surface in the axial direction of the roller and a vertical or angled surface are arranged on the end of one core element and it is able to make the positioning for connection only by combining both ends of two core elements 331, 332, 341 and 342. FIG. 53B and FIG. 54B show the shapes of the ends of the core elements 331, 332, 341 and 342, respectively.

The shapes of these core elements 331, 332, 341 and 342 may be applied to the core support members 333 and 343 at the ends so as to clamp the core elements by these support members from both ends. Further, for improving accuracy of positions or when gaps are produced in a mold, the elements and core support members may be made to one united body by fixing the joints using a heat resisting bonding agent.

Figure 55:
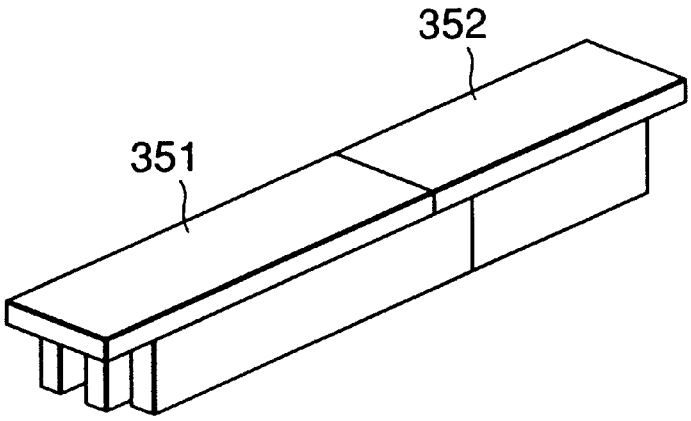
FIG. 55 is a perspective view showing a fifth example of core elements in the fixing device shown in FIG. 52A.

Core elements in complicated sectional shapes may not be achieved by a monolithic construction. Therefore, the core elements 351 and 352 are composed by combining ferrite plates as shown in FIG. 55. In this case, a gap may be provided to the core elements 351 and 352 and for heat insulation, and they can be held by support members and further, they may be made in a monolithic construction by bonding using a bonding agent.

Figure 56A:
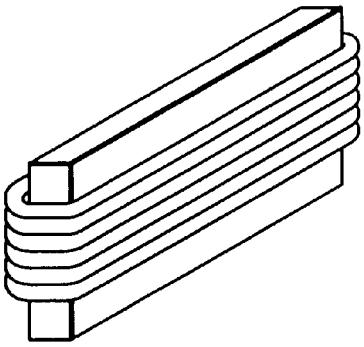
FIG. 56A through FIG. 56C are perspective views showing core elements in the fixing device in a thirty-first embodiment of the present invention, respectively.
Figure 56B:
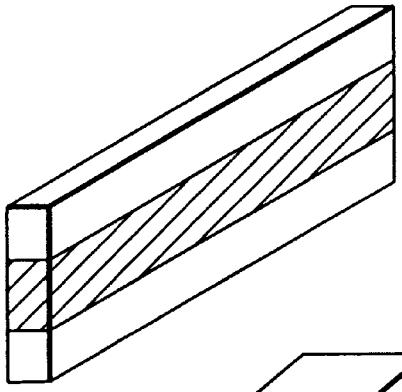
Figure 56C:
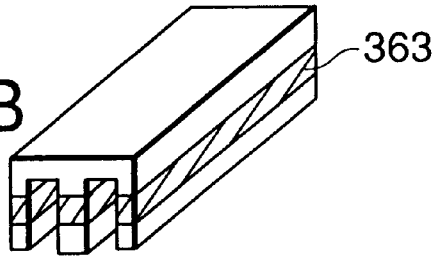

Next, referring to FIG. 56A through FIG. 56C, a thirty-first embodiment of the present invention is described.

Ferrite is expensive and also heavy and therefore, ferrite elements can be partially omitted among ferrite elements. That is, as magnetic flux can be controlled according to a coil and permeability of ferrite before and after the coil, it is possible to give the same effect as that when the entire core elements are composed of ferrite.

However, in order to accommodate an excitation coil in a roller in small diameter, I is necessary to incorporate core elements in a united body and support it at both ends. Therefore, it becomes necessary to arrange a member 363 made of a light heat resisting resin at this omitted portion and bond it to a united body as shown in FIG. 56. Further, FIG. 56A is a diagram showing a core element with a coil wound round in this thirty-first embodiment, and FIG. 56B and FIG. 56C are diagrams showing the state of ferrite elements partially replaced by the resin material 36.

Figure 57:
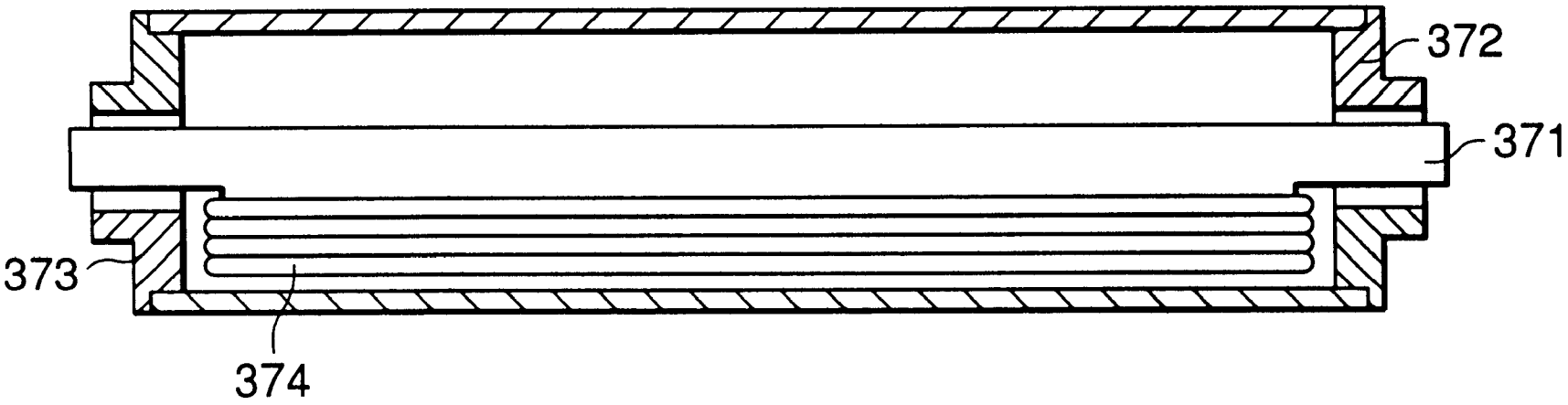
FIG. 57 is a sectional view showing a heating roller and a core element in the fixing device in a thirty-second embodiment of the present invention.

Next, referring to FIG. 57, a thirty-second embodiment of the present invention is described.

In the heat source of the fixing device of the present invention, the position control of the core end portion including a coil and the roller largely affects the generation of eddy current. Further, when compared with a conventional halogen lamp, the excitation coil including a core has a large volume and requires a large opening when inserting it into the roller. Therefore, it is not possible to mount this heat source by the integral processing of the flange portion that was so far performed in the conventional method and the heat source must be in such the structure that at least the flange portion at one side is removable.

So, in this thirty-second embodiment, the fixing device is made in such the structure that flanges 372 and 373 at both sides for supporting a core element 371 are made of heating resisting resin, separately and after inserting a coil portion 374, these flanges 372 and 373 are mounted to a frame (not shown) in the detachable state for maintenance. In this thirty-second embodiment, the flanges 372 and 373 are press fitted to the frame so that the maintenance works can be performed at normal temperature but even when they are mounted using screws, the same effect can be obtained.

Further, even when the flange portions are made of metal, the same effect is also obtained. In addition, it is also possible to provide a separation layer to he roller surface.

Figure 58A:
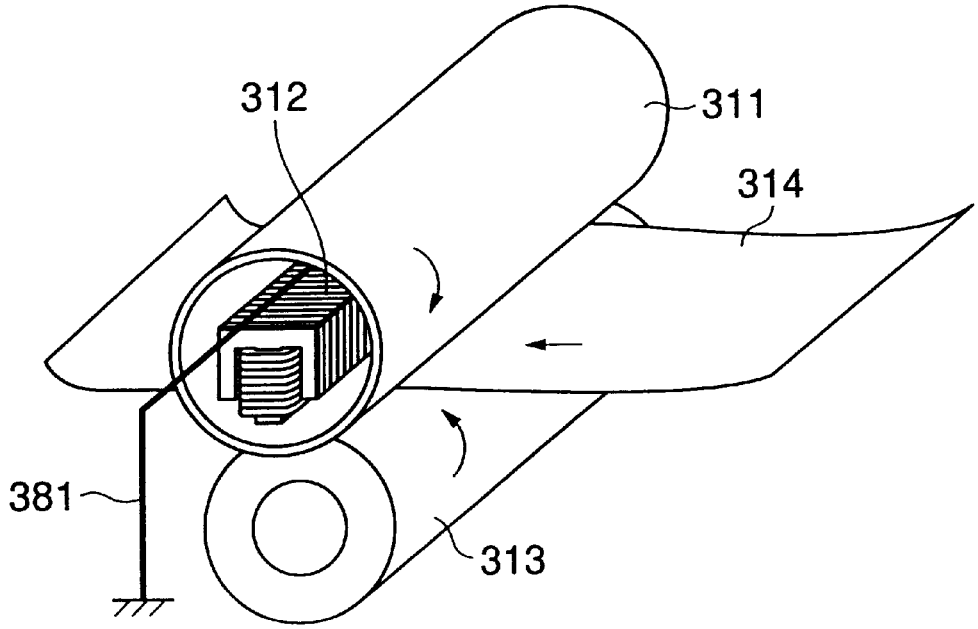
FIG. 58A and FIG. 58B are perspective views showing a fixing device in a thirty-third embodiment of the present invention, respectively.
Figure 58B:
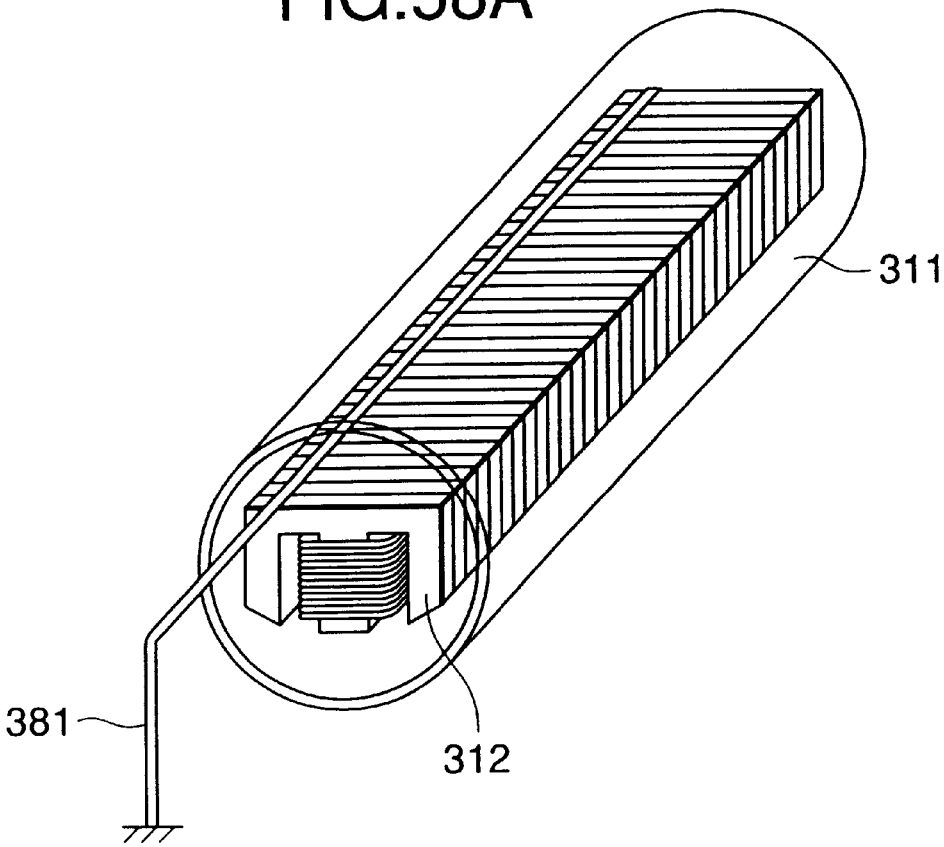

FIG. 58A and FIG. 58B are diagrams showing a thirty-third embodiment of the present invention. Excepting that an induction heating unit 312 is grounded by an aluminum wire 381 that is a non-magnetic conductor this fixing device is in the same structure as the fixing device shown in FIG. 52A.

Generally, materials available for composing core element are ranging from conductive materials such as silicon steel plate, amorphous to strongly insulating materials such as ferrite, etc. In this embodiment, amorphous materials are used by laminating them as generally used. When a fixing device using such core elements is used, current may possibly leak from a coil to a roller. In general, the roller surface is covered by Teflon and other resins, rubber, etc. However, these surface may be shaved or partially peeled off and prudent measures become necessary against this leak current.

So, in this thirty-third embodiment, the aluminum wire 381 that is a non-magnetic conductor is used for grounding so as to prevent generation of eddy current at frequency that is used. Thus, it becomes possible to block the current leakage to the surface of the roller 311 and provide a safe fixing device.

Figure 59A:
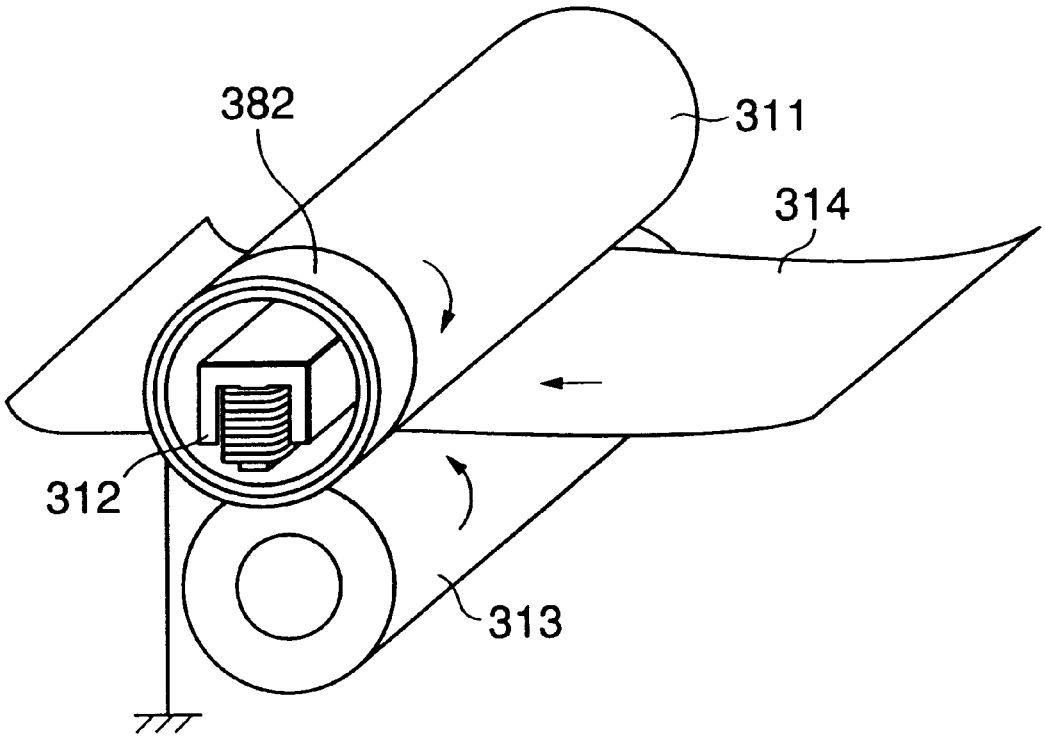
FIG. 59A and FIG. 59B are perspective views showing a fixing device in a thirty-fourth embodiment of the present invention, respectively.
Figure 59B:
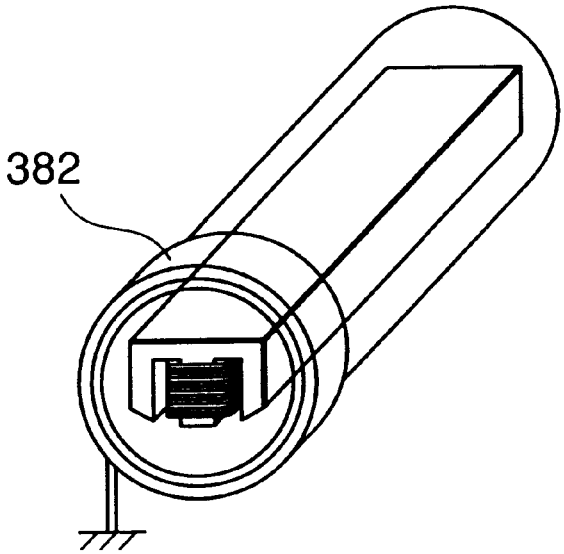

FIG. 59A and FIG. 59B are diagrams showing a thirty-fourth embodiment of the present invention. This fixing device is in the same structure as the fixing device shown in FIG. 52 excepting that a slip ring 382 is provided at the end of the roller 311 for grounding.

As a member to ground via the slip ring 382, it is possible to use publicly known brushes, etc. to feed power to rotating products. Thus, it becomes possible to block the current leakage and provide a safe fixing device.

Figure 60A:
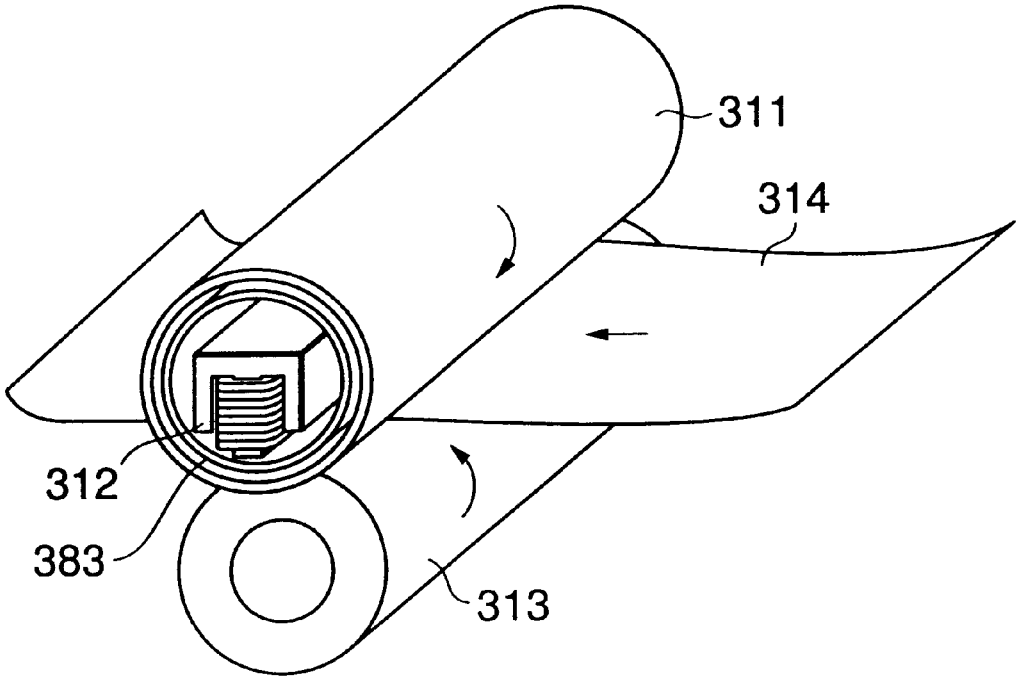
FIG. 60A and FIG. 60B are perspective views showing a fixing device in a thirty-fifth embodiment of the present invention, respectively.
Figure 60B:
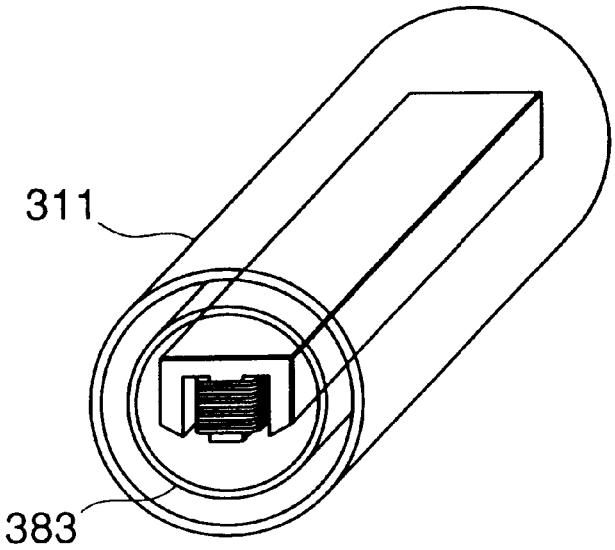

FIG. 60A and FIG. 60B are diagrams showing a thirty-fifth embodiment of the present invention. This fixing device is in the same structure as the fixing device shown in FIG. 52A excepting that a heat resisting and insulating sheet 383 is provided between the roller 311 and the induction heating unit 312 for insulation.

In this thirty-fifth embodiment, polyimide is used as a material for the sheet 383 but it is needless to say that similar effect is obtained when insulating materials are used. In particular, in this embodiment, attaching great importance to safety, the sheet 383 is made double. This sheet 383 is in the cylindrical shape and its both ends are fixed separately from the induction heating unit 312.

Thus, it becomes possible to block the current leakage and provide a safe fixing device.

Figure 61A:
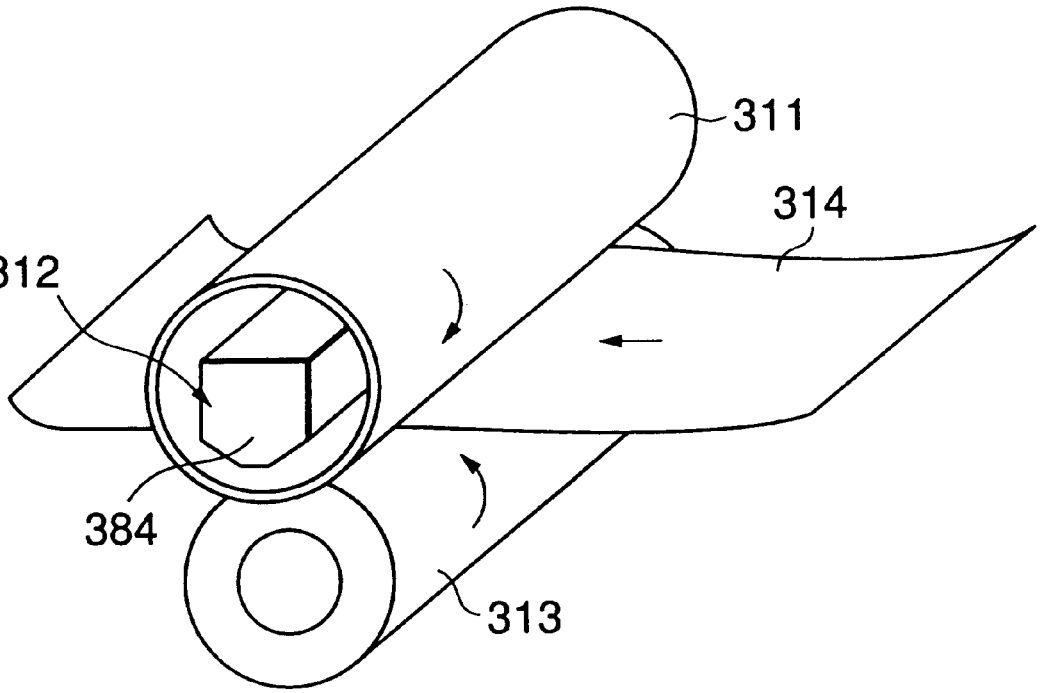
FIG. 61A and FIG. 61B are perspective views showing a fixing device in a thirty-sixth embodiment of the present invention, respectively.
Figure 61B:
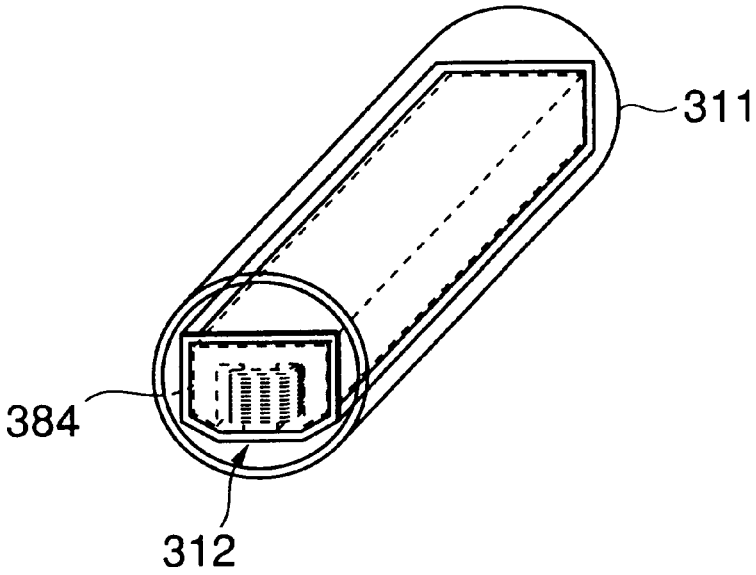

FIG. 61A and FIG. 61B are diagrams showing a thirty-sixth embodiment of the present invention This fixing device is in the same structure as the fixing device shown in FIG. 52A excepting that the induction heating unit 312 is covered by a heat resisting and insulating sheet 384 for insulation.

In this thirty-sixth embodiment, polyimide is used as a material for the heat resisting and insulating sheet 384 but similar effect is obtained when heat resisting and insulating materials are used. In particular, in this embodiment, attaching great importance to safety, the sheet 384 is made double. The sheet 384 in thickness more than 0.4 mm per sheet is desirable.

This sheet is basically not in contact with the rotating conductive roller 311 but thus, it becomes possible to block the current leakage and provide a safe fixing device.

Figure 62A:
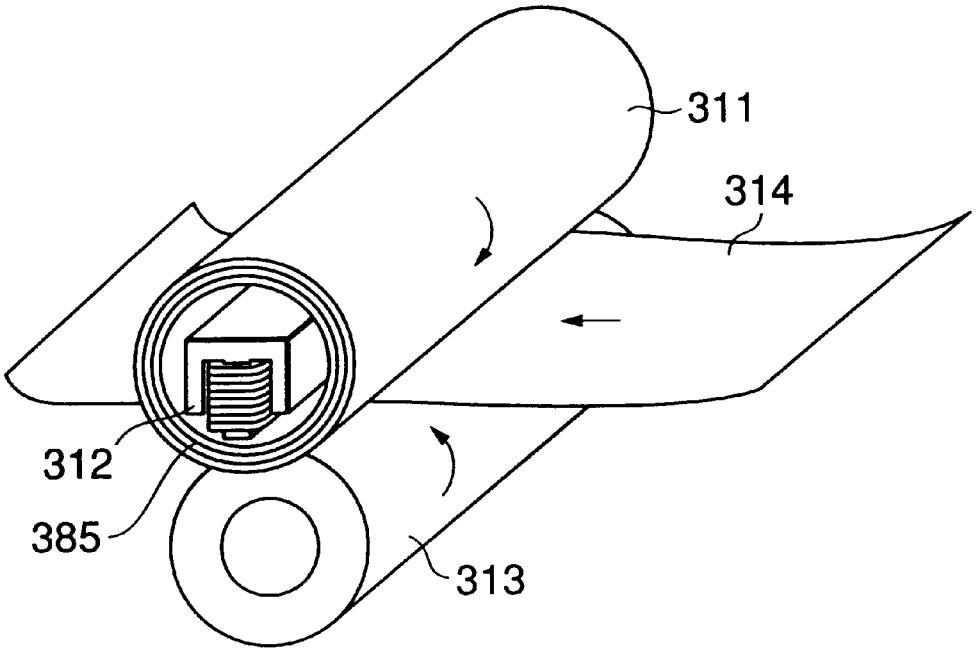
FIG. 62A and FIG. 62B are perspective views showing a fixing device in a thirty-seventh embodiment of the present invention, respectively.
Figure 62B:
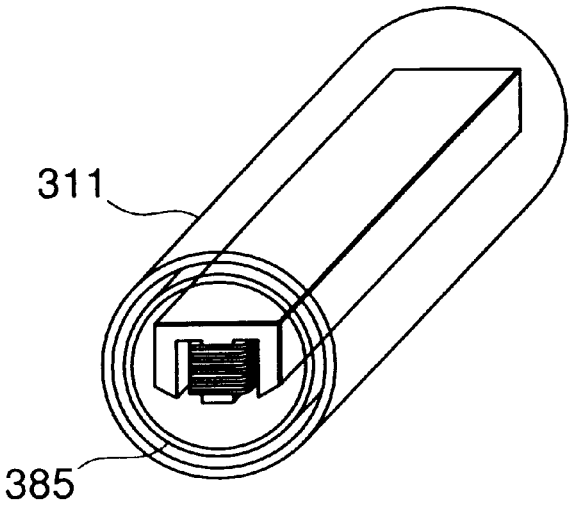

FIG. 62A and FIG. 62B are diagrams showing a thirty-seventh embodiment of the present invention. This fixing device is in the same structure as the fixing device shown in FIG. 52A excepting that a polyimide layer 385 is arranged in the inside of the conductive roller 311.

The layer arranged in the inside of the conductive roller 311 is not limited to the polyimide layer but the same effect is obtained when it is any insulating material. In particular, attaching importance to safety, the layer is made double. The induction heating unit 312 is basically not in contact with the rotating conductive roller 311 but the polyimide layer 385 provided enables it to block the current leakage and provide a safe fixing device.

Figure 63A:
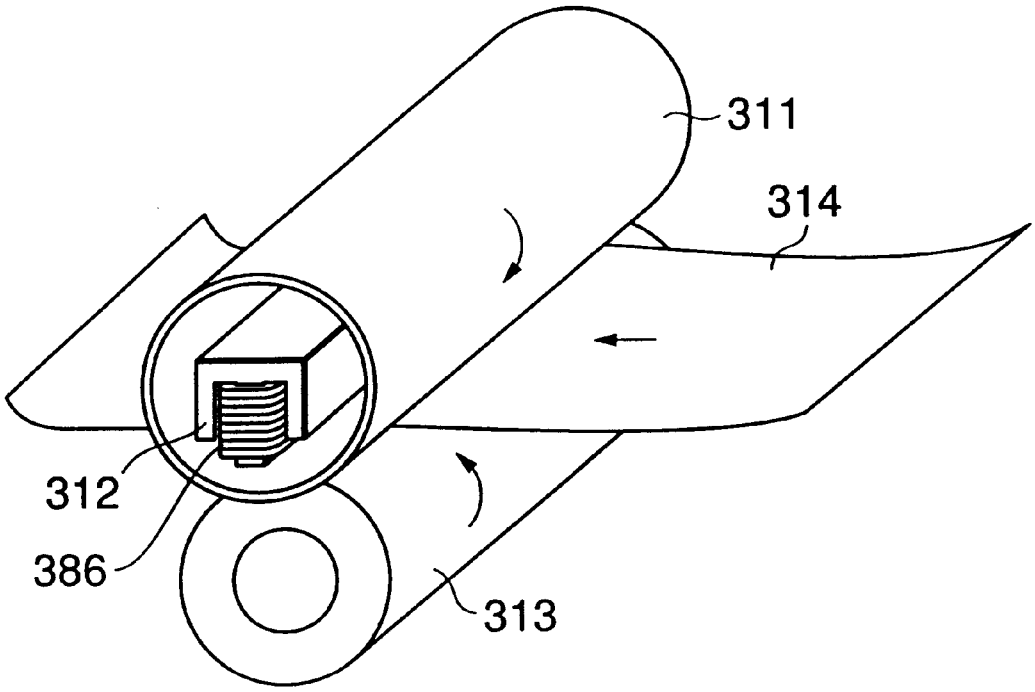
FIG. 63A and FIG. 63B are perspective views showing a fixing device in a thirty-eighth embodiment of the present invention, respectively.
Figure 63B:
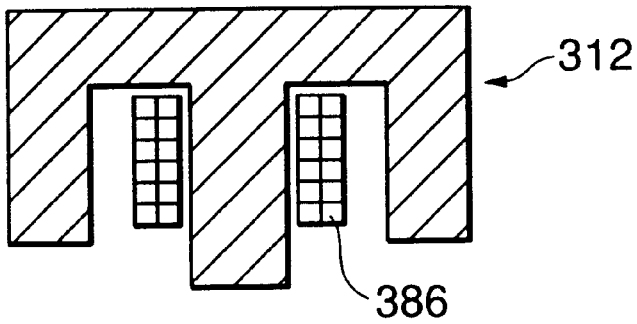

FIG. 63A and FIG. 63B are diagrams showing a thirty-eighth embodiment of the present invention. This fixing device is in the same structure as the fixing device shown in FIG. 52A excepting an 1.5 mm square shaped wire are wound round a coil 386 by 12 turns.

That is, when a coil and a core element are installed in a roller in small diameter, it is difficult to make a core elements for density of saturation magnetic flux, etc. and the coil winding becomes a point in the downsizing. Conductors in round cross section were used so far and whenever spaces were produced between wires and it was difficult to increase the coil density.

On the contrary, as a square-shaped wire is used for the coil 386 in this thirty-eighth embodiment, it becomes possible to make a coil and a core element small. Further, use of this square-shaped wire as Litz wire is also effective. Thus, it becomes possible to provide space between a roller and coil and core elements and a large effect can be expected for the insulating measures and temperature rise of a coil and a core element.

Figure 64A:
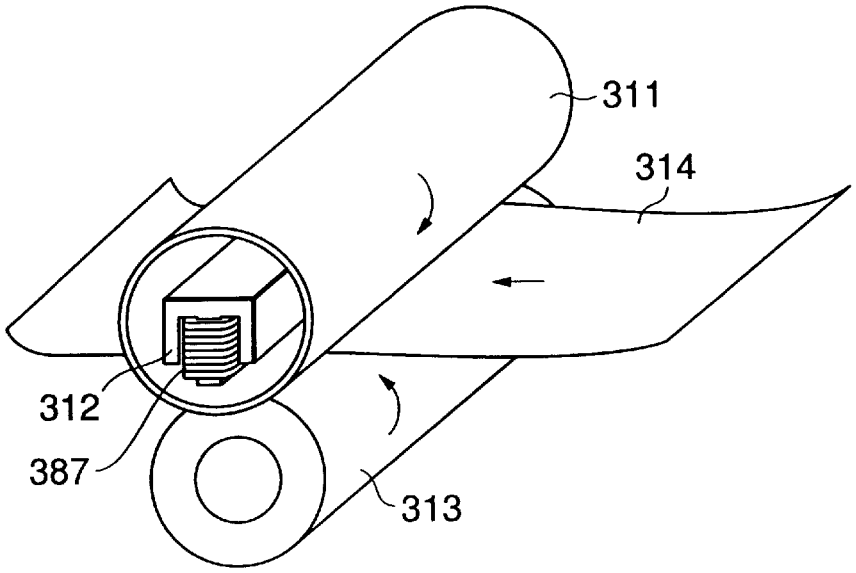
FIG. 64A and FIG. 64B are perspective views showing a fixing device in a thirty-ninth embodiment of the present invention, respectively.
Figure 64B:
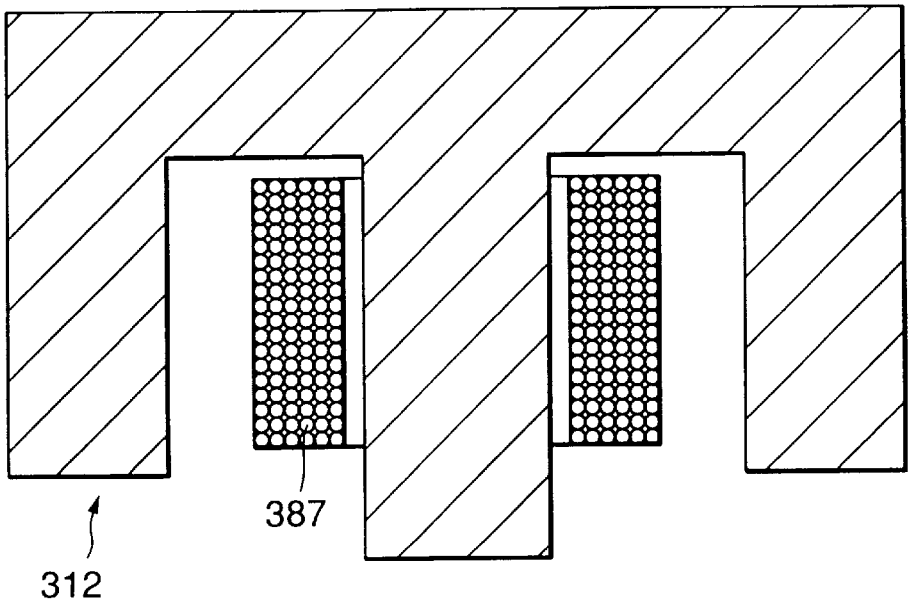

FIG. 64A and FIG. 64B are diagrams showing a thirty-ninth embodiment of the present invention. In this fixing device, 9 wires of 0.3 mm in diameter are used as Litz wire and wound round a coil 387 by 12 turns and these 9 wires are maintained always in a flat-square shape. Other structure is the same as the fixing device shown in FIG. 52A.

When a coil and a core element are mounted in a roller in small diameter, it is difficult to make a core element small for density of saturation magnetic flux and the winding of a coil becomes a point. When conductors in round cross section are used as stranded wire as before and a coil is composed, many spaces are produced and make a coil and a core large in size.

On the contrary, when 9 wires of 0.3 mm in diameter are wound round the coil 387 as Litz wire by 12 turns and further, these 9 wires are maintained always in a flat and square shape as shown in the thirty-ninth embodiment, it becomes possible to provide a space between a roller and a coil and core elements. Accordingly, a large effect can be expected for insulation measures and temperature rises of a coil and a core element.

Figure 65A:
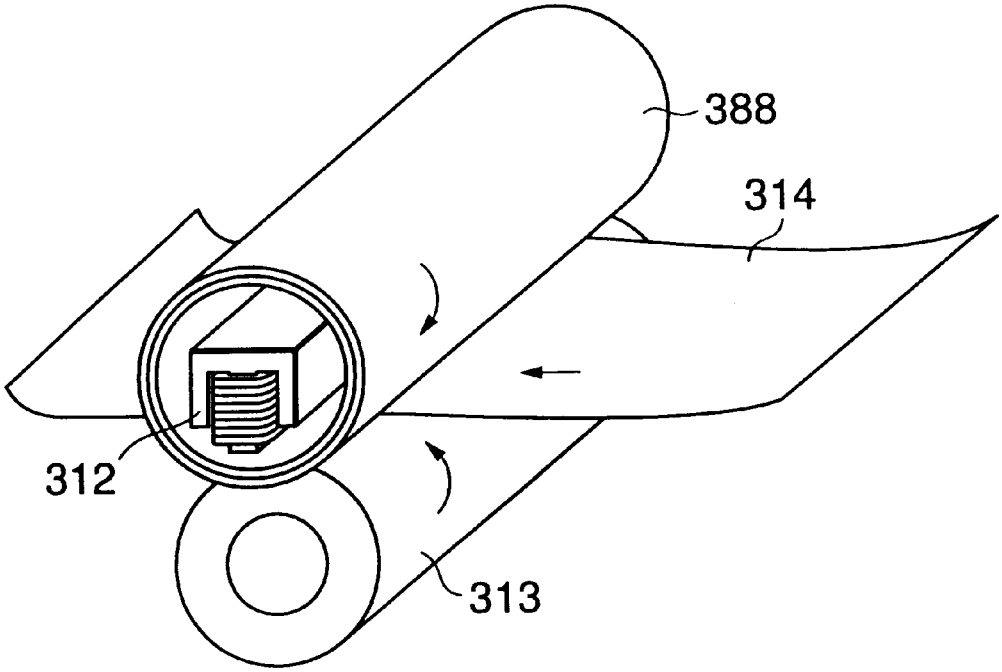
FIG. 65A and FIG. 65B are perspective views showing a fixing device in a fortieth embodiment of the present invention, respectively.
Figure 65B:
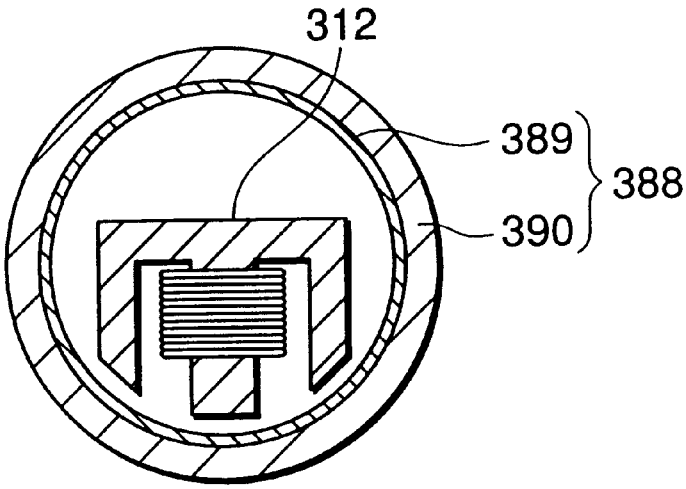

FIG. 65A and FIG. 65B are diagrams showing a fortieth embodiment of the present invention. This fixing device is in the same structure as the fixing device shown in FIG. 52A excepting that as a conductive roller 388, a stainless steel tube 389 of 50 mm in diameter and 1 mm thick made of a 5 mm thick fusion forged aluminum layer 390 is used.

In general, with the increase in printing speed, a fixing device of a copying machine consumed much energy for printing and it was necessitated to make a fixing roller more thick and increase heat capacity. Further, thermal conductivity of iron, stainless steel, etc. that are suited for induction heating is low and if a fixing roller was made using these materials, uneven temperature was generated on the surface depending on various print sizes and it was difficult to solve this problem. Furthermore, when the roller thickness was increased, thee was such a defect that its weight was increased sharply more than aluminum.

So, the composition of iron, stainless steel and nickel that are magnetic materials suited to the induction heating with aluminum that has high thermal conductivity was examined but it was extremely difficult to composite metals having different rates of thermal expansion.

In this fortieth embodiment, it was confirmed that when stainless steel and aluminum were combined by the fusion forging, the bonding between the boundary was strong and hardly separated and its effect was cleared. In this fortieth embodiment, when the surface of the fixing roller is made of aluminum, it is easy to perform such processes as crowning, etc. further, when the surface of the roller is covered with a good mold releasing Teflon or other resins, it is effective for preventing toner offset.

Further, in FIG. 65B, a gap between the stainless steel tube 389 and a core element close thereto is desirable below 10 mm in order for obtaining high thermal efficiency.

Figure 66A:
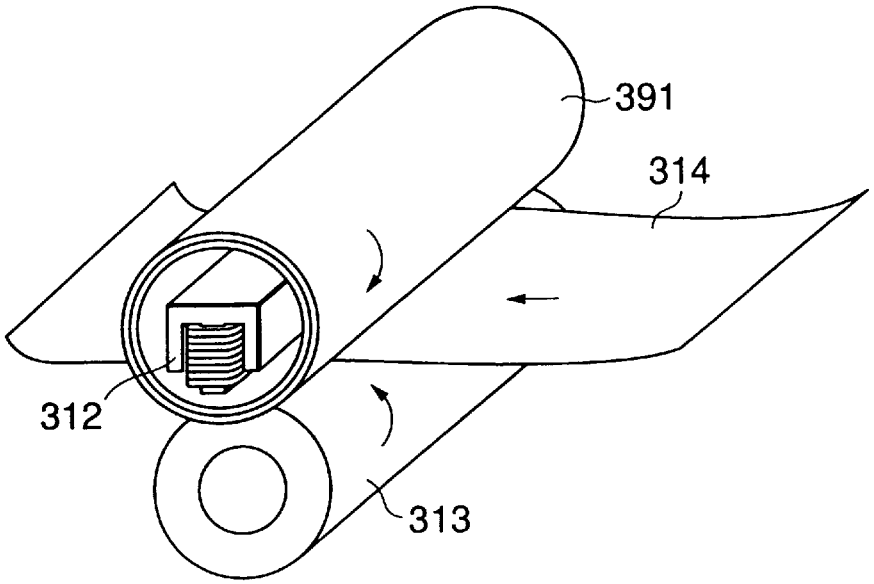
FIG. 66A through FIG. 66C are perspective views showing a fixing device in a forty-first embodiment of the present invention, respectively.
Figure 66B:
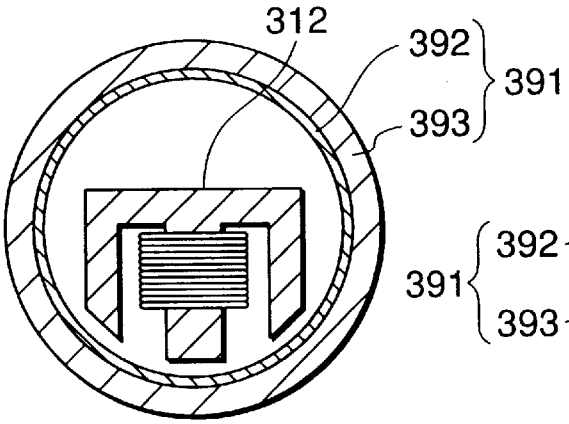
Figure 66C:
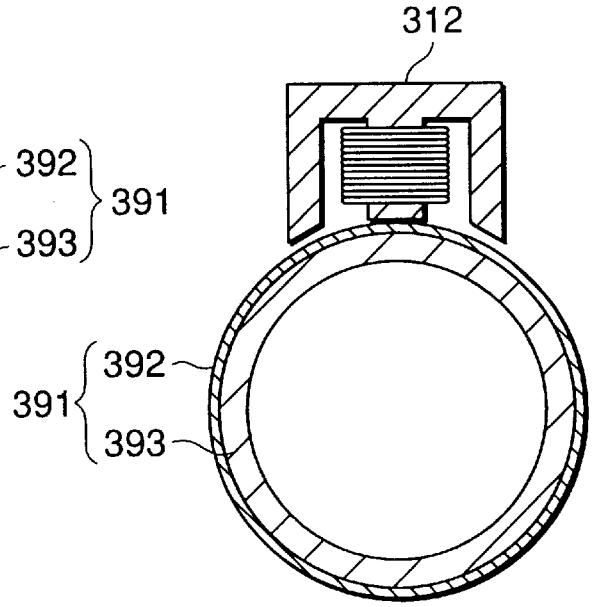

FIG. 66A through FIG. 66C are diagrams showing a forty-first embodiment of the present invention As a conductive roller 391, this fixing device uses a stainless steel tube 392 of which outside is 50 mm in diameter and 1 mm thick made of a fusion forged 5 mm thick aluminum layer 393 and the inside is a 5 mm thick fusion forged aluminum layer 393. Other construction is the same as the fixing device shown in FIG. 52A.

It was revealed that when combining ion, stainless steel or nickel that are magnetic materials suited to the induction heating with aluminum that has high thermal conductivity, desired eddy current and heating are not generated if there is a conductive layer between an eddy current generating layer and a coil. Taking this into consideration, in this forty-first embodiment, when stainless steel and aluminum are combined by the fusion forging, aluminum that is a conductive layer is placed at the outside of the stainless steel against a coil so that the magnetic field generated in the coil fully acts on the stainless steel to improve efficiency.

That is, it is better to arrange the aluminum layer 393 at the outside of the stainless steel tube 392 when the oil is at the inside of the conductive roller 391 and to arrange the aluminum layer 393 at the inside of the stainless tube 392 when the coil is at the outside of the conductive roller 391.

Further, when the aluminum layer 393 is arranged at the outside of the stainless steel tube 392, there is such a merit that the crowning and other processes becomes easy. Further, if a mold releasing Teflon and other resins are coated on the surface, it is effective for preventing toner offset.

What is claimed is:

1. A fixing device comprising:

a first roller that is made of a conductive material, and driven to be rotated;

a second roller that is in contact with the first roller in the pressed state to pass a fixing medium on which a developer image is formed between the first and second rollers;

an induction heating unit that is arranged at the first roller side and concentrates the induction heating to a nip portion of the first roller to change the developer image formed on the fixing medium to a fixed image, the induction heating unit making at least one heat distribution portion on the first roller; and separation means for separating the second roller from one of said at least one heat distribution portion on the first roller while the first roller is rotated and driven and its temperature rises to a fixable temperature either at the time of warm-up or at the time of ready.

2. A fixing device comprising:

a first roller that is made of a conductive material, and driven to be rotated;

a second roller that is in contact with the first roller in the pressed state to pass a fixing medium on which a developer image is formed between the first and second rollers;

an induction heating unit that is arranged at the first roller side and concentrates the induction heating to a nip portion of the first roller to change the developer image formed on the fixing medium to a fixed image, the induction heating unit making at least one heat distribution portion on the first roller; and a separator to separate the second roller from one of said at least one heat distribution portion on the first roller while the temperature of one of the heat distribution portion on the first roller rises to a fixable temperature at the time of warm-up and cancels the separation of the second roller and brings it to contact the first roller after reaching a specified temperature.

3. A fixing device comprising:

a first roller that is made of a conductive material, and driven to be rotated;

a second roller that is in contact with the first roller in the pressed state to pass a fixing medium on which a developer image is formed between the first and second rollers;

an induction heating unit that is arranged at the first roller side and concentrates the induction heating to a nip portion of the first roller to change the developer image formed on the fixing medium to a fixed image, the induction heating unit making at least one heat distribution portion on the first roller; and a separator to separate the second roller from one of said at least one heat distribution portion on the first roller after a copying operation is started and cancels the separation of the second roller and brings it to contact the first roller immediately before the fixing medium goes into a nip portion between the first and second rollers.

4. A fixing device comprising:

a first roller that is made of a conductive material, and driven to be rotated;

a second roller that is in contact with the first roller in the pressed state to pass a fixing medium on which a developer image is formed between the first and second rollers;

an induction heating unit that is arranged at the first roller side and concentrates the induction heating to a nip portion of the first roller to change the developer image formed on the fixing medium to a fixed image, the induction heating unit making at least one heat distribution portion on the first roller; and a separator to separate the second roller from one of said at least one heat distribution portion on the first roller after a copying operation is started and releases the separation of the second roller and bring it to contact the first roller immediately before the fixing medium goes into a nip portion between the first and second rollers.

* * * * *